US012733705B2

(12) United States Patent
Adams et al.

(10) Patent No.: US 12,733,705 B2
(45) **Date of Patent: *Sep. 15, 2026**

(54) HARD HAT WITH FAN

(71) Applicant: Milwaukee Electric Tool Corporation, Brookfield, WI (US)

(72) Inventors: Caleb C. Adams, Milwaukee, WI (US); Trent T. Bauters, West Allis, WI (US); Jesse J. Brown, Milwaukee, WI (US); Bryce M. Lee, Glendale, WI (US); Samuel L. Lombardi, Milwaukee, WI (US); James C. Popp, Milwaukee, WI (US); Christopher Sosnowski, Milwaukee, WI (US); Thomas S. Whitburn, Milwaukee, WI (US); Todd A. Zeilinger, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/228,335

(22) Filed: Jun. 4, 2025

(65) Prior Publication Data

US 2025/0288045 A1 Sep. 18, 2025

Related U.S. Application Data

(63) Continuation of application No. 18/410,562, filed on Jan. 11, 2024, now Pat. No. 12,336,587.

(Continued)

(51) Int. Cl.
*A42B 3/28* (2006.01)

(52) U.S. Cl.
CPC ..... *A42B 3/286* (2013.01); *A42B 3/28* (2013.01); *A42B 3/281* (2013.01); *A42B 3/283* (2013.01)

(58) Field of Classification Search
CPC ..... A42B 3/286; A42B 3/28; A42B 3/281; A42B 3/283; A42B 3/125; A42B 3/142; A42B 3/145; A42B 3/08
See application file for complete search history.

(56) References Cited

U.S. PATENT DOCUMENTS 5,283,914 A 2/1994 James
6,094,750 A 8/2000 Lee (Continued)

FOREIGN PATENT DOCUMENTS

CN 1325000 C 7/2007
CN 205432309 U 8/2016

(Continued)

OTHER PUBLICATIONS

Bolt Low-Profile Headlamp Mount, <https://www.milwaukeetool.com/Products/Safety-Solutions/Personal-Protective-Equipment/48-73-1094>, believed to be commercially available at least by Dec. 4, 2022, Retrieved on Jan. 8, 2024, 5 pages.

(Continued)

*Primary Examiner* — Khaled Annis
(74) *Attorney, Agent, or Firm* — Reinhart Boerner Van Deuren s.c.

(57) ABSTRACT

Various hard hat fan systems are provided. In a certain embodiment, fan system includes an impact absorbing layer with a channel that defines a recessed surface which extends into the impact absorbing layer away from an inner surface of a shell of a hard hat. Together, the inner surface of the shell and the recessed surface define a duct configured to provide fluid communication between an inlet of the channel and an air vent positioned along the channel. In another embodiment, fan system includes a mounting bracket with first and second cam levers which may be actuated into a locked position, and first and second channels. When in the locked position, the first and second cam levers bias the (Continued)

edges of a mounting ridge of the shell against the first and second channels of the mounting bracket such that the mounting bracket is retained on the shell.

20 Claims, 41 Drawing Sheets

Related U.S. Application Data

(60) Provisional application No. 63/500,808, filed on May 8, 2023, provisional application No. 63/492,679, filed on Mar. 28, 2023, provisional application No. 63/487,121, filed on Feb. 27, 2023, provisional application No. 63/482,106, filed on Jan. 30, 2023.

(56) References Cited

U.S. PATENT DOCUMENTS

| | | | |
|---|---|---|---|
| 6,247,186 | B1 | 6/2001 | Huang |
| 6,694,529 | B1 | 2/2004 | Chiu |
| 7,475,434 | B2 | 1/2009 | Ambuske et al. |
| RE43,173 | E | 2/2012 | Ambuske et al. |
| 8,296,867 | B2 | 10/2012 | Rudd et al. |
| 9,510,632 | B2 | 12/2016 | Perusse et al. |
| 9,510,633 | B2 | 12/2016 | Rudd et al. |
| 9,578,916 | B2 | 2/2017 | Daniels et al. |
| 9,924,753 | B1 | 3/2018 | Soto et al. |
| 9,924,754 | B1 | 3/2018 | Soto et al. |
| 9,974,350 | B2 | 5/2018 | Perusse et al. |
| 10,165,817 | B2 | 1/2019 | Redpath et al. |
| 10,334,902 | B2 | 7/2019 | Vilone et al. |
| 10,575,578 | B2 | 3/2020 | Soto et al. |
| 11,019,870 | B2 | 6/2021 | Hyma |
| 11,116,273 | B2 | 9/2021 | Rudd et al. |
| 11,131,310 | B1 | 9/2021 | Emery |
| 11,213,087 | B2 | 1/2022 | Hyma |
| 11,241,060 | B2 | 2/2022 | Wong |
| 11,266,199 | B2 | 3/2022 | Wong |
| 11,363,850 | B2 | 6/2022 | Vilone et al. |
| 11,528,952 | B2 | 12/2022 | Hyma |
| 11,583,023 | B2 | 2/2023 | Jones et al. |
| 11,717,047 | B2 | 8/2023 | Wong |
| 12,336,587 | B2 * | 6/2025 | Adams ..... A42B 3/281 |
| 2005/0066416 | A1 | 3/2005 | Ma |
| 2006/0053528 | A1 | 3/2006 | English |
| 2006/0101556 | A1 | 5/2006 | Goldsborough |
| 2013/0139818 | A1 | 6/2013 | Billingsley et al. |
| 2015/0143613 | A1 | 5/2015 | Chu |
| 2016/0249702 | A1 | 9/2016 | Pfanner et al. |
| 2016/0255901 | A1 | 9/2016 | Jeon |
| 2017/0072286 | A1 | 3/2017 | Rudd et al. |
| 2017/0127745 | A1 | 5/2017 | Daniels et al. |
| 2017/0215511 | A1 | 8/2017 | Albani |
| 2018/0077993 | A1 | 3/2018 | Bertolo |
| 2019/0044919 | A1 | 2/2019 | Lindsey |
| 2019/0150550 | A1 | 5/2019 | Zoref |
| 2019/0191812 | A1 | 6/2019 | Salem et al. |
| 2020/0221809 | A1 | 7/2020 | Burke |
| 2020/0275722 | A1 | 9/2020 | Higuchi |
| 2021/0100310 | A1 | 4/2021 | Kim |
| 2021/0112901 | A1 | 4/2021 | Rodgers |
| 2022/0015488 | A1 | 1/2022 | Adams et al. |
| 2022/0047030 | A1 | 2/2022 | Summersett et al. |
| 2022/0047033 | A1 | 2/2022 | Zeilinger et al. |
| 2022/0132973 | A1 | 5/2022 | Wong |
| 2022/0248797 | A1 | 8/2022 | Zeilinger et al. |
| 2022/0287403 | A1 | 9/2022 | Summersett et al. |
| 2022/0386735 | A1 | 12/2022 | Agustsson |
| 2023/0122996 | A1 | 4/2023 | Hyma |
| 2023/0148698 | A1 | 5/2023 | Jones et al. |
| 2023/0157398 | A1 | 5/2023 | Lombardi et al. |
| 2023/0180880 | A1 | 6/2023 | Melofchik et al. |
| 2023/0329386 | A1 | 10/2023 | Wong |
| 2024/0251904 | A1 | 8/2024 | Adams et al. |
| 2024/0268714 | A1 | 8/2024 | Hashimoto et al. |

FOREIGN PATENT DOCUMENTS

| | | | |
|---|---|---|---|
| CN | 206630060 | U | 11/2017 |
| CN | 110367636 | A | 10/2019 |
| CN | 110716310 | A | 1/2020 |
| CN | 112545098 | A | 3/2021 |
| CN | 214509721 | U | 10/2021 |
| CN | 215737141 | U | 2/2022 |
| DE | 202021105934 | U1 | 12/2021 |
| EP | 0903086 | B1 | 2/2003 |
| EP | 3174416 | B1 | 6/2018 |
| JP | 2003119611 | | 4/2003 |
| JP | 2017089060 | | 5/2017 |
| KR | 20220020594 | | 2/2022 |
| WO | WO98/46095 | | 10/1998 |
| WO | WO2005/055752 | | 6/2005 |
| WO | WO05102090 | A1 | 11/2005 |
| WO | WO2008/085108 | | 7/2008 |
| WO | WO2010075391 | | 7/2010 |
| WO | WO13175932 | A1 | 11/2013 |
| WO | WO2015/052251 | | 4/2015 |
| WO | WO2015/077721 | | 5/2015 |
| WO | WO15064926 | A1 | 5/2015 |
| WO | WO2015/123280 | | 8/2015 |
| WO | WO2016/016710 | | 2/2016 |
| WO | WO2016/112987 | | 7/2016 |
| WO | WO2018/147898 | | 8/2018 |
| WO | WO2019/008434 | | 1/2019 |
| WO | WO2019/125589 | | 6/2019 |
| WO | WO2020/106878 | | 5/2020 |
| WO | WO20241994 | A1 | 12/2020 |
| WO | WO2021/089619 | | 5/2021 |
| WO | WO2022/016040 | | 1/2022 |
| WO | WO2022/039977 | | 2/2022 |
| WO | WO2022/039990 | | 2/2022 |
| WO | WO2023/092131 | | 5/2023 |
| WO | WO2023/107627 | | 6/2023 |

OTHER PUBLICATIONS

Bolt Redlithium USB Headlamp, <https://www.milwaukeetool.com/Products/Lighting/Personal-Lighting/2118-21>, believed to be commercially available at least by Jan. 30, 2023, Retrieved on Jan. 8, 2024, 6 pages.

Bolt Front Brim Safety Helmet (USA), <https://www.milwaukeetool.com/Products/Safety-Solutions/Personal-Protective-Equipment/Head-Protection/Front-Brim-Safety-Helmet>, believed to be commercially available at least by Nov. 28, 2021, Retrieved on Jan. 8, 2024, 12 pages.

Bolt Eye Visor Mount Replacement, <https://www.milwaukeetool.com/Products/Safety-Solutions/Personal-Protective-Equipment/BOLT-Eye-Visor-Mount-Replacement>, believed to be commercially available at least by Jan. 7, 2024, Retrieved on Jan. 8, 2024, 3 pages.

Bolt Full Face Shield Mount Replacement (Helmet & Hard Hat), <https://www.milwaukeetool.com/Products/Safety-Solutions/Personal-Protective-Equipment/48-73-1448>, believed to be commercially available at least by Jan. 7, 2024, Retrieved on Jan. 8, 2024, 3 pages.

Bolt Full Face Shield Mount Replacement (No Brim Helmet Only), <https://www.milwaukeetool.com/Products/Safety-Solutions/Personal-Protective-Equipment/48-73-1449>, believed to be commercially available at least by Jan. 7, 2024, Retrieved on Jan. 8, 2024, 3 pages.

* cited by examiner

HARD HAT WITH FAN

CROSS-REFERENCE TO RELATED PATENT APPLICATIONS

This application is a continuation of U.S. application Ser. No. 18/410,562, filed Jan. 11, 2024, which claims the benefit of and priority to U.S. Provisional Application No. 63/500,808, filed on May 8, 2023, and U.S. Provisional Application No. 63/492,679, filed on Mar. 28, 2023, and U.S. Provisional Application No. 63/487,121, filed on Feb. 27, 2023, and U.S. Provisional Application No. 63/482,106, filed Jan. 30, 2023, each of which are incorporated herein by reference in their entirety.

BACKGROUND OF THE INVENTION

The present invention relates generally to the field of hard hats. The present invention relates specifically to a hard hat with a fan, an attachment system for a fan, a hard hat power supply for a fan or other powered hard hat accessory, a manifold system for a hard hat with a fan, and/or a sunshade attachment system for a hard hat with a fan.

SUMMARY OF THE INVENTION

One embodiment of the invention relates to a fan system for a hard hat. The fan system includes a shell, a fan, and an impact absorbing layer. The shell has an inner surface and an outer surface opposite the inner surface. The fan is coupled to the outer surface of the shell. The impact absorbing layer has an outer surface and an inner surface opposite the outer surface. The outer surface of the impact absorbing layer is coupled to the inner surface of the shell, and the inner surface of the impact absorbing layer defines an interior region configured to receive the head of a user. A recessed surface is formed in the outer surface of the impact absorbing layer and defines a channel extending along the outer surface of the impact absorbing layer. An air vent extends from the recessed surface, through the impact absorbing layer, and to the inner surface of the impact absorbing layer. A primary duct extends between the fan and the impact absorbing layer such that the primary duct directs air into an inlet side of the channel. The channel defines a secondary duct between the outer surface of the impact absorbing layer and the inner surface of the shell such that air flows from the inlet side of the channel to the air vent and into the interior region. In this way, the fan system is configured to provide fluid communication for air between and exterior of the shell and the interior region.

Another embodiment of the invention relates to a fan system for a hard hat. The fan system includes a shell, a fan, and an impact absorbing layer. The shell has an inner surface and an outer surface opposite the inner surface. The fan is coupled to the outer surface of the shell, and the impact absorbing layer is coupled to the inner surface of the shell. The impact absorbing layer includes at least one channel extending a distance along the length of the impact absorbing layer and an air vent. The at least one channel defines a recessed surface extending into the impact absorbing layer away from the inner surface of the shell. The air vent is positioned along the recessed surface and extends through the impact absorbing layer. In this way, the inner surface of the shell and the recessed surface of the impact absorbing layer define a duct configured to provide fluid communication between an inlet of the channel and the air vent.

Another embodiment of the invention relates to a hard hat fan system. The fan system including a shell, a mounting bracket, and a fan coupled to the mounting bracket. The shell is configured to receive the head of a user and includes an outer surface and a mounting ridge extending away from the outer surface. The mounting ridge has a first edge and a second edge opposite the first edge. The mounting bracket is configured to securely and removably couple to the mounting ridge. The mounting bracket includes a mounting plate, a first channel, a second channel, a first cam lever, and a second cam lever. The mounting plate has a front surface and a back surface opposite the front surface. The first channel is located on the back surface of the mounting plate and is configured to couple to the first edge of the mounting ridge. The second channel is located opposite the first channel along the back surface of the mounting plate and is configured to couple to the second edge of the mounting ridge. The first cam lever is pivotally coupled to the front surface of the mounting plate opposite the first channel, and the second cam lever is pivotally coupled to the front surface of the mounting plate opposite the second channel. The first cam lever and the second cam lever are configured to actuate between an unlocked position and a locked position. As such, when the first cam lever and the second cam lever are actuated into the locked position, the first cam lever biases the first edge of the mounting ridge against the first channel, and the second cam lever biases the second edge of the mounting ridge against the second channel such that the mounting bracket is retained on shell.

Additional features and advantages will be set forth in the detailed description which follows and, in part, will be readily apparent to those skilled in the art from the description or recognized by practicing the embodiments as described in the written description and the drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain the principles and operation of the various embodiments. In addition, alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
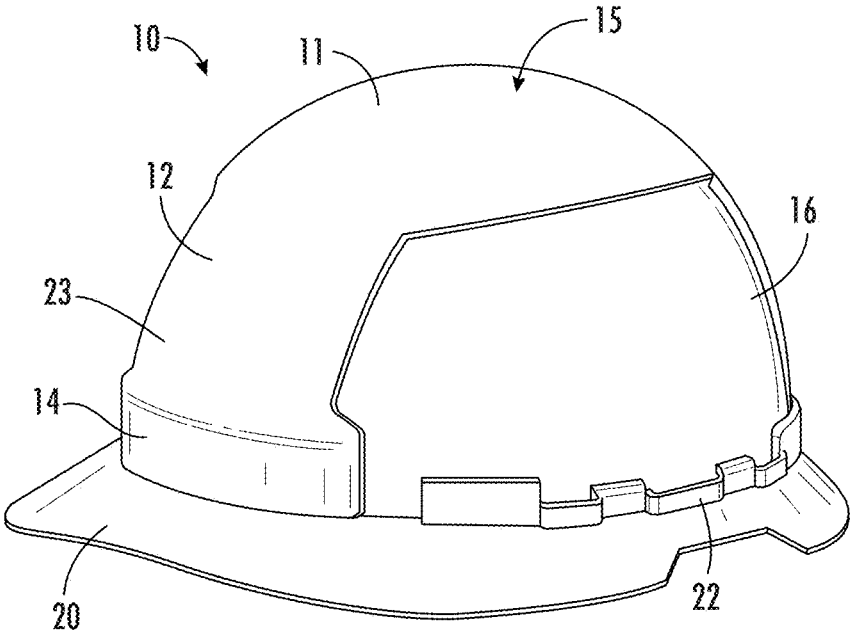
FIG. 1 is a front perspective view of a hard hat, according to an exemplary embodiment.

Referring generally to the figures, various embodiments of a hard hat with a fan are shown. Hard hats may be used in a variety of construction jobs or other situations. Those wearing hard hats complete a wide range of tasks and physical labor. These tasks may be performed in confined spaces or outdoors, which includes hot and unventilated environments. In some conventional hard hats with fans, a fan is embedded in the shell or the helmet and/or may be otherwise rigidly attached to the hard hat. However, Applicant has identified that such arrangements may provide ineffective cooling, limit the ability to attach additional accessories to the hard hat, result in uncomfortable or obstructed fan positioning, and limit the ability to adjust the fan as needed for a variety of uses.

In contrast, as discussed herein, Applicant has developed various fan systems and related system that are believed to provide for various advantages over typical hard hat fans, including improved fan attachment and support of a hard hat suitable for construction or similar jobsite uses. Specifically, the fan systems discussed herein may utilize a fan mounting bracket, a fan hinge, and a fan frame that allows for secure attachment of the fan to a hard hat. In certain embodiments, the fan system utilizes a hinge including a stopping structure positioned to limit the hinge's range of movement towards the user. The hinge including the stopping structure allows users to complete dynamic movements while limiting/preventing the fan from pivoting to positions in which the fan may collide with the user, the hard hat, or other equipment that may be worn by the user.

In addition, the hard hat fan systems discussed herein may be structured to provide for comfortable weight distribution across the hard hat. Applicant has determined that some hard hat accessory attachment arrangements may cause imbalance or uneven/uncomfortable weight distribution. In some embodiments, the hard hat fan system discussed herein include a power source system located on an opposite side of the hard hat from the fan system. Specifically, in such embodiments, the hard hat includes a power source system located on the front of the hard hat to counterbalance the weight of the fan system added to the rear of the hard hat.

In a specific embodiment, the power source system is configured to provide lateral weight distribution and accessibility to a front accessory attachment location for the hard hat. In this embodiment, the power source of the power source system includes first and second segments (e.g., left and right battery cells) evenly spaced on either side of the front mounting location of the hard hat providing for lateral weight distribution to the hard hat. In a specific embodiment, the power source mount of the power source system includes an attachment device for mounting an accessory, such as a lamp accessory, to the front of the hard hat. It should be understood that while the power source systems discussed herein are described primarily in the context of powering hard hat fans, the power source systems can be used to power a wide variety of powered/electronic hard hat accessories, including light sources, sensors, communications equipment, auditory equipment, etc.

In addition, various embodiments of the hard hat systems discussed herein include a manifold system. Applicant has developed various manifold systems that are believed to provide for various advantages, such as improved distribution of cooling air to the head and neck of a wearer and improved removal of humid/hot air from between the user's head and the hard hat. Applicant believes that the manifold system designs discussed herein allow for a variety of air routing/direction arrangements to further improve cooling and comfort delivered by the fan system. Specifically, the manifold systems discussed herein utilize a primary duct attached to the fan and a plurality of air vents position to direct air towards various locations of the head of a user.

In certain embodiments, a secondary duct is attached to the primary duct opposite the fan. The secondary duct extends around the lower circumference of the hard hat, and the air vents are attached to the secondary duct to simultaneously provide cooling to the face, neck, and head of a user.

In certain other embodiments, the primary duct is attached to a head liner. The head liner is designed to fit between the inner surface of the hard hat and the head of the user. The liner includes a plurality of vents to direct air downward onto the user's head to provide a cooling sensation to the user. The liner also assists in exhausting hot or humid air trapped inside the hard hat by pushing in ambient air from outside the hard hat.

In certain other embodiments, the hard hat includes an impact absorbing layer, and the manifold system includes a plurality of secondary ducts embedded in the impact absorbing layer. In some embodiments the primary duct is attached to the air outlet of the fan. In such embodiments, the manifold system is configured to direct air into the hard hat to exhaust hot/humid air and replace it with ambient air. Alternatively, in some embodiments the primary duct is attached to the air intake of the fan. In such embodiments, the hard hat includes ports that allow ambient air to be drawn into the helmet while hot/humid air is vacuumed out by the manifold system. In addition, various embodiments of the hard hat systems discussed herein include a cross flow fan.

In addition, various embodiments of the hard hat systems discussed herein include a sunshade attachment system. Applicant has developed a sunshade attachment system to provide for various advantages, such as allowing for a sunshade to be attached to a hard hat that has a fan. A sunshade can provide the benefit of protecting a user's skin from ultraviolet radiation in hot and sunny environments. As such, a sunshade can work in tandem with a fan to provide a cooling sensation to the back of a user's neck. Specifically, the sunshade attachment system herein includes a first receiver located at a first end of the brim mounting bracket, a second receiver located at a second end of the brim mounting bracket, and a retention groove along the outer edge of a brim mounting attachment. The sunshade includes a cord, a first retention anchor at a first end of the cord, and a second retention anchor opposite the first retention anchor on a second end of the cord. Thus, when the sunshade is coupled to the sunshade attachment system, the cord is received in the retention groove, the first retention anchor is received in the first receiver, and the second retention anchor is received in the second receiver. This allows the sunshade to hang behind a fan attached to the brim mounting attachment and not interfere with the operation of the fan.

In addition, various embodiments of the hard hat fan systems discussed herein include an impact absorbing layer with an outer surface coupled to an inner surface of the hard hat. A recessed surface is formed in the outer surface of the impact absorbing layer and defines a channel extending along the outer surface of the impact absorbing layer. Together, the inner surface of the hard hat and the recessed surface define a duct configured to provide fluid communication between an inlet of the channel and an air vent to provide air to a user's head and, thus, provide a cooling sensation to the user.

In contrast to some vented hard hats, Applicant believes that by utilizing a duct design in which cooling air travels in a duct defined between the impact absorbing layer and the inner surface of the hard hat (as opposed to traveling via a duct completely defined within an impact absorbing layer) air movement and heat/moisture transfer away from a user's head may be improved. Further, Applicant believes that by forming a recessed surface in the outer surface of the impact absorbing layer (as opposed to a duct completely defined within a impact absorbing layer) may provide manufacturing advantages by allowing easy molding of the recessed surfaced on the outer surface of the impact absorbing layer.

In addition, various embodiments of the hard hat fan systems discussed herein include a mounting bracket configured to securely and removably couple to a mounting ridge of the hard hat. Specifically, mounting bracket includes a first channel and a second channel configured to couple to the mounting ridge when a first cam lever and a second cam lever bias opposing edges of the mounting ridge against an inner wall of first and second channels.

Referring generally to the figures, a protective helmet or hard hat 10 with a fan system is shown and described. Although discussed namely in the context of hard hat 10, the fan systems discussed herein are further applicable to other protective headwear, like a protective helmet. As shown, hard hat 10 includes a shell 11 with an outer surface 15. Referring to FIG. 1, a front perspective view of shell 11 is shown. Outer surface 15 of hard hat 10 includes a front side surface 12, and a rear side surface 16 that opposes front side surface 12. The front side surface 12 includes a front mounting feature or location, shown as front mounting feature 14. Front mounting feature 14 includes a mounting ridge 23. Hard hat 10 includes a bill or brim 20 that extends outward from a lower circumference of hard hat 10 around at least part of hard hat 10 to shield the eyes of a user. The hard hat 10 also includes a side accessory ridge 22 positioned between front side surface 12 and rear side surface 16 along the outer surface 15 of hard hat 10.

Figure 2:
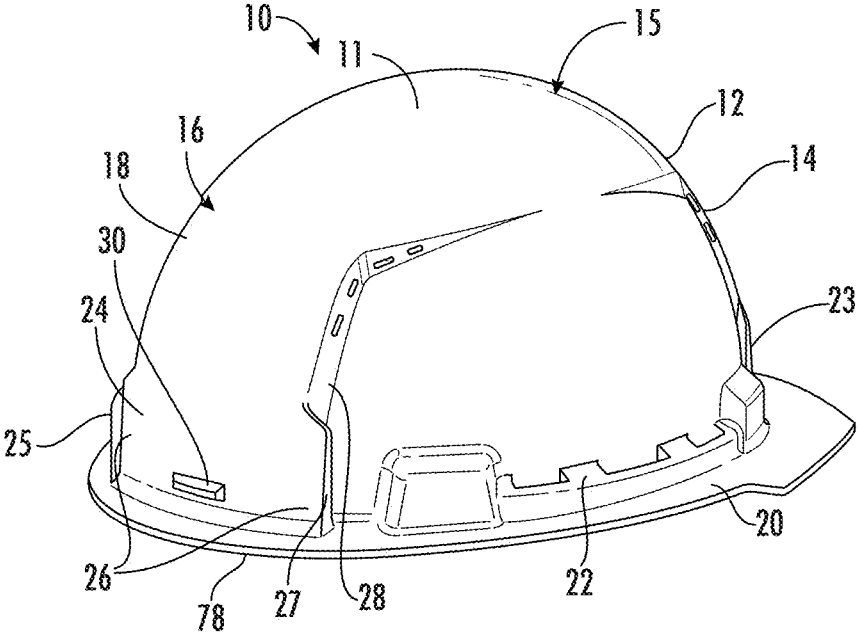
FIG. 2 is a rear perspective view of the hard hat, according to an exemplary embodiment.

Referring to FIG. 2, a rear perspective view of the hard hat 10 is shown according to an exemplary embodiment. Rear side surface 16 includes a rear mounting location or feature 18. Rear mounting feature 18 includes a mounting ridge 24. The mounting ridge 24 is configured to receive a mounting bracket for a hard hat accessory. Mounting ridge 24 includes a pair of dovetail projections or wings 26 extending outward from opposing planar surfaces 28 extending from the rear mounting feature 18. Wings 26 define a first edge 25 and a second edge 27 opposite first edge 25. Additionally, or alternatively, the mounting ridge 24 includes a retention cleat 30. Retention cleat 30 is centered on the rear mounting feature 18 between the pair of dovetail projections 26. Front mounting ridge 23 is generally the same as rear mounting ridge 24 such that mounting brackets and accessories are mountable on both. As shown, the rear mounting feature 18 is configured to receive a fan system 32.

Figure 3:
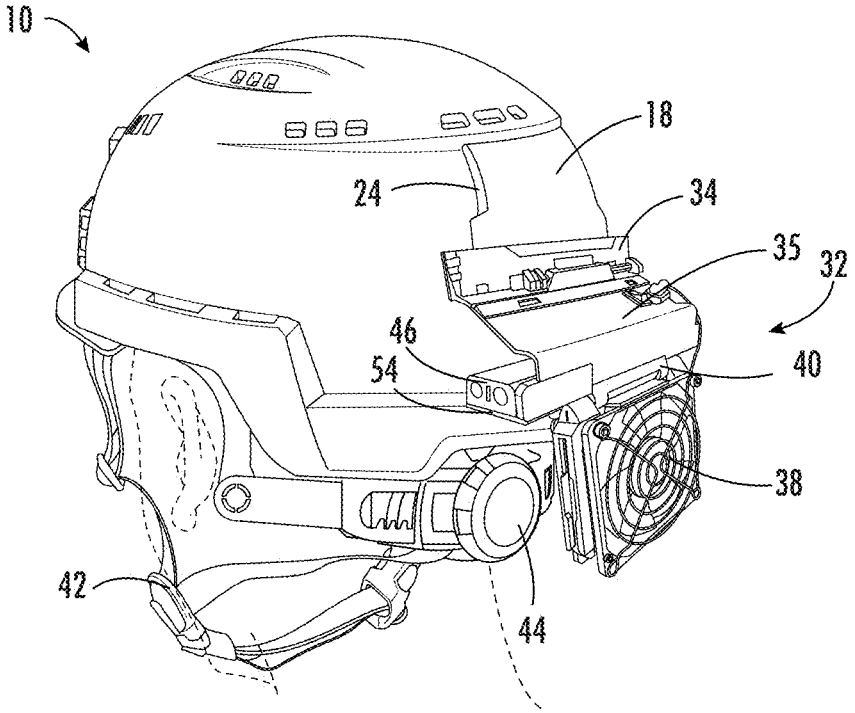
FIG. 3 is a perspective view of a fan system connected to the hard hat at a rear mounting feature, according to an exemplary embodiment.
Figure 4:
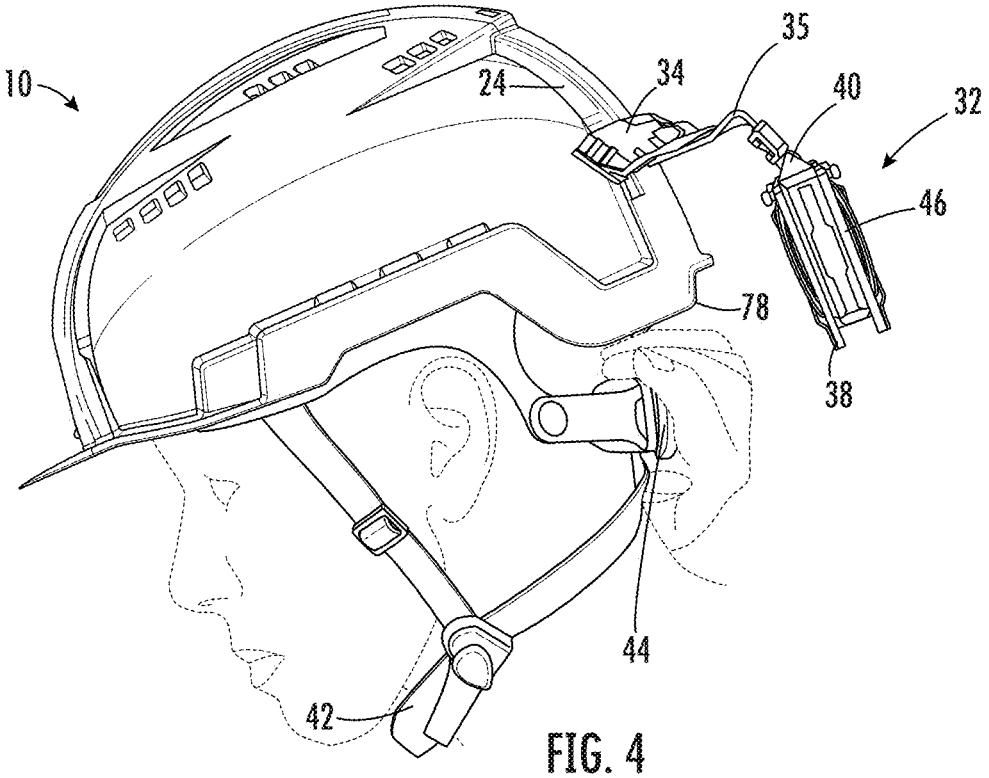
FIG. 4 is a perspective view of a fan system connected to the hard hat at the rear mounting feature illustrating positioning relative to an adjustment ratchet of a hard hat suspension system, according to an exemplary embodiment.

Referring to FIGS. 3 and 4, a fan system 32 coupled to hard hat 10 is shown. Fan system 32 is attached to the hard hat 10 at the rear mounting feature 18. Fan system 32 includes a fan attachment system or mounting bracket 34, a support arm 35, a fan frame 36, a fan 38, and a hinge 40. Fan mounting bracket 34 is securely and removably coupled to the rear mounting feature 18, and, more specifically, to mounting ridge 24. A support section, shown as support arm 35, extends outward and away from fan mounting bracket 34. Fan frame 36 is configured to house fan 38. Fan frame 36 is rotatably coupled to an outer end portion of support arm 35 by hinge 40.

Hard hat 10 includes a strap or suspension system 42 and a ratcheting system 44 that provides for adjustment/tightening of suspension system 42. As shown in FIG. 4, mounting bracket 34 and support arm 35 are sized and structured such that fan 38 is spaced from the back of a user's head providing a gap large enough to allow a user access to the ratcheting system 44 to adjust the hard hat 10 while the fan system 32 is attached to the hard hat 10.

Figure 5:
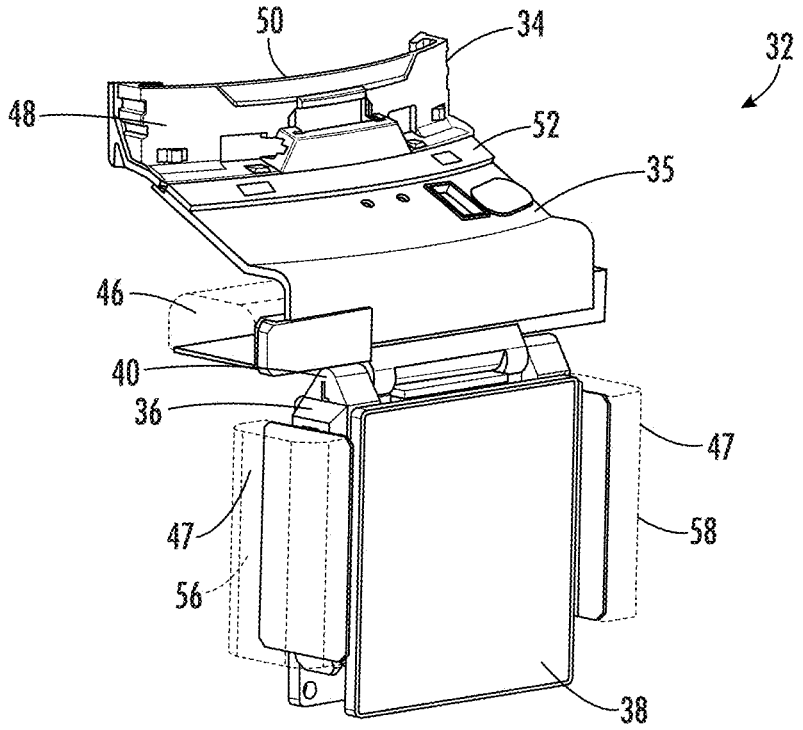
FIG. 5 is a perspective view of the fan system of FIG. 3, according to an exemplary embodiment.
Figure 6:
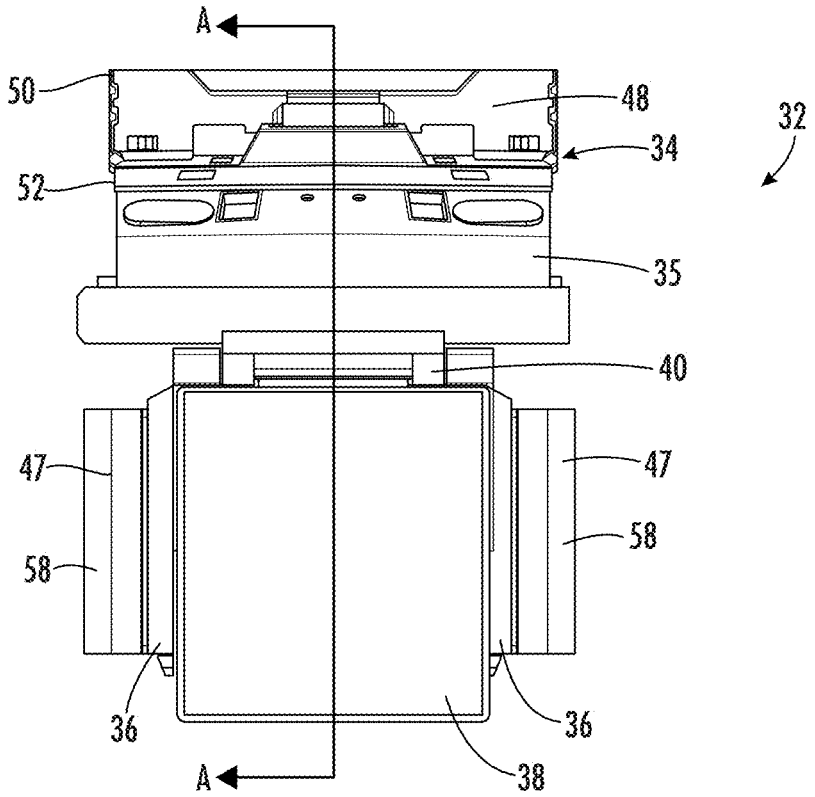
FIG. 6 is a front view of the fan system of FIG. 3, according to an exemplary embodiment.

Referring to FIGS. 5 and 6, various details of fan system 32 are shown. Fan system 32 includes a power source 46 and mounting bracket 34. Mounting bracket 34 includes a locking clip or securing mechanism 48 at a first end 50. When mounting bracket 34 is secured on mounting ridge 24 of hard hat 10, locking clip 48 locks into position engaging onto mounting ridge 24. Locking clip 48 limits/prevents accidental jarring or removal of the fan system 32 during use. In this configuration, fan system 32 is securely locked onto the hard hat 10. A user may disconnect fan system 32 by moving locking clip 48 into the unlocked position and sliding the mounting bracket 34 off of rear mounting ridge 24.

At a second end 52 of mounting bracket 34, mounting bracket 34 is attached to the support arm 35 by way of the hinge 40. Fan frame 36 is rotatably attached to support arm 35 to allow the fan 38 to adjust to a variety of user movements.

The power source 46 (e.g., one or more battery cells) is included in the fan system 32. In the embodiments shown in FIGS. 3 and 5, power source 46 is supported below support arm 35. In such configuration, fan system 32 includes a power source mount 54. As shown, power source mount 54 is a flat support that extends from the support arm 35 towards a lower end of the rear side surface 16 of hard hat 10. Power source 46 is secured to the power source mount 54 and connected to fan 38 to power it. In some embodiments, support arm 35 is structured such that when the fan mounting bracket 34 is secured to hard hat 10, an inner surface of the power source mount 54 and/or power source 46 abuts against the lower end of the rear side surface 16 of the hard hat 10. In this position, power source mount 54 does not interfere with the movement of the head of a user.

In some embodiments, as shown FIGS. 5 and 6, fan system 32 may include the power source 47 is mounted on fan frame 36. In a specific embodiment, power sources 47 are mounted vertically along the side surfaces of fan frame 36. In such configuration, power sources 47 are divided into a first segment 56 and a second segment 58. First segment 56 and second segment 58 are located on opposite sides of fan frame 36 to equally distribute the weight of the power sources 47 along the fan frame 36 to keep the frame 36 balanced. In various embodiments, fan system 32 includes both power source 46 located on the power source mount 54 and power sources 47 mounted to fan frame 36.

Figure 7:
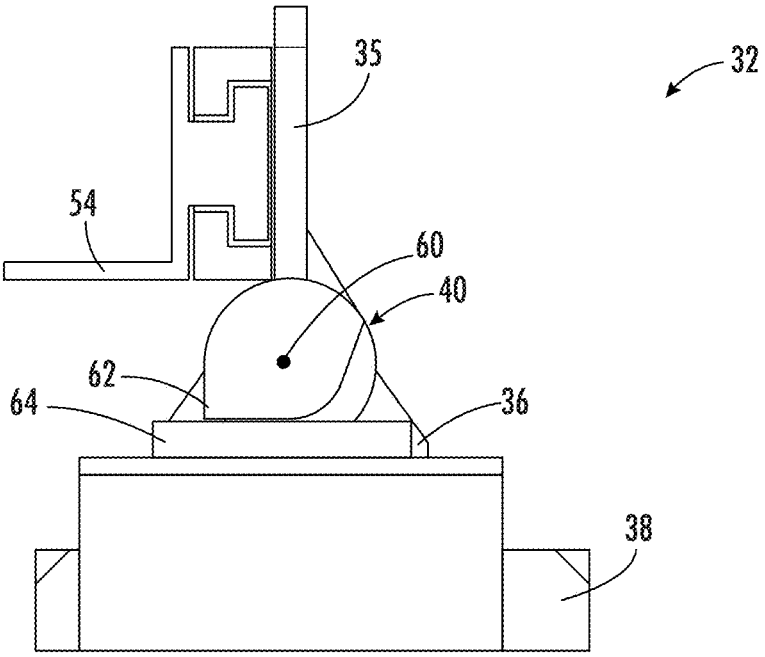
FIG. 7 is a side cross-sectional view of the fan system of FIG. 6 taken along line A-A, according to an exemplary embodiment.

Referring generally to FIGS. 7-12, details of the operation of hinge 40 are shown. Referring to FIG. 7, a side-cross sectional view of the fan system 32 is shown. The hinge 40 rotatably couples fan frame 36 to support arm 35. Hinge 40 includes a rotational axis 60 and a stopping structure 62. When fan system 32 is attached to hard hat 10, hinge 40 allows fan 38 to rotate along rotational axis 60, while mounting bracket 34 remains rigidly coupled and fixed in relation to the hard hat 10.

Figure 9:
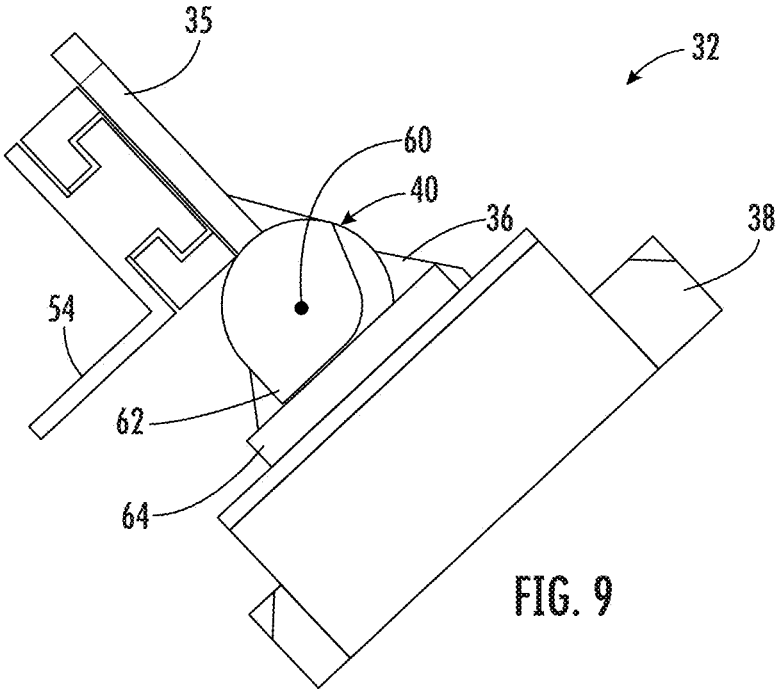
FIG. 9 is a side cross-sectional view of the fan system of FIG. 3 in a forward leaning position, according to an exemplary embodiment.
Figure 10:
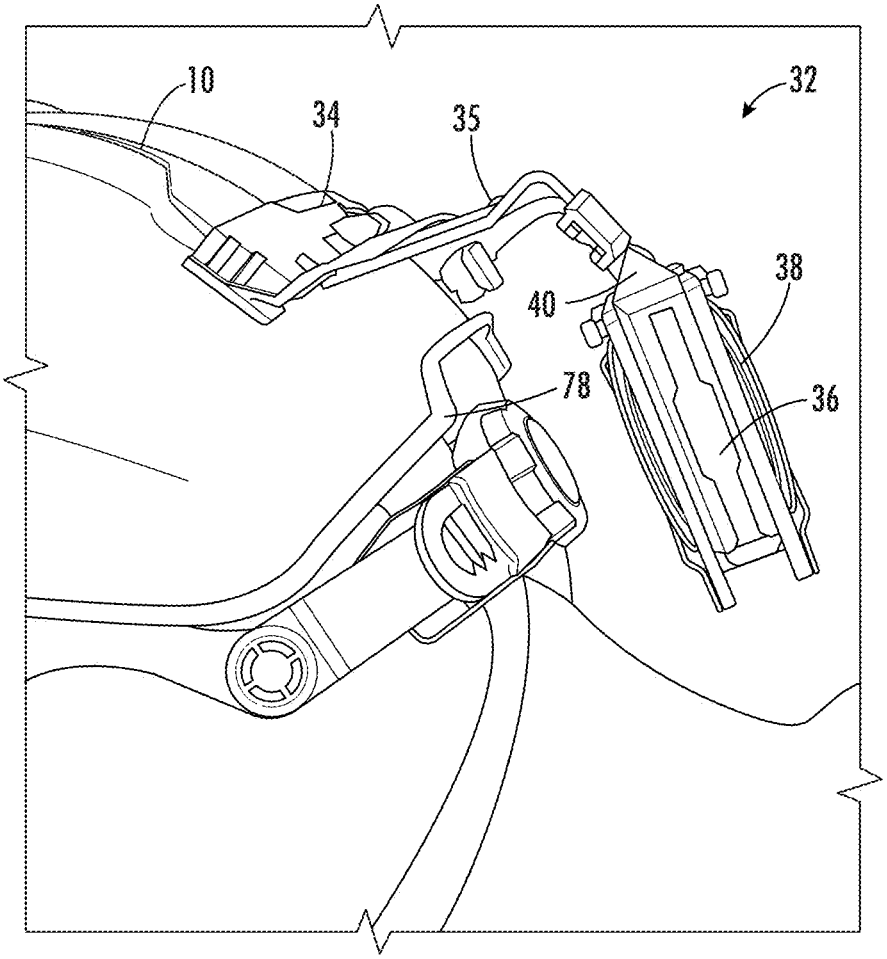
FIG. 10 is a perspective view of the fan system of FIG. 3 in a forward leaning position, according to an exemplary embodiment.

As best shown in FIGS. 9 and 10, stopping structure 62 of hinge 40 acts to limit the rotation of fan 38 in a downward direction when hinge 40 would otherwise rotate forward around the rotational axis 60. Specifically, stopping structure 62 may constrain movement of fan 38 to pitch rotation only. When the wearer leans forward, stopping structure 62 engages with a portion of fan frame 36 preventing fan frame 36 from rotating further forward around hinge 40 toward the wearer. This arrangement allows users to complete dynamic movements while limiting the fan 38 from pivoting to positions in which the fan 38 may collide with the user, the hard hat, or other equipment that may be worn by the user.

In certain embodiments, fan system 32 includes a stopping pad 64 (e.g., a foam pad) coupled to fan frame 36 and located between stopping structure 62 and fan frame 36. The stopping pad 64 is formed from a compliant material (e.g., foam, rubber, TPE, etc.) and acts as a shock absorber by reducing the speed at which stopping structure 62 limits the movement of fan 38 when the fan 38 reaches its swing limit as dictated by stopping structure 62.

Figure 8:
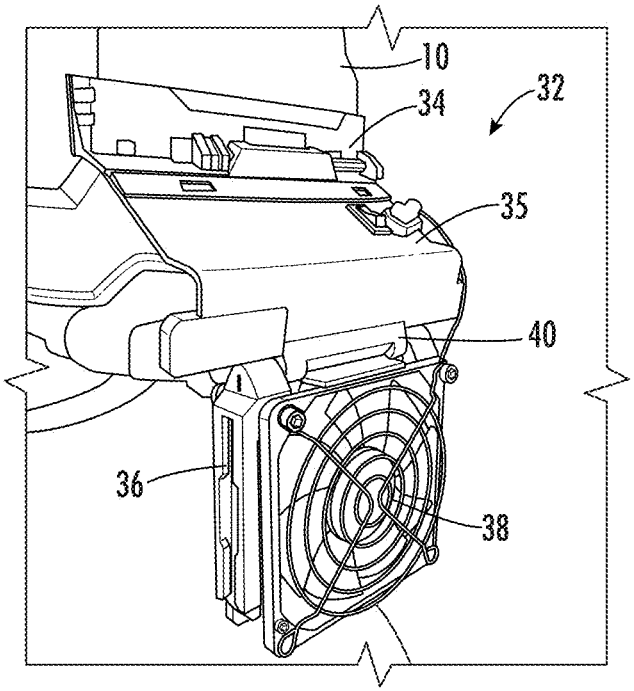
FIG. 8 is a perspective view of the fan system of FIG. 3 in a neutral hang position, according to an exemplary embodiment.

Referring to FIGS. 7 and 8, fan system 32 is in a neutral hang position. As illustrated, a user has fan system 32 coupled to hard hat 10 and the user's head is in an upright position. In this position, fan 38 can freely swing upward or downward.

Referring to FIGS. 9 and 10, fan system 32 is in a forward hanging position. As illustrated, a user has fan system 32 coupled to a hard hat 10 and the user's head is bent forward towards the ground. In this position, fan 38 is restricted from moving in the downward direction, or toward the user. Specifically, as shown, fan 38 has been prevented from swinging downward as hinge 40 rotates forward along the rotational axis 60. Stopping structure 62 is pressing against foam pad 64, and hinge 40 is prevented from rotating further along rotational axis 60.

Figure 11:
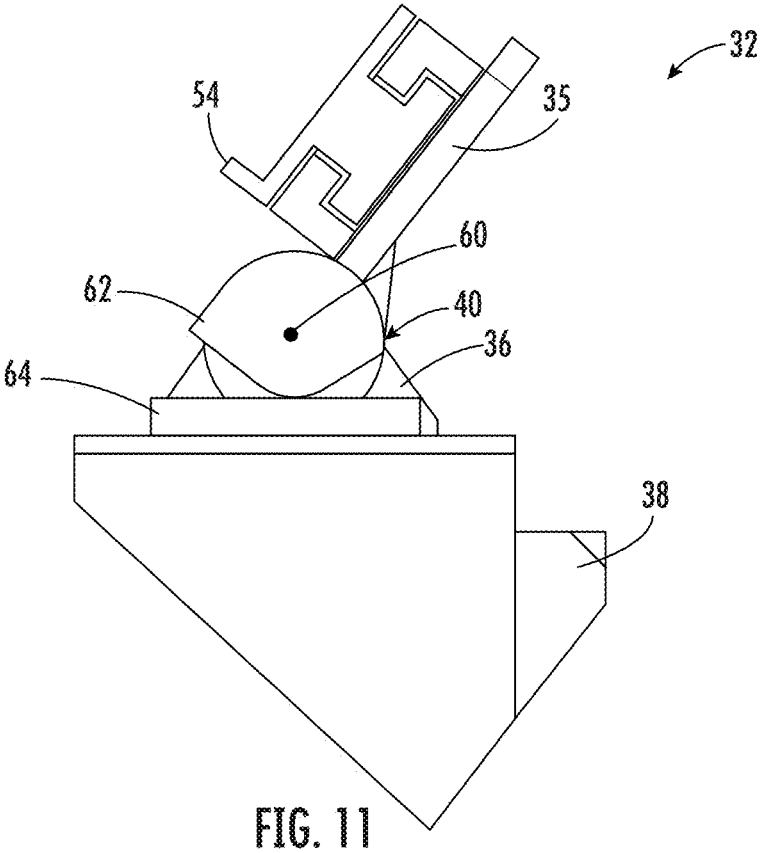
FIG. 11 is a side cross-sectional view of the fan system of FIG. 3 backward leaning position, according to an exemplary embodiment.
Figure 12:
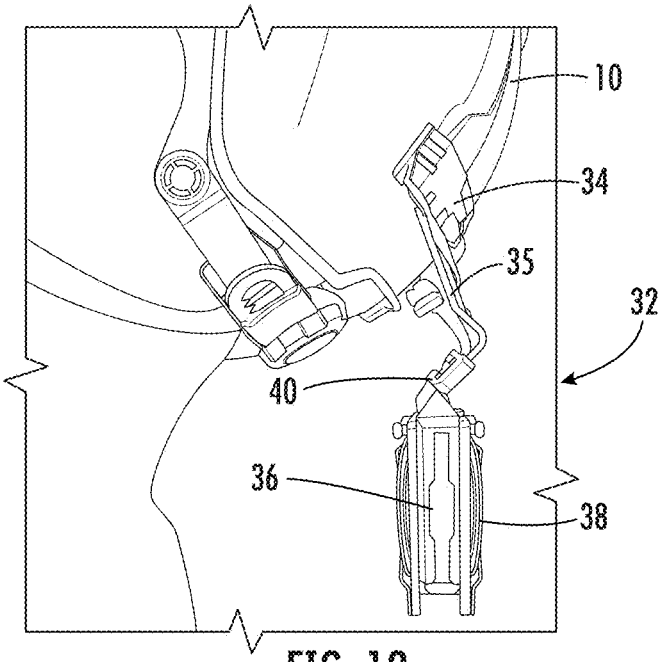
FIG. 12 is a perspective view of the fan system of FIG. 3 backward leaning position, according to an exemplary embodiment.

Referring to FIGS. 11 and 12, fan system 32 is in a backward hanging position. As illustrated, a user has fan system 32 coupled to the hard hat 10, and the user's head is in leaning backward towards the ground. In this position, fan 38 is unrestricted and can freely move upward or downward.

Figure 13:
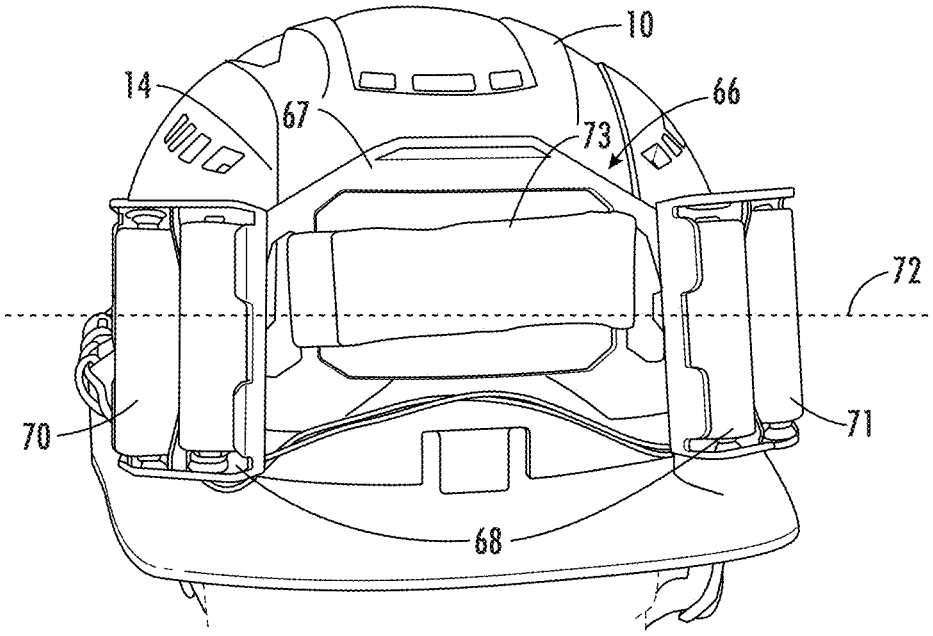
FIG. 13 is a front view of a power source system attached to a hard hat at a front mounting feature, according to an exemplary embodiment.
Figure 14:
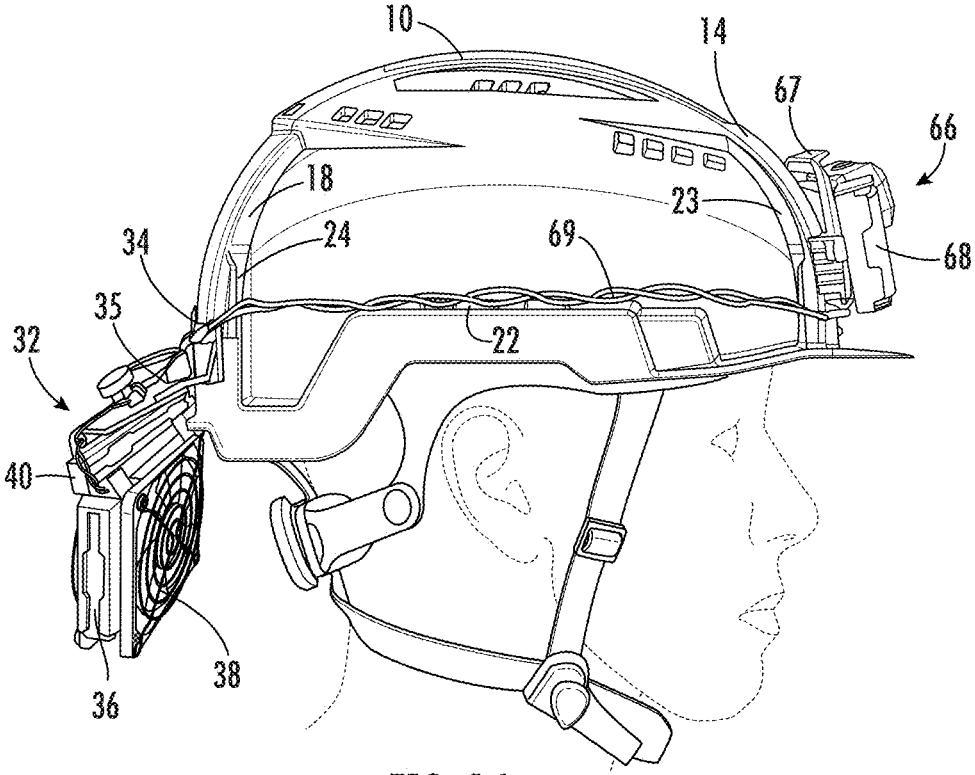
FIG. 14 is a side perspective view of the power source system of FIG. 13 attached to the front of the hard hat coupled to deliver power to a fan system attached to the rear of the hard hat, according to an exemplary embodiment.
Figure 15:
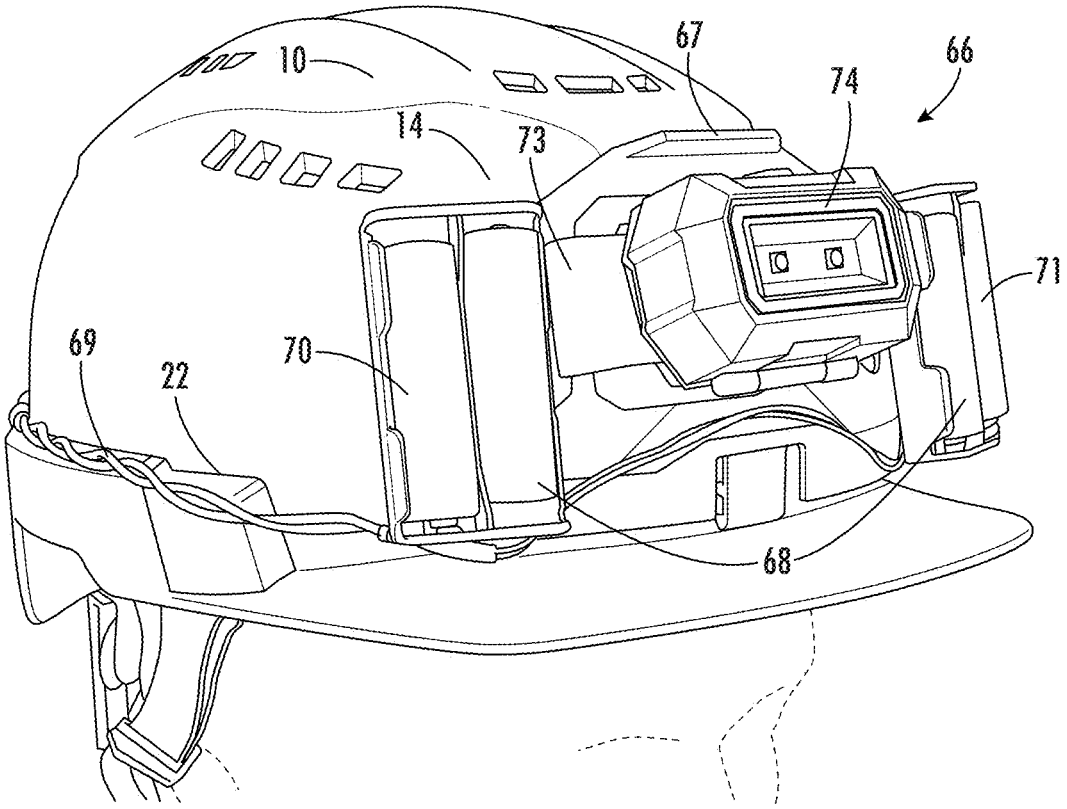
FIG. 15 is a perspective view of the power source system of FIG. 13 and a lamp accessory attached to the front of the hard hat, according to an exemplary embodiment.
Figure 16:
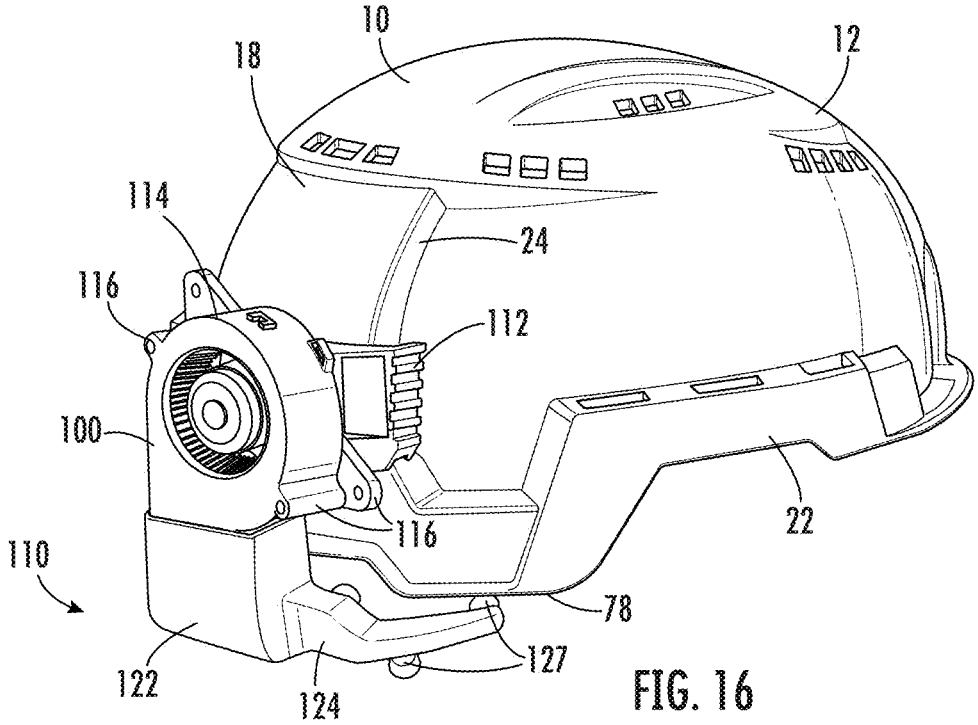
FIG. 16 is a rear perspective view of a hard hat with fan and manifold system, according to an exemplary embodiment.
Figure 17:
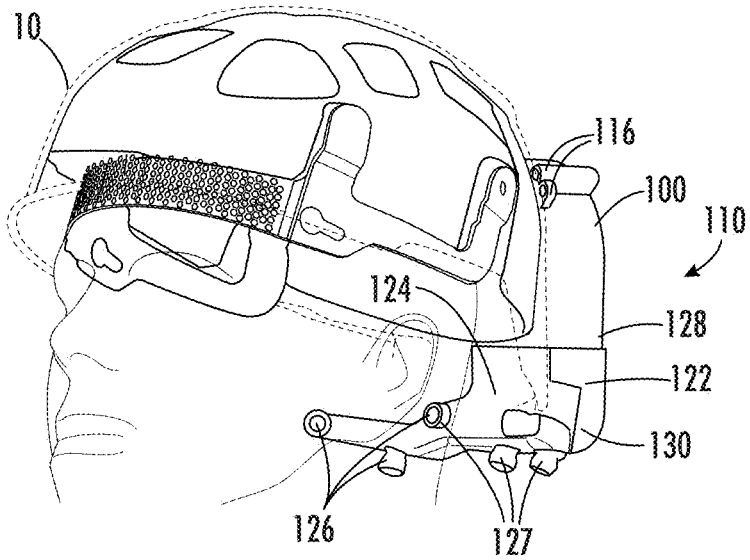
FIG. 17 is a front perspective view of the hard hat with fan and manifold system of FIG. 16 showing the hard hat in ghost lines, according to an exemplary embodiment.

Referring generally to FIGS. 13-15, a power source system 66 that can be used to power fan system 32 is shown. As shown in FIGS. 13-15, power source system 66 is located on an opposite side of a hard hat 10 from a fan system 32. Referring to FIGS. 13 and 14, hard hat 10 includes a front mounting feature 14 with a mounting ridge 23, and a rear mounting feature 18 with a mounting ridge 24. Fan system 32 is coupled to the hard hat 10 at the rear mounting feature 18. Power source system 66 is coupled to hard hat 10 at front mounting feature 14. Power source system 66 includes a power source mount 67 and a power source 68. The power source system 66 is located opposite the side of hard hat 10 from fan system 32 and provides a counterbalance for the weight added by fan system 32. Power source system 66 is connected to fan system 32 by wires 69. Wires 69 may be secured to hard hat 10 in variety of ways. As shown, wires 69 are secured against side accessory ridge 22.

In the specific embodiment shown, power source 68 includes a first segment 70 and a second segment 71 (e.g., left and right battery cells). First segment 70 and second segment 71 are evenly spaced on either side of power source mount 67 along a lateral axis 72 of the hard hat 10. First segment 70 and second segment 71 provide lateral weight distribution to hard hat 10. In addition, power source mount 67 includes an accessory attachment device 73 (e.g., an elastic band). Accessory attachment device 73 extends across power source mount 67 between first segment 70 and second segment 71 of power source 68. Attachment device 73 is configured to receive an additional hard hat accessory 74, such as a lamp (as shown in FIG. 15).

Figure 18:
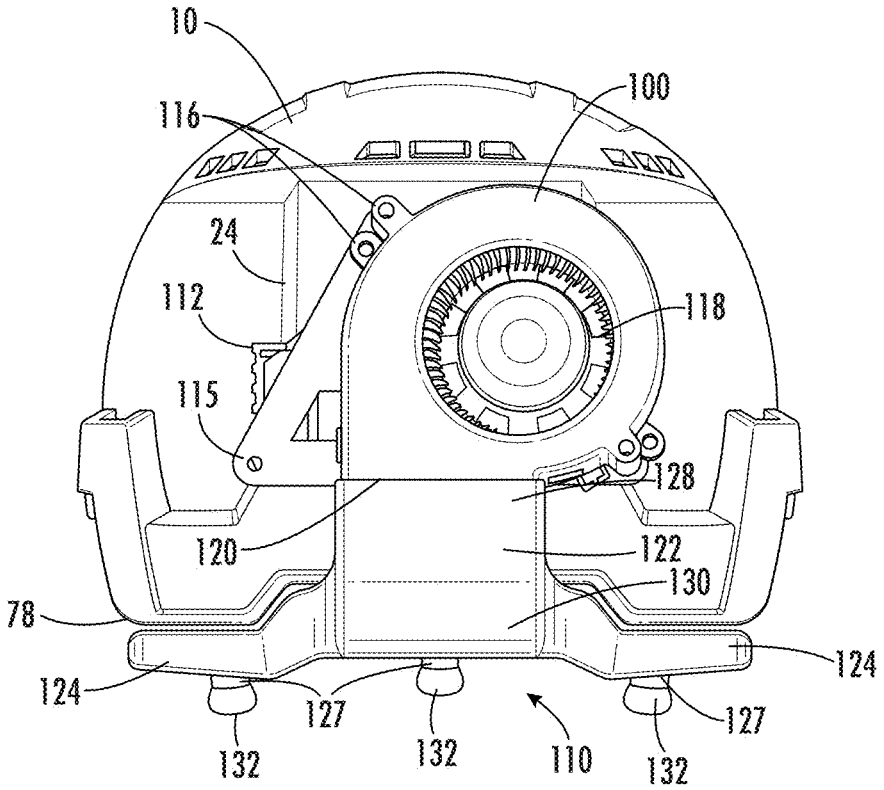
FIG. 18 is a rear plan view of the hard hat with fan and manifold system of FIG. 16, according to an exemplary embodiment.
Figure 19:
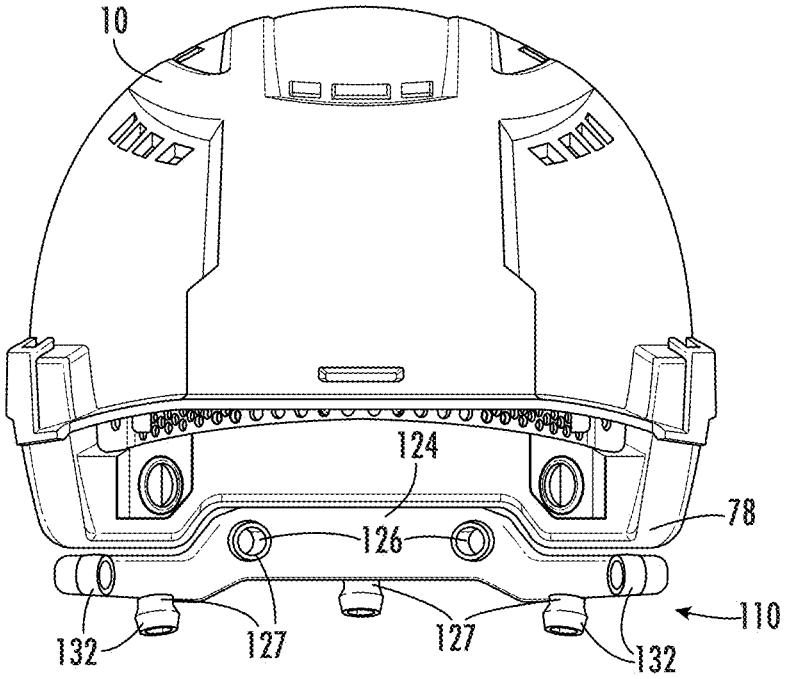
FIG. 19 is a front plan view of the hard hat with fan and manifold system of FIG. 16, according to an exemplary embodiment.

Referring generally to FIGS. 16-21, hard hat 10 with a fan 100 and manifold system 110 is shown according to an exemplary embodiment. Referring to FIGS. 16-19, fan 100 is coupled to hard hat 10 at rear mounting feature 18. Fan 100 is mounted above the lower edge 78 of hard hat 10. As best shown in FIG. 19, in various embodiments, fan 100 does not extend below the lower edge 78 of hard hat 10.

Specially, fan 100 is coupled to a fan mounting bracket 112. Fan mounting bracket 112 is securely and removable coupled to the rear mounting feature 18, and more specifically, to mounting ridge 24. Fan 100 is coupled to mounting bracket 112 using a mounting plate 114. Fan 100 includes a plurality of projections 116 to allow for fan 100 to attach to mounting plate 114 in different configurations or at different angles. Projections 116 extend from the outer surface 15 of fan 100 and are configured to receive a fastener to attach fan 100 to mounting plate 114. Projections 116 may have varied depth to allow different types and lengths of fasteners.

Referring to FIG. 18, mounting plate 114 includes holes 115, which can be aligned with projections 116 to receive a fastener and couple mounting plate 114 to fan 100. Mounting plate 114 can be coupled to fan 100 by aligning at least one hole 115 with at least one projection 116 and securing them together with a fastener. As shown, mounting plate 114 has a generally triangular perimeter with rounded corners and fan 100 includes four projections 116. Two of projections 116 are interfacing with two of holes 115 of mounting plate 114 to attach fan 100 to mounting bracket 112.

Figure 20:
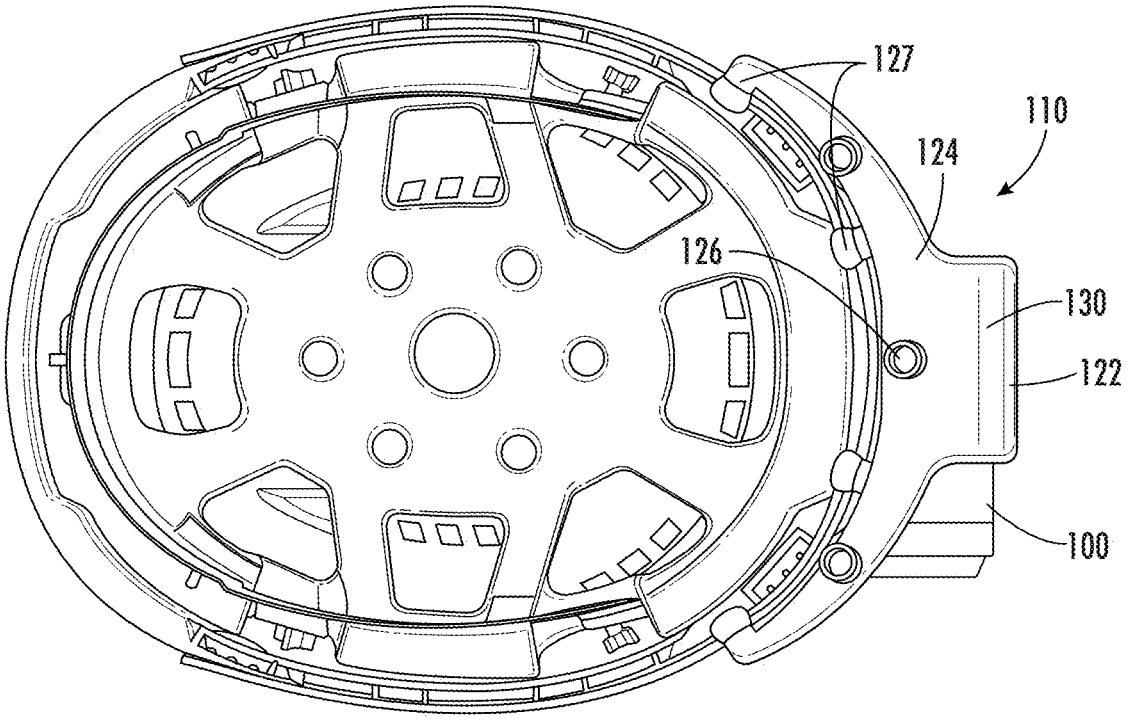
FIG. 20 is a bottom plan view of the hard hat with fan and manifold system of FIG. 16, according to an exemplary embodiment.

Referring to FIGS. 18-20, fan 100 includes an air intake 118 and an air outlet or exhaust 120. Ambient air enters fan 100 through intake 118 and exits through outlet 120. Intake 118 is positions and located on a front surface of fan 100 and faces away from the outer surface 15, specifically rear surface 16, of shell 11. Outlet 120, as shown, is positioned, and located at a bottom of fan 100 below intake 118. Manifold system 110 is attached to air outlet 120 to distribute air from fan 100 to around hard hat 10 and the head of a user. Manifold system 110 includes a primary air duct 122, secondary air duct 124, and a plurality of air vents 126. Primary duct 122 is coupled to outlet 120 of fan 100. Primary duct 122 may be coupled to outlet 120 through a friction fit arrangement, such as through an interference fit, snap fit, or press-fit arrangement. As shown, air outlet 120 is received in a first end 128 of primary duct 122.

Secondary air duct 124 is coupled to a second end 130 of primary air duct 122. As shown, secondary air duct 124 is made unitary with primary air duct 122 such that primary duct 122 and secondary duct 124 are made from a single, continuous, and continuous piece of material. Secondary air duct 124 carries air from primary duct 122 to air vents 126. Secondary duct 122 extends below the lower edge 78 of hard hat 10 and at least partially around the lower circumference of hard hat 10. As shown, secondary air duct 124 extends symmetrically to the left and right around a user's neck, and secondary air duct 124 is shaped to match the lower circumference of hard hat 10.

Air vents 126 are apertures or openings positioned to direct air towards the head and neck of the user. Air vents 126 are located in protrusions or air vent structures 127 which extend from secondary air duct 124. Air vent structures 127 have ends 132 and air vents 126 are located in ends 132. Air vents 126 are located in ends 132 to direct air from manifold system 110 out towards a user. As shown, ends 132 are generally spherical in shape.

Figure 21:
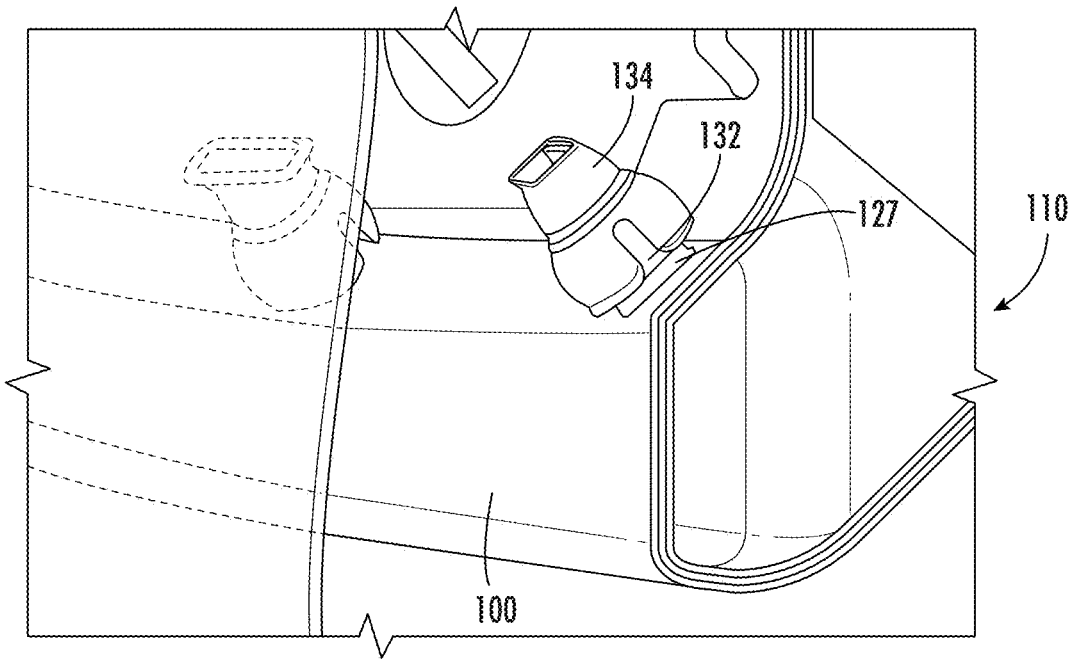
FIG. 21 is a detailed view of the air vents of the manifold system of FIG. 16, according to an exemplary embodiment.

As shown in FIG. 21, air vents structure 127 may include airflow caps or nozzles 134 attached to the end 132. Airflow caps 134 cover air vents 126 to allows adjustment of airflow in all directions. Airflow caps 134 may be attached through a friction fit arrangement, such as through a snap fit arrangement, interference fit, etc.

As shown, manifold system 110 includes seven air vents 126. Four of the air vents 126 are configured to direct air towards the back of a user's head, while three of the air vents 126 are angled downward towards the user's neck. However, manifold system 110 may include any number of air vents 126 in a variety of arrangements and configurations.

Referring R generally to FIGS. 22-26, hard hat 10 with a fan 200 and a manifold system 210 is shown according to an exemplary embodiment. Fan 200 is substantially the same as fan 100, except for the differences discussed herein, and manifold system 210 is substantially the same as manifold system 110, except for the differences discussed herein. Specifically, secondary duct 224 of manifold system 210 extends around a perimeter of hard hat 10 defined by lower edge 78.

Figure 22:
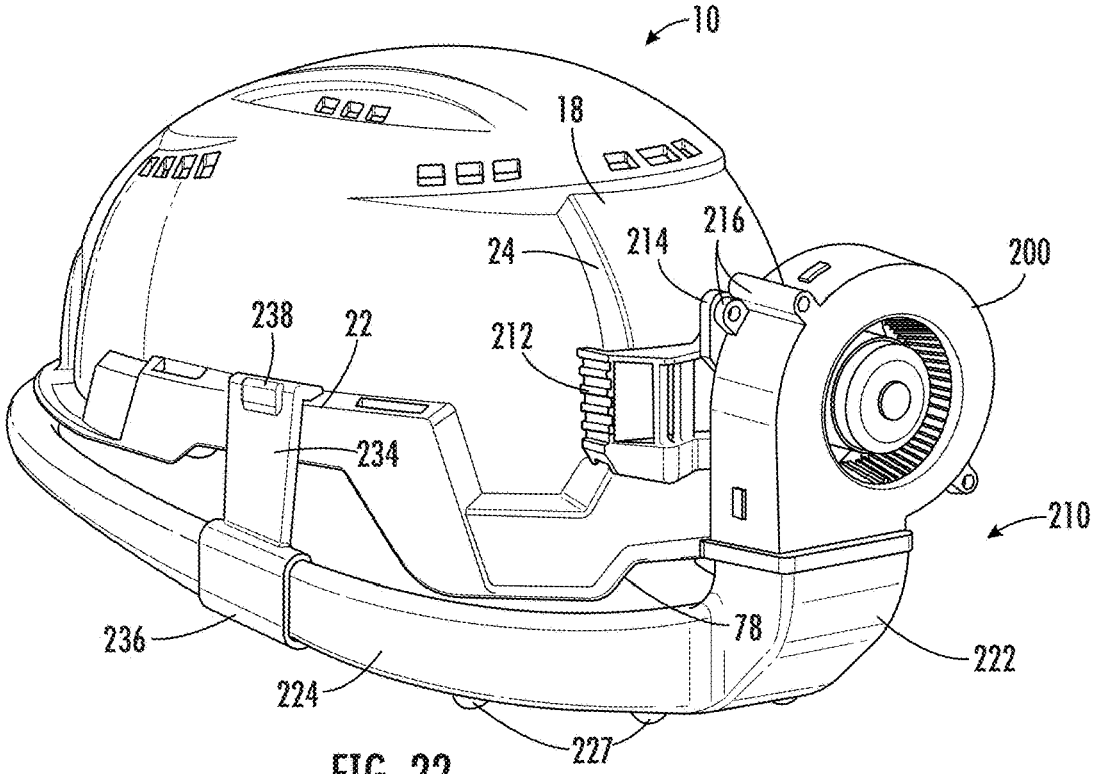
FIG. 22 is a rear perspective view of a hard hat with fan and manifold system, according to an exemplary embodiment.
Figure 26:
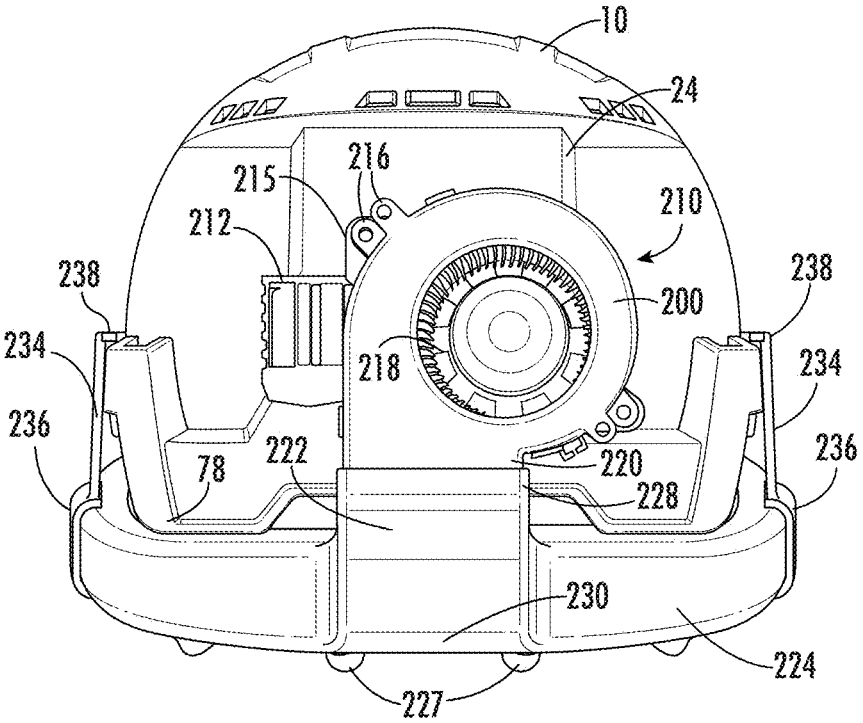
FIG. 26 is a rear plan view of the hard hat with fan and manifold system of FIG. 22, according to an exemplary embodiment.

Referring to FIG. 22, a rear perspective view of hard hat 10, fan 200, and manifold system 210 is shown. Fan 200 is coupled to hard hat 10 at rear mounting feature 18 above the lower edge 78 of hard hat 10. Specifically, fan 200 is coupled to a fan mounting bracket 212, and fan mounting bracket 212 is mounted at mounting ridge 24 of hard hat 10. Fan 200 is coupled fan mounting bracket 212 through a mounting plate 214. Mounting plate 214 includes holes 215 configured to receive a fastener. Fan 200 includes a plurality of projections 216 that are configured to receive a fastener. Mounting plate 214 can be coupled to fan 200 by aligning at least one hole 215 with at least one projection 216 and securing them together with a fastener. Projections 216 may have varied depth to allow different types and lengths of fasteners. As shown in FIGS. 22 and 26, mounting plate 214 has a generally polygonal shaped perimeter with rounded corners. At least two rounded corners include holes 215 and an angled section extends between two rounded corners. Two projections 216 with narrow depth are interfacing with mounting plate 214 to attach fan 200 to mounting bracket 212.

Referring to FIGS. 23-26, fan 200 includes an air intake 218 and an air outlet or exhaust 220. Manifold system 210 is attached to air outlet 220 to distribute air from fan 200 to and around the head of a user. Manifold system 210 includes a primary air duct 222, secondary air duct 224, and a plurality of air vents 226. Primary duct 222 is coupled to outlet 220 of fan 200.

Secondary air duct 224 is coupled to a second end 230 of primary air duct 222. As shown, secondary air duct 224 is made unitary with primary air duct 222. Secondary duct 224 of manifold system 210 extends below the lower edge 78 of hard hat 10. Secondary air duct 224 is a hollow tube that extends around the circumference of hard hat 10. As shown, secondary air duct 224 is design to surround the top of a user's head.

Figure 23:
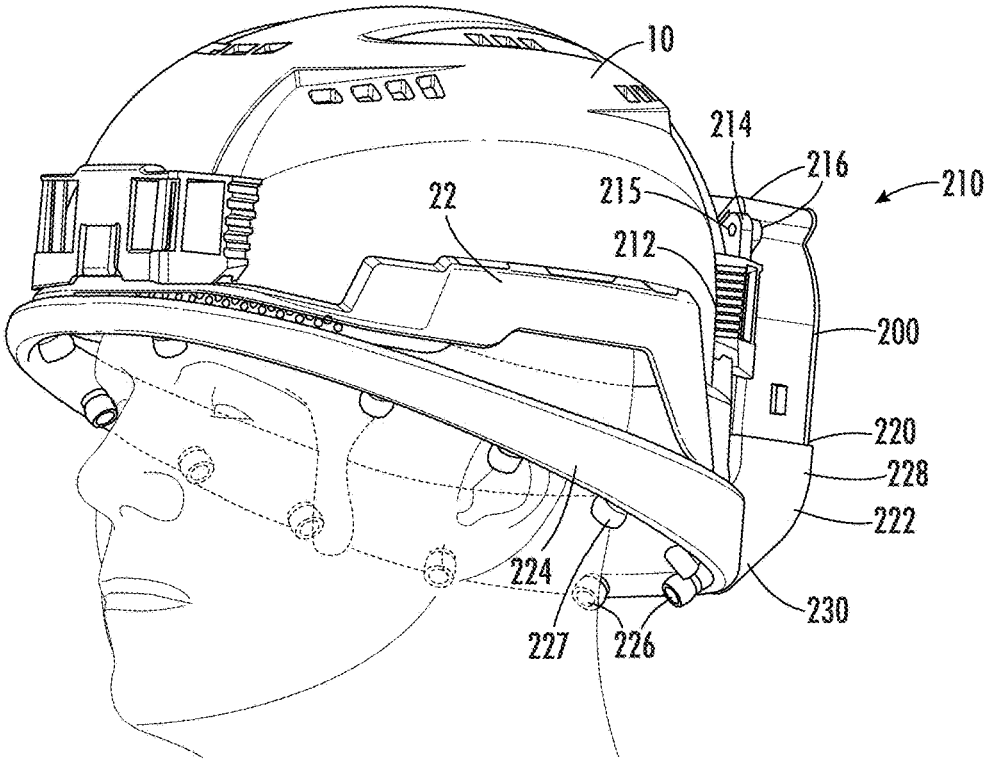
FIG. 23 is a front perspective view of the hard hat with fan and manifold system of FIG. 22, according to an exemplary embodiment.
Figure 24:
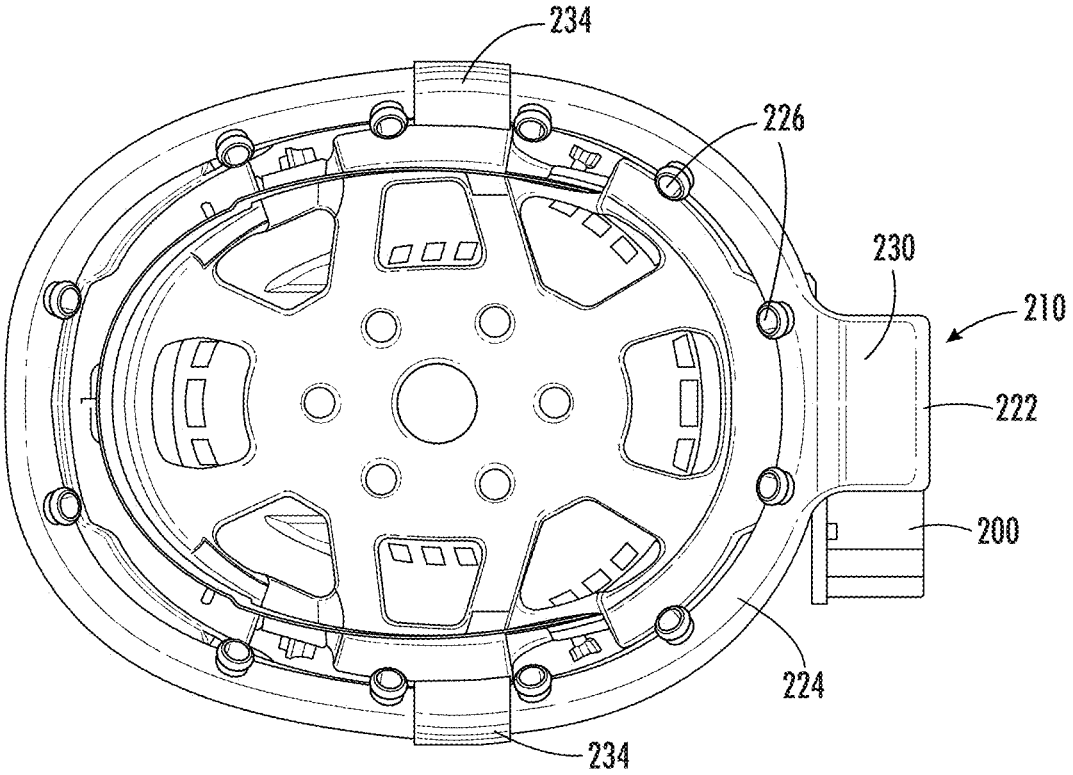
FIG. 24 is a bottom plan view of the hard hat with fan and manifold system of FIG. 22, according to an exemplary embodiment.
Figure 25:
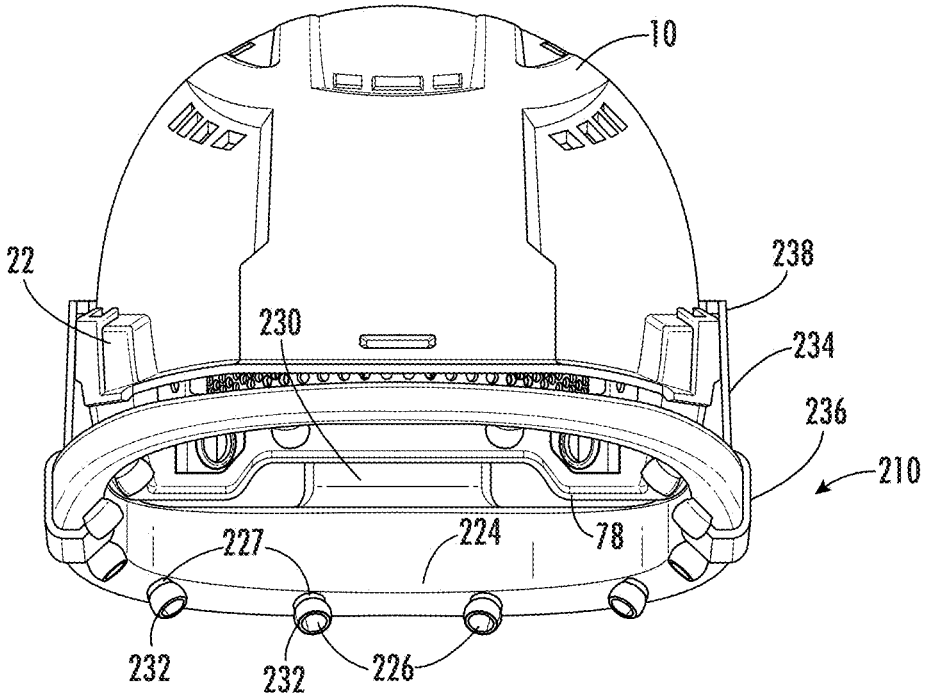
FIG. 25 is a front plan view of the hard hat with fan and manifold system of FIG. 22, according to an exemplary embodiment.

Air vents 226 are apertures or openings positioned to direct air towards the head and neck of the user. Air vents 226 are located in air vent structures or protrusions 227 which extend from secondary air duct 224. Air vent structures 227 have ends 232. Air vents 226 are located in ends 232 to direct air from manifold system 210 out towards a user. As shown, ends 232 are generally spherical in shape. As shown in FIGS. 23 and 24, air vents 226 and air vent structures 227 are positioned evenly along secondary duct 224 and are aimed to direct air downward towards the face, ears, and neck of a user. Air vents 226 may include airflow caps or nozzles attached to the spherical end 232 of air vents 226 to allow adjustment of airflow in all directions. As shown, two air vents 226 are located below the front 12 of hard hat 10 to direct air towards the face of a user, two air vents 226 are located at the back 16 of hard hat 10 to direct air at the neck of a user, and eight air vents 226 are located below the sides of the hard hat 10.

In various embodiments, manifold system 210 includes side attachment brackets 234 to provide added support and stability to manifold system 210. Side attachment brackets 234 are attached on each side of hard hat 10 and include a lower end 236 coupled to secondary air duct 224 and an upper end 238 coupled to hard hat 10. Lower end 236 may be coupled to secondary air duct 224 through a friction fit arrangement, such as through an interference fit, snap fit, press-fit arrangement, etc. Upper end 238 is configured to attach to side accessory ridge 22. Upper end 238 may include a clip or other attachment feature, or may be coupled to accessory ridge through a friction fit arrangement, such as through an interference fit, snap fit, press-fit arrangement, etc.

Referring generally to FIGS. 27-30, hard hat 10 with a fan 300 and a manifold system 310 is shown according to an exemplary embodiment. Fan 300 is substantially the same as fan 100 or 200, and manifold system 310 is substantially the same as manifold system 210, except that air vents 326 are aimed upward.

Figure 27:
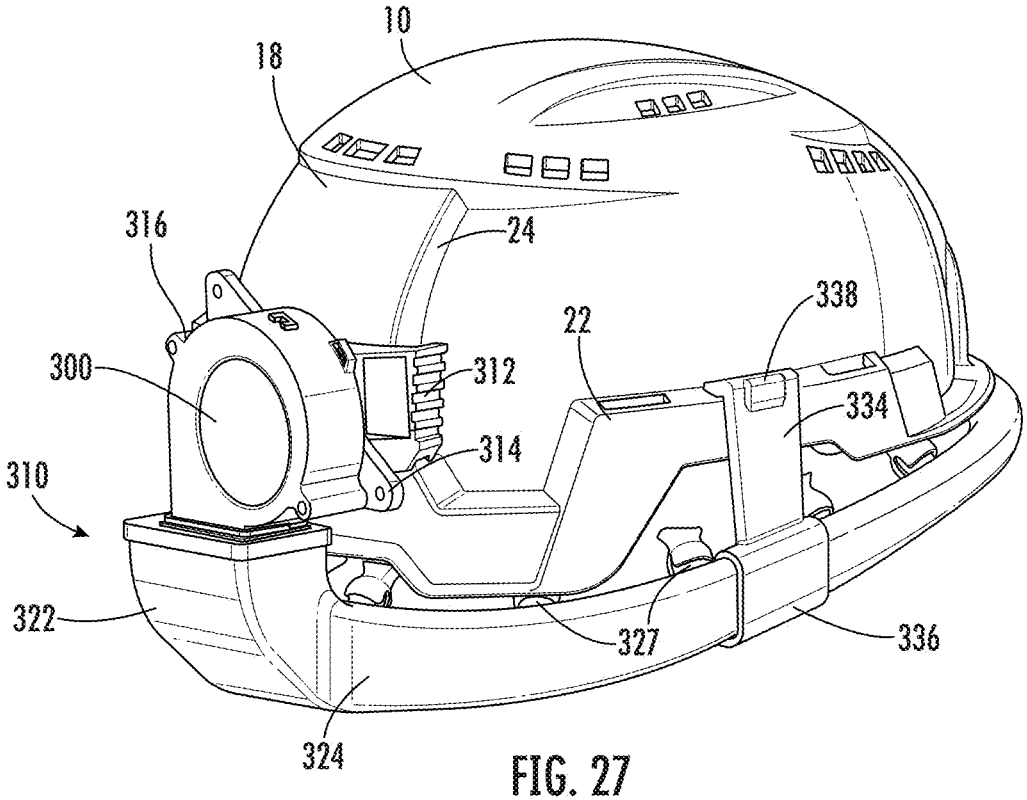
FIG. 27 is rear perspective view of a hard hat with fan and manifold system, according to an exemplary embodiment.
Figure 28:
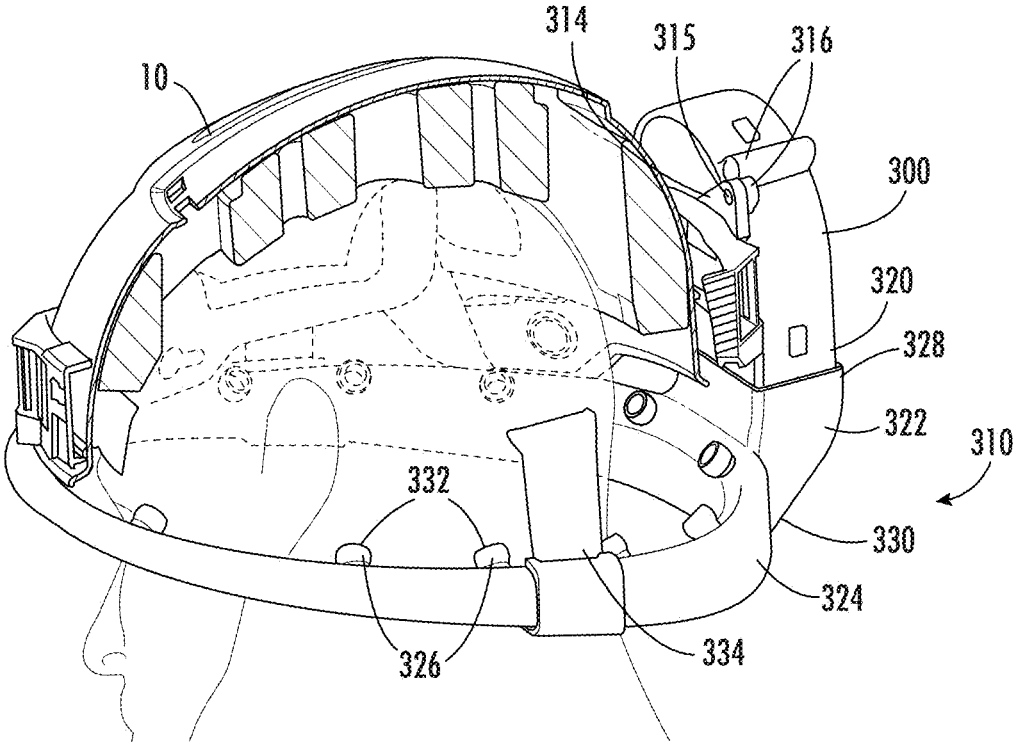
FIG. 28 is perspective view of the hard hat with fan and manifold system of FIG. 27 with a section removed to show the cross-section of the hard hat, according to an exemplary embodiment.
Figure 29:
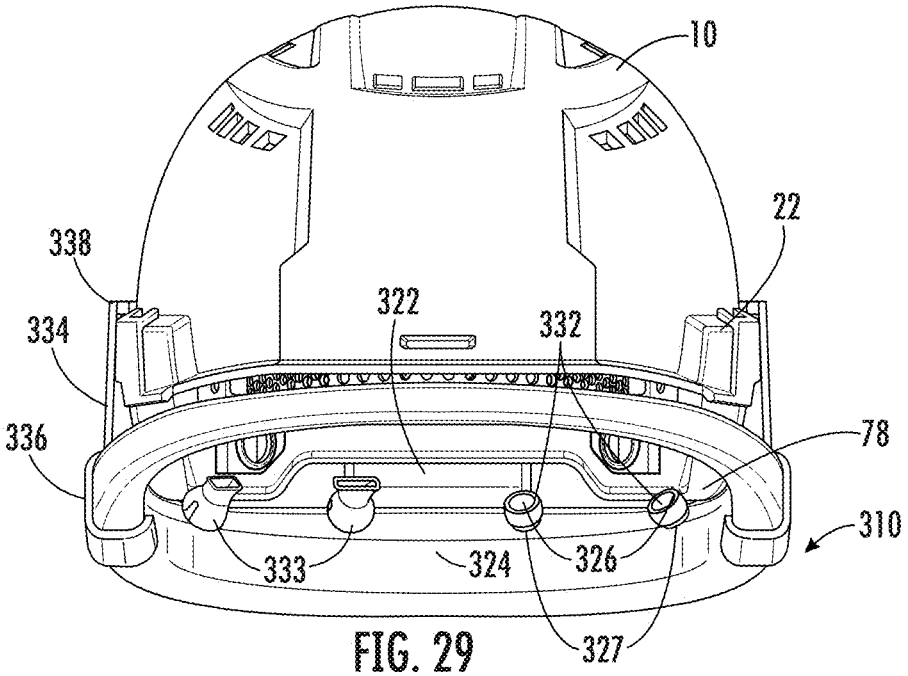
FIG. 29 is a front plan view of the hard hat with fan and manifold system of FIG. 27, according to an exemplary embodiment.

Referring to FIGS. 27, fan 300 is coupled to a fan mounting bracket 312, and fan mounting bracket 312 is mounted at mounting ridge 24 of hard hat 10. Fan 300 is coupled to fan mounting bracket 312 through a mounting plate 314. As shown in FIGS. 27, 28, and 29, mounting plate 314 has a generally polygonal shaped perimeter with rounded corners. At least two rounded corners include holes 315 and an angled section extends between two rounded corners. Two projections 316 with narrow depth are interfacing with mounting plate 314 to attach fan 300 to mounting bracket 312.

Figure 30:
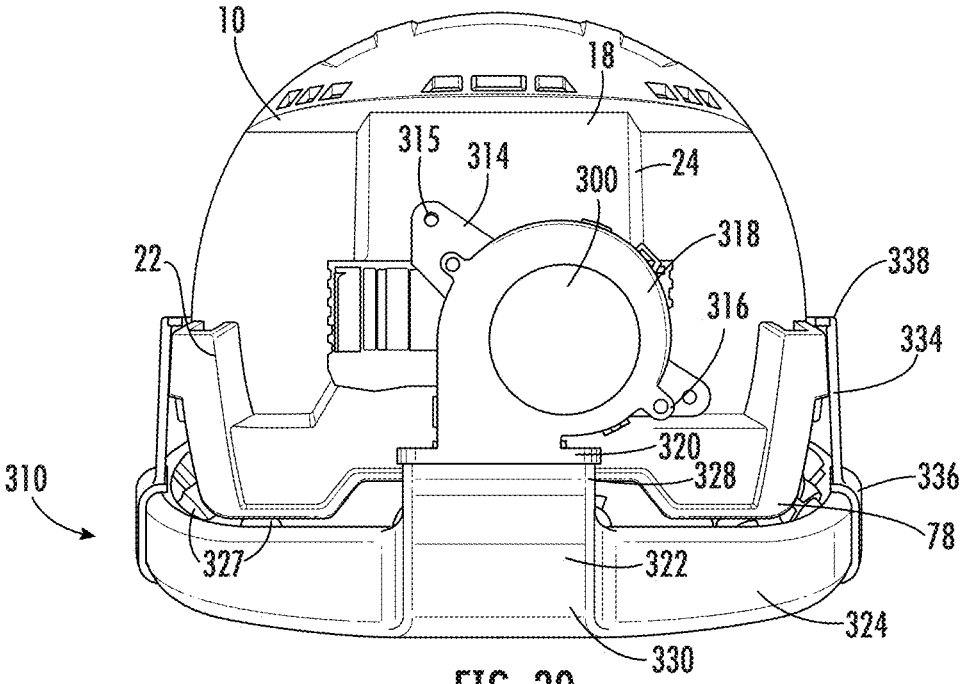
FIG. 30 is a rear plan view of the hard hat with fan and manifold system of FIG. 27, according to an exemplary embodiment.

Referring to FIGS. 28-30, fan 300 includes an air intake 318 and an air outlet or exhaust 320. Manifold system 310 is attached to air outlet 320 to distribute air from fan 300 to and around the head of a user. Manifold system 310 includes a primary air duct 322, secondary air duct 324, and a plurality of air vents 326. Primary duct 322 is coupled to outlet 320 of fan 300.

Secondary air duct 324 is coupled to a second end 330 of primary air duct 322. As shown, secondary air duct 324 is not unitary with primary air duct 322. Secondary duct 324 of manifold system 310 extends below the lower edge 78 of hard hat 10 and around the entire lower circumference of hard hat 10. As shown, secondary air duct 324 is design to surround the top of a user's head.

Air vents 326 are apertures or openings positioned to direct air towards the head and neck of the user. Air vents 326 are located in air vent structures or protrusions 327 which extend from secondary air duct 324. Air vent structures 327 have ends 332. Air vents 326 are located in ends 332 to direct air from manifold system 310 out towards a user. As shown, ends 332 are generally spherical in shape. Air vents structures 327 are positioned evenly along secondary duct 324. Air vents 326 and protrusions 327 are aimed to direct air upward into hard hat 10 and towards the head of a user. As shown, two air vents 326 are located below the front 12 of hard hat 10 to direct air towards the face of a user, two air vents 326 are located at the back 16 of hard hat 10 to direct air at the neck of a user, and eight air vents 326 are located below the sides of the hard hat 10.

In various embodiments, air vents structures 327 include airflow caps or nozzles 333 attached to the ends 332 of air vents structures 327 and covering air vents 326 to allow adjustment of airflow in all directions.

In other various embodiments, manifold system 310 includes side attachment brackets 334 to provide added support and stability to the manifold system 210. Side attachment brackets 334 are attached on each side of hard hat 10 and include a lower end 336 coupled to secondary air duct 324 and an upper end 338 coupled to hard hat 10. Upper end 338 is configured to attach to side accessory ridge 22.

Referring generally to FIGS. 31-34, hard hat 10 with a fan 400 and a manifold system 410 is shown according to an exemplary embodiment. Fan 400 is substantially the same as fan 100, 200, or 300, except for the differences discussed herein.

Figure 31:
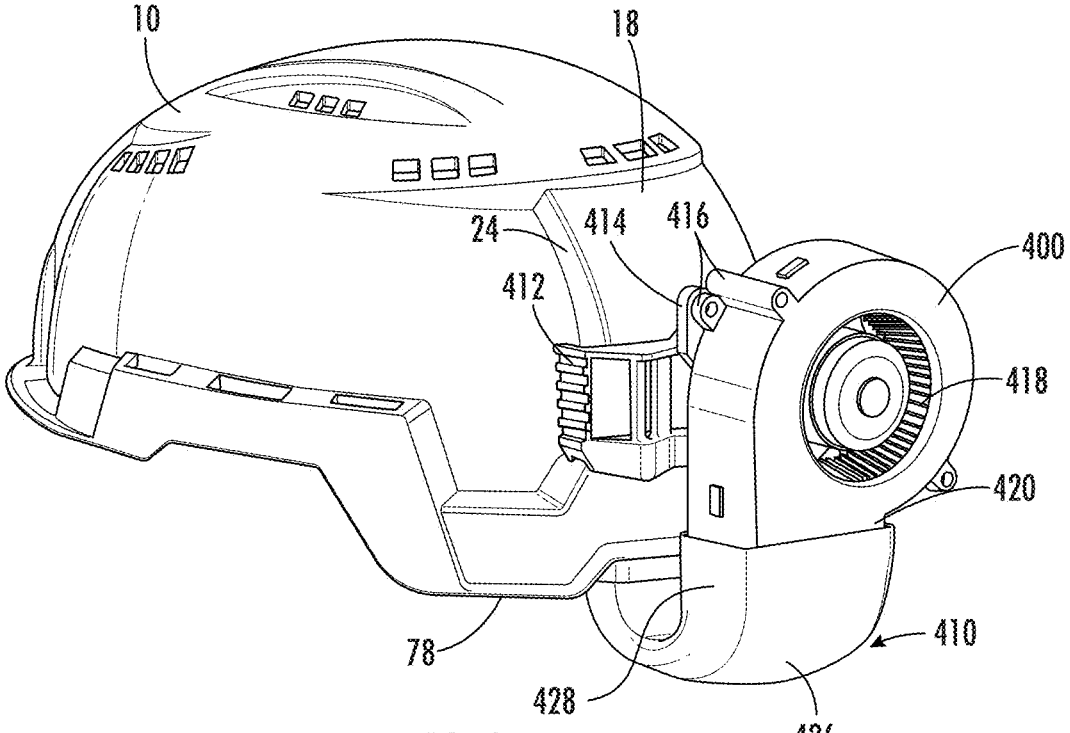
FIG. 31 is rear perspective view of a hard hat with fan and manifold system, according to an exemplary embodiment.

Referring to FIG. 31, fan 400 is coupled to hard hat 10 at rear mounting feature 18 above the lower edge 78 of hard hat 10. Specifically, fan 400 is coupled to a fan mounting bracket 412, and fan mounting bracket 412 is mounted at mounting ridge 24 of hard hat 10. Fan 400 is coupled fan mounting bracket 412 through a mounting plate 414.

Figure 32:
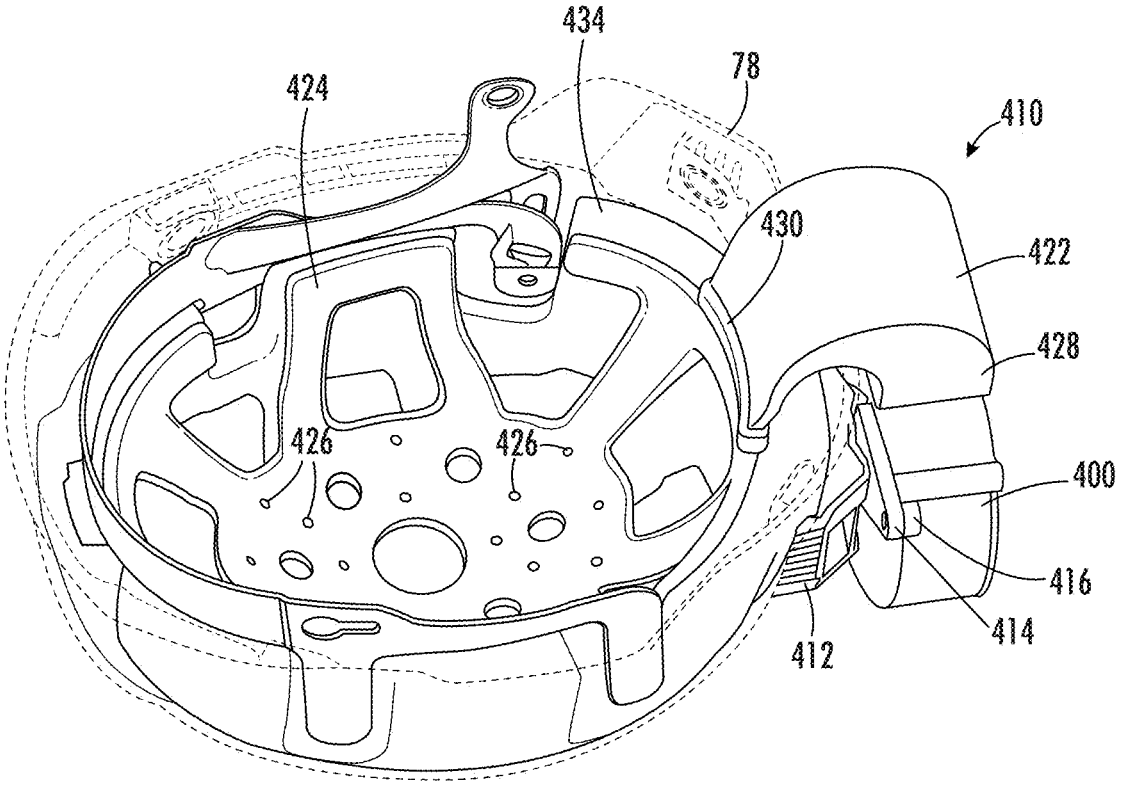
FIG. 32 is a bottom perspective view of the hard hat with fan and the manifold system of FIG. 31 showing the hard hat in ghost lines, according to an exemplary embodiment.
Figure 33:
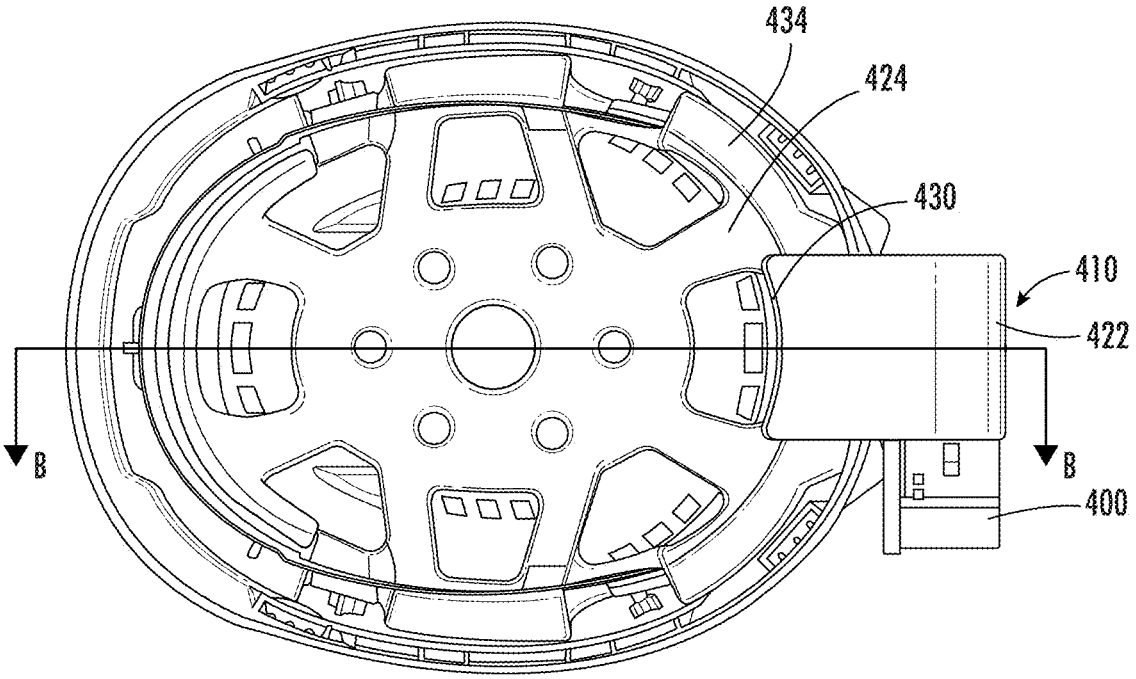
FIG. 33 is a bottom plan view of the hard hat with fan and manifold system of FIG. 31, according to an exemplary embodiment.
Figure 34:
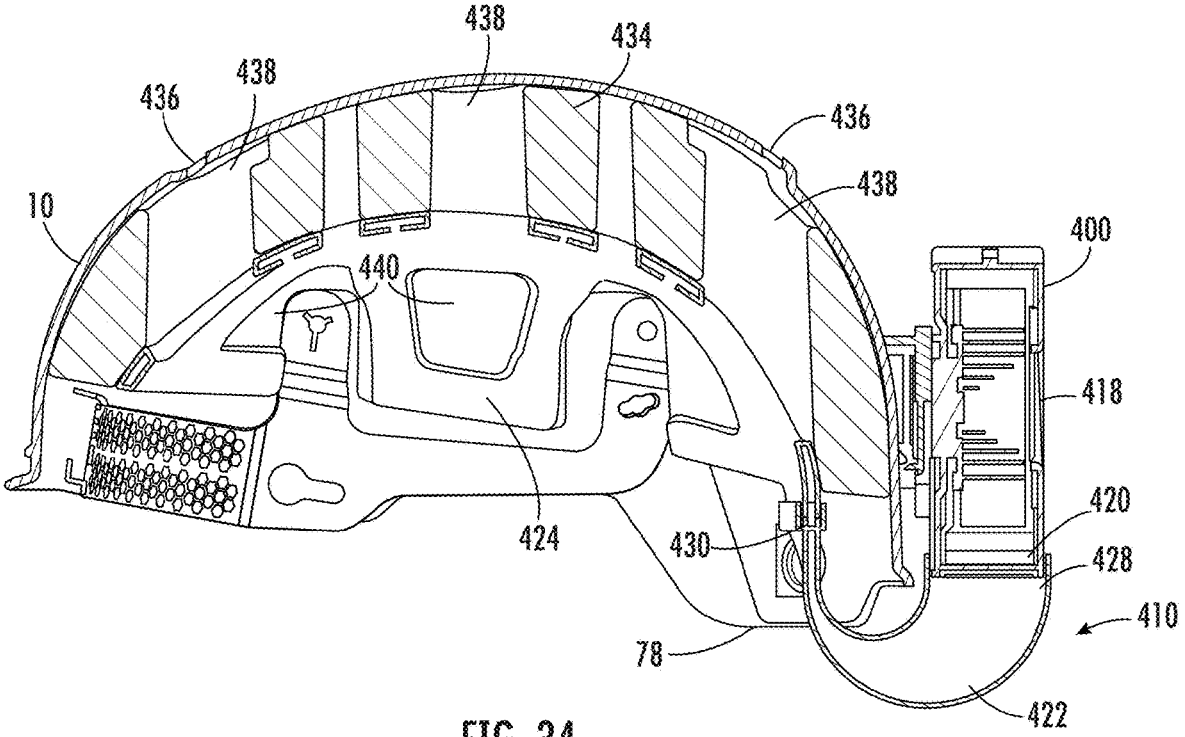
FIG. 34 is a cross sectional side view of the hard hat with fan and manifold system of FIG. 33 taken along line B-B, according to an exemplary embodiment.

Referring to FIGS. 32-34, fan 400 includes an air intake 418 and an air outlet or exhaust 420. Manifold system 410 is attached to air outlet 420 to distribute air from fan 400 to and around the head of a user. Manifold system 410 includes a primary duct 422, a head liner 424, and a plurality of air vents 426.

Primary duct 422 is coupled to outlet 420 of fan 400. Primary duct 422 may be coupled to outlet 420 through a friction fit arrangement, such as through an interference fit, snap fit, press-fit arrangement, etc. As shown, air outlet 420 is received in a first end 428 of primary duct 322. Primary duct 422 extends below the lower edge 78 of hard hat 10 and curves upwards towards an inner surface 80 of shell 11 of hard hat 10. This allows for primary duct 422 to be transitional to head liner 424.

Head liner 424 is coupled to a second end 430 of primary duct 422 opposite fan 400. Head liner 424 is coupled to second end 430 through a friction fit arrangement, such as through an interference fit, snap fit, press-fit arrangement, etc. Head liner 424 is designed to fit between inner surface 80 and the head of a user. As such, head liner 424 is curved and sized to substantially match inner surface 80. Head liner 424 may be made from numerous materials, such as fabric, elastomers, plastic, foam, etc. Head liner 424 distributes air from primary duct 422 to air vents 426. Head liner 424 is hollow to allow air to flow through it.

Plurality of air vents 426 are openings located in head liner 424. Air vents 426 direct air downward onto the user's head, away from inner surface 80 of shell 11, to provide a cooling sensation to the user. Head liner 424 and vents 426 also assist in exhausting hot or humid air trapped inside hard hat 10 by pushing in ambient air from outside hard hat 10.

As shown in FIG. 34, hard hat 10 includes foam or impact absorbing layer 434 and open ports 436. Impact absorbing layer 434 lies adjacent to inner surface 80 of hard hat 10. Impact absorbing layer 434 is coupled to inner surface 80. Shell 11 of hard hat 10 is formed from a first material and the impact absorbing layer 434 is formed from a second material that is different from the first material.

Impact absorbing layer 434 includes cavities 438 that align with open ports 436 to allow ambient air to enter hard hat 10 and provide additional cooling sensation to a user. Head liner 424 is placed below impact absorbing layer 434 adjacent to a user's head. Head liner 424 is coupled to impact absorbing layer 434 and has openings 440 that align with cavities 438 to allow ambient air to flow to the user's head, along with the air from air vents 426. Head liner 424 may be coupled to inner surface 80 of hard hat 10 or impact absorbing layer 434 through any suitable attachment mechanism, such as adhesives, fasteners, or friction fit arrangement. Head liner 424 may also be made unitary with impact absorbing layer 434.

Referring generally to FIG. 35-39, hard hat 10 with a fan 500 and a manifold system 510 is shown according to an exemplary embodiment. Fan 500 is substantially the same as fan 100, 200, 300 or 400, except for the differences discussed herein.

Figure 35:
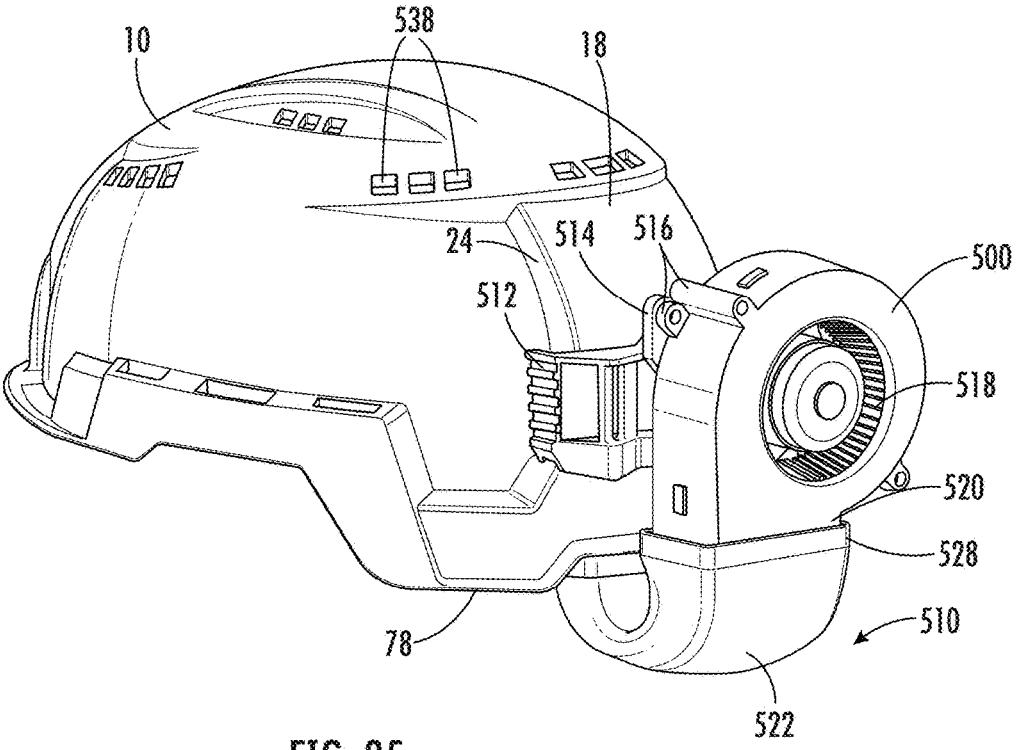
FIG. 35 is rear perspective view of a hard hat with fan and manifold system, according to an exemplary embodiment.
Figure 36:
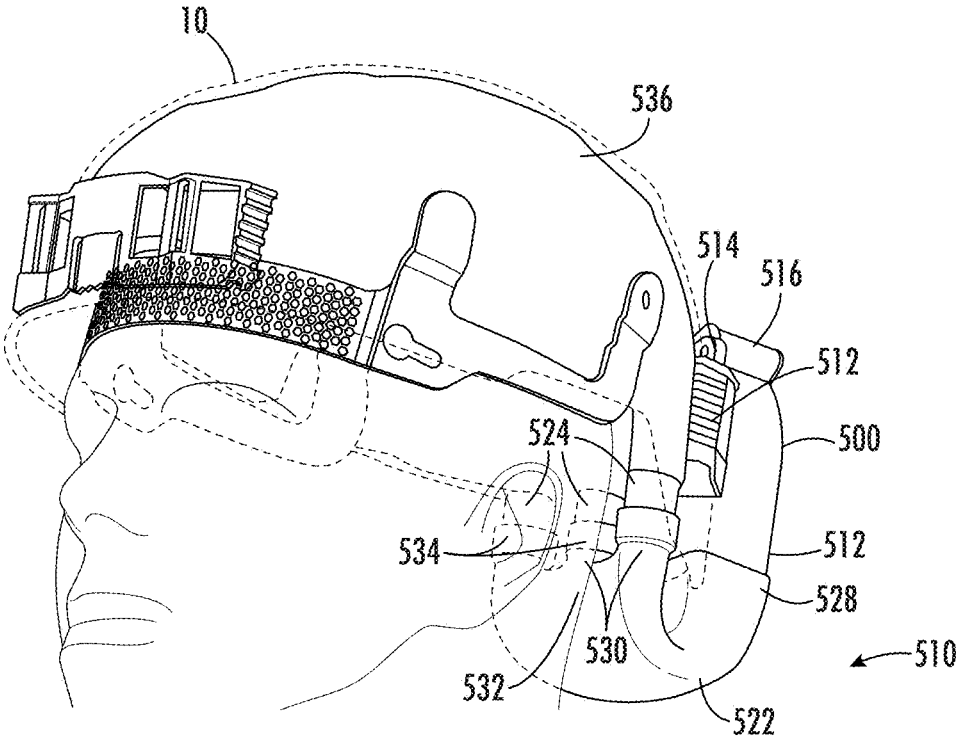
FIG. 36 is a front perspective view of the hard hat with fan and manifold system of FIG. 35 showing the hard hat in ghost lines, according to an exemplary embodiment.
Figure 37:
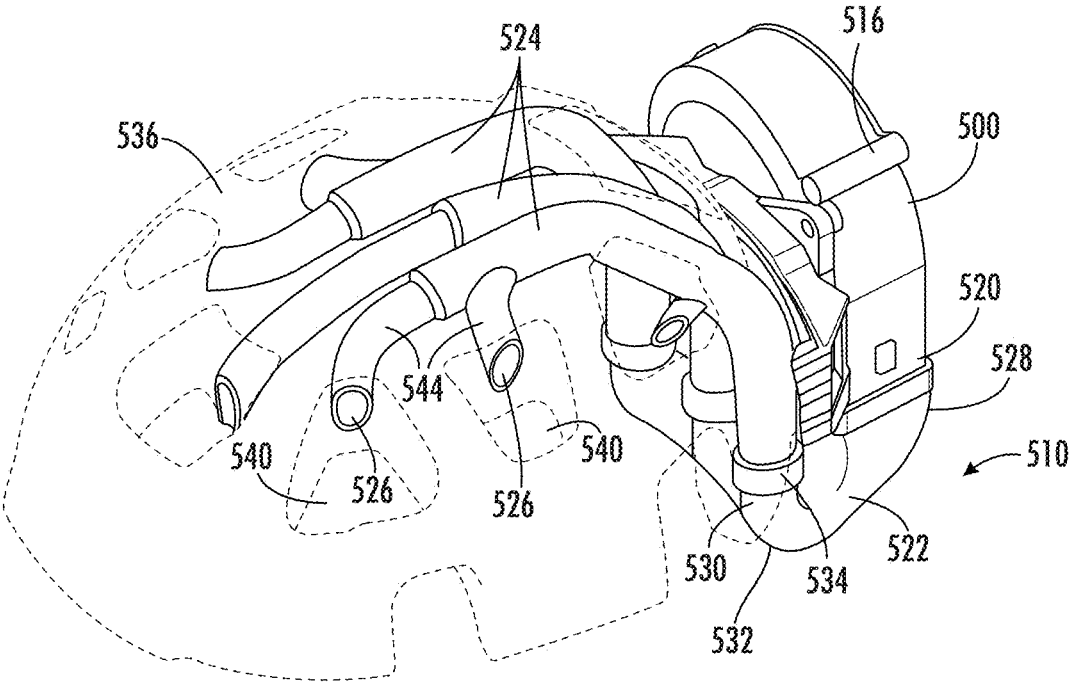
FIG. 37 is a front perspective view of the fan and manifold system of FIG. 35 showing the impact absorbing layer of the hard hat in ghost lines, according to an exemplary embodiment.
Figure 38:
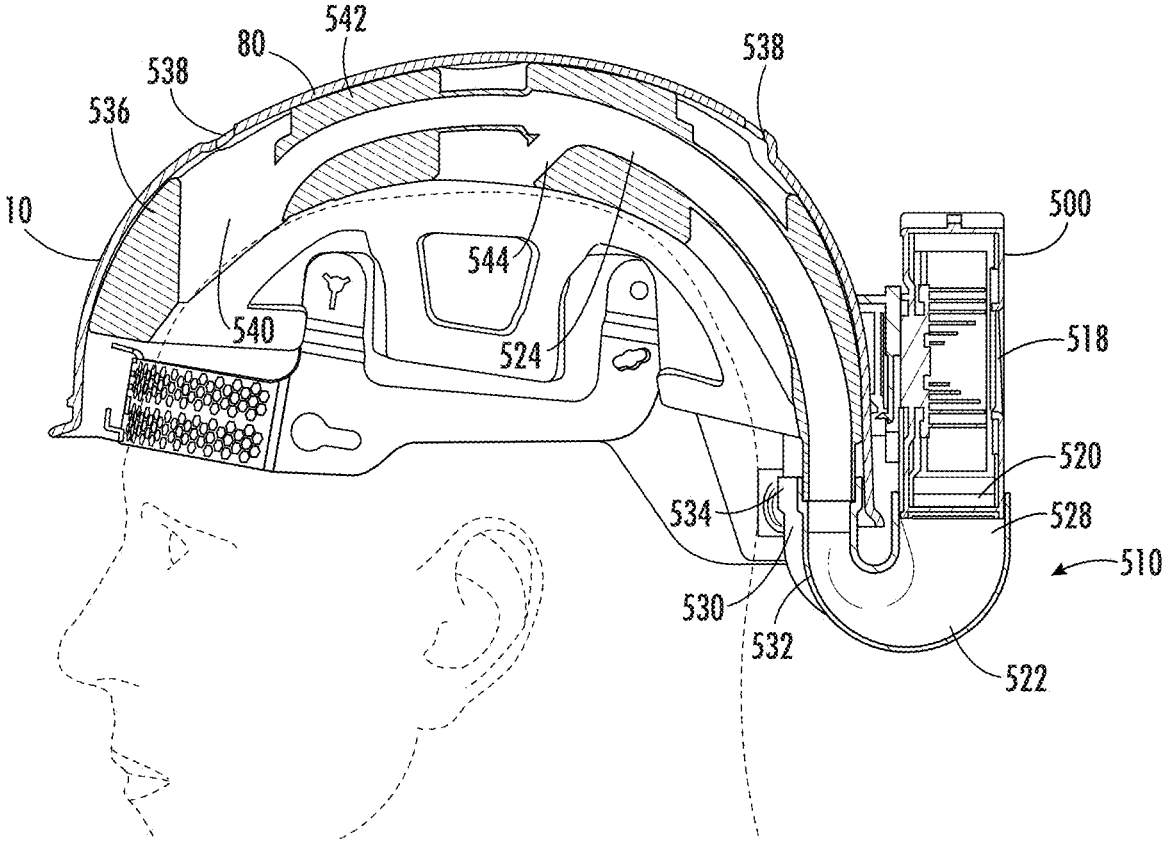
FIG. 38 is a side cross sectional view of the fan and manifold system of FIG. 35, according to an exemplary embodiment.
Figure 39:
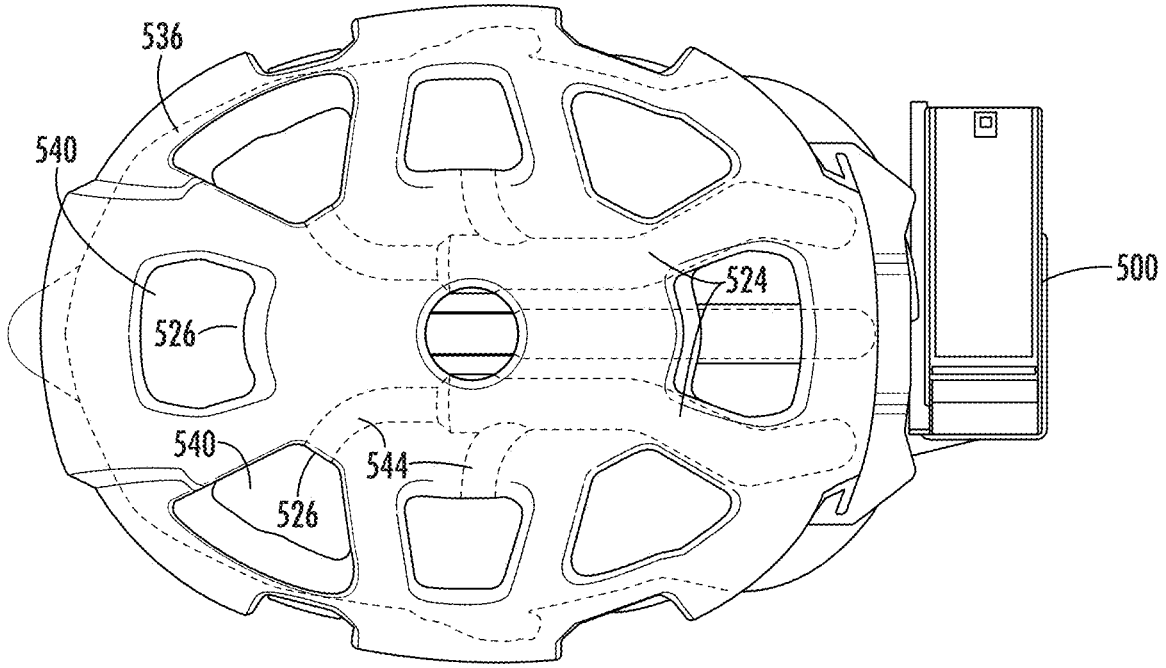
FIG. 39 is a top plan view of the fan and manifold system of FIG. 35 showing the impact absorbing layer of the hard hat in ghost lines, according to an exemplary embodiment.

Referring to FIGS. 35, fan 500 is coupled to hard hat 10 at rear mounting feature 18 above the lower edge 78 of hard hat 10. Specifically, fan 500 is coupled to a fan mounting bracket 512, and fan mounting bracket 512 is mounted at mounting ridge 24 of hard hat 10. Fan 500 is coupled fan mounting bracket 512 through a mounting plate 514. As shown, mounting plate 514 has a generally polygonal shaped perimeter with rounded corners. Two projections 516 with narrow depth are interfacing with mounting plate 514 to attach fan 500 to mounting bracket 512.

Referring to FIGS. 36-39, fan 500 includes an air intake 518 and an exhaust or air outlet 520. Ambient air enters fan 500 through intake 518 and exits through outlet 520. Intake 518 is located on the front of fan 500. Outlet 520, as shown, is located at bottom of fan 500. Manifold system 510 is attached to air outlet 520 to distribute air from fan 500 to and around the head of a user. Manifold system 510 includes a primary duct 522, a plurality of secondary ducts 524, and a plurality of air vents 526.

Primary duct 522 is coupled to outlet 520 of fan 500. Primary duct 522 may be coupled to outlet 520 through a friction fit arrangement, such as through an interference fit, snap fit, press-fit arrangement, etc. As shown, air outlet 520 is received in a first end 528 of primary duct 522. Primary duct 522 extends below the lower edge 78 of hard hat 10 and curves upwards towards inner surface 80 of hard hat 10. Primary duct 522 includes a plurality of projections 530 at a second end 532 of primary duct 522. Projections 530 are elongate tubes coupled to primary duct 522 and configured to receive secondary ducts 524. Secondary ducts 524 may be coupled to projections 530 through a friction fit arrangement, such as through an interference fit, snap fit, press-fit arrangement, etc.

As shown, primary duct 522 includes three projection 530. Projections 530 include outer rims 534. Projections 530 extend towards inner surface 80 of hard hat 10 and rest against the lower edge 78 of inner surface 80.

Referring to FIGS. 36-39, hard hat 10 includes a foam or impact absorbing layer 536 and open ports 538. Impact absorbing layer 536 is helmet shaped and securely fits within hard hat 10. A top surface 542 of impact absorbing layer 536 lies adjacent to inner surface 80 of hard hat 10. Impact absorbing layer 536 may be coupled to hard hat 10 through any suitable attachment mechanism, such as adhesives, fasteners, or friction fit arrangements. Impact absorbing layer 536 includes cavities 540 that extend through impact absorbing layer 536. Cavities 540 may align with open ports 538 to allow ambient air to enter hard hat 10. As shown, cavities 540 are polygonal shapes and evenly spaced around impact absorbing layer 536.

Secondary ducts 524 are embedded in impact absorbing layer 536. Secondary ducts 524 extend through impact absorbing layer 536 and terminate at air vents 526. Air vents 526 are apertures that open into cavities 540 to provide cooling air from fan 500 to the head of a user. Secondary ducts 524 includes branching arms 544. Branching arms 544 allow secondary ducts 524 to deliver air to multiple air vents 526.

As shown, manifold system 510 includes three secondary ducts 524 which includes six branching arms 544. Each secondary duct 524 has two branching arms 544 which extend into two cavities 540.

Referring generally to FIG. 40-45, hard hat 10 with a fan 600 and a manifold system 610 is shown according to an exemplary embodiment. Fan 600 is substantially the same as fan 100, 200, 300, 400, or 500, except as discussed herein. Manifold system 610 is substantially the same as manifold system 510, except that manifold system 610 is configured to move (e.g., vacuum, suck, push, pull, etc.) hot/humid air out of hard hat 10.

Figure 40:
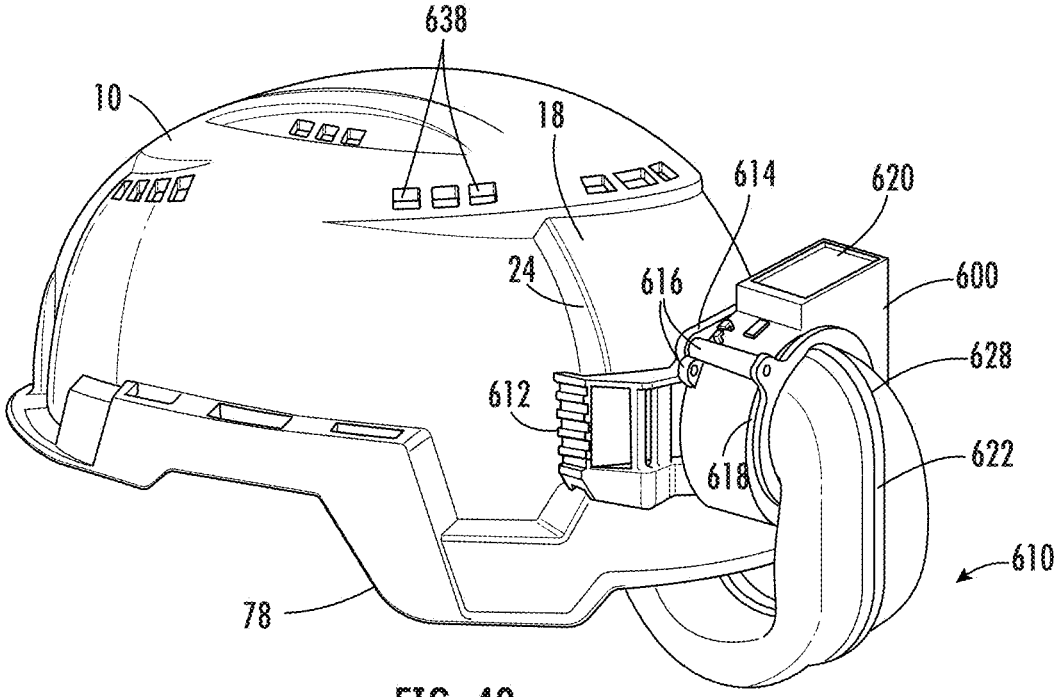
FIG. 40 is rear perspective view of a hard hat with fan and manifold system, according to an exemplary embodiment.
Figure 41:
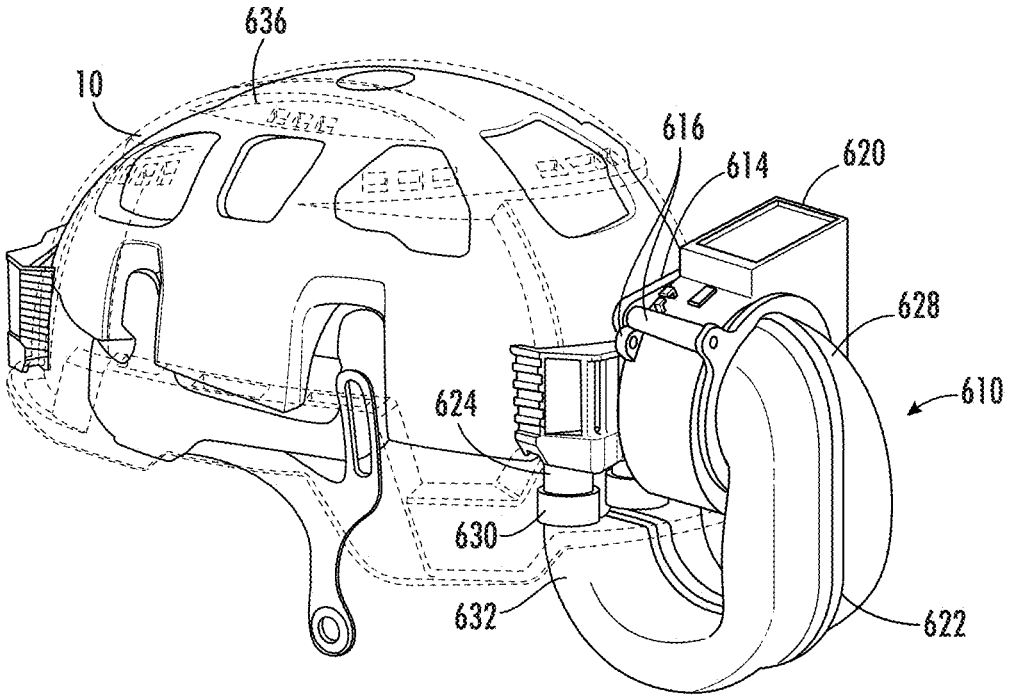
FIG. 41 is rear perspective view of the hard hat with fan and manifold system of FIG. 40 showing the hard hat in ghost lines, according to an exemplary embodiment.
Figure 42:
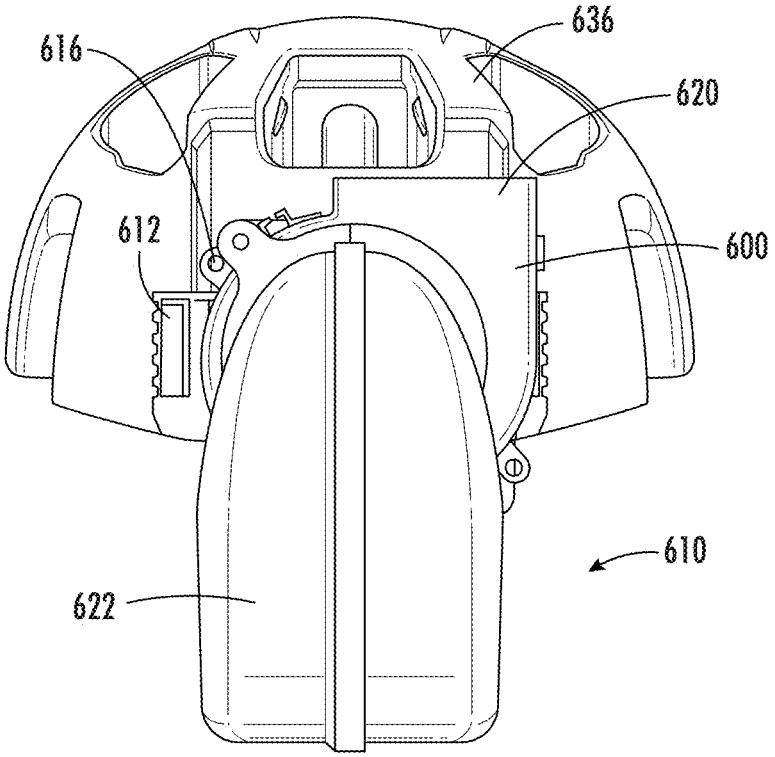
FIG. 42 is a rear plan view of the fan and manifold system of FIG. 40, according to an exemplary embodiment.
Figure 43:
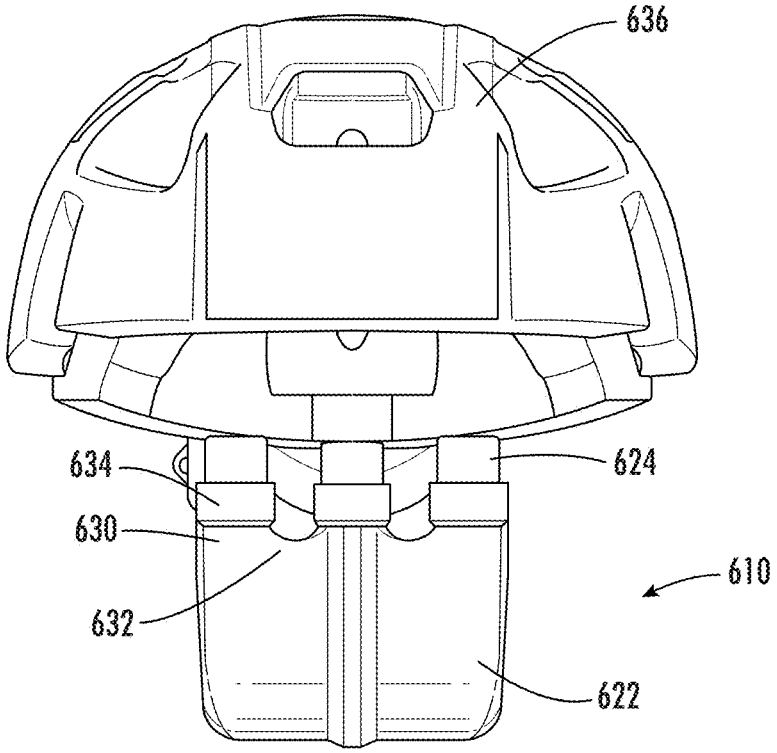
FIG. 43 is a front plan view of the fan and manifold system of FIG. 40, according to an exemplary embodiment.
Figure 44:
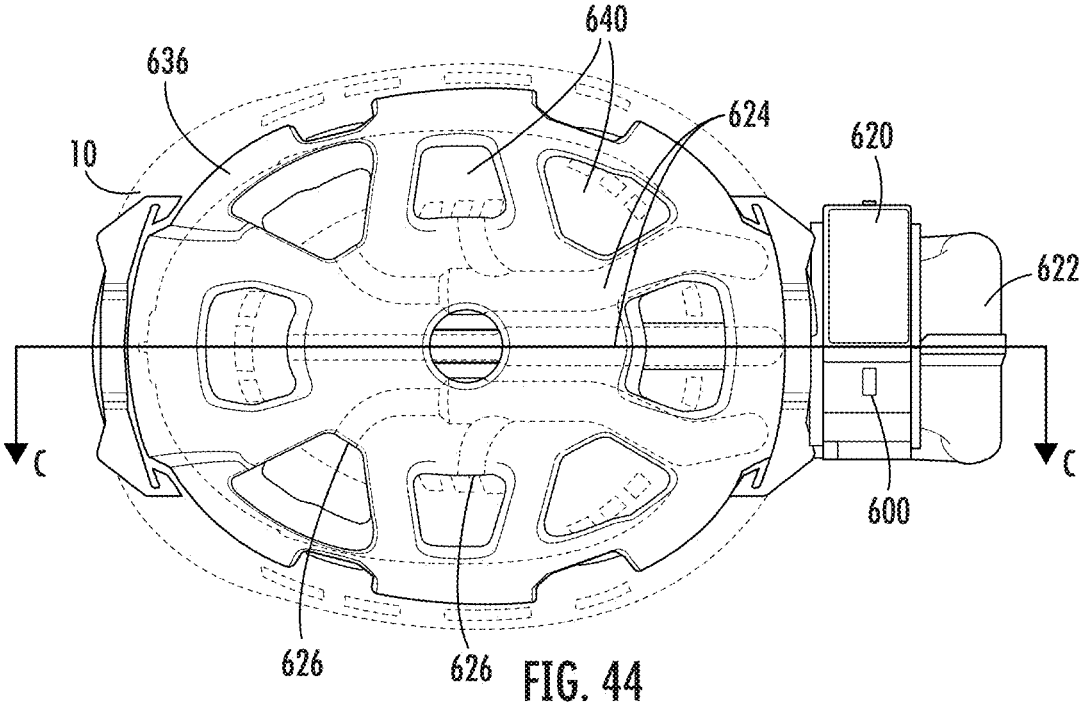
FIG. 44 is a top plan view of the hard hat with fan and manifold system of FIG. 40 showing the hard hat in ghost lines, according to an exemplary embodiment.
Figure 45:
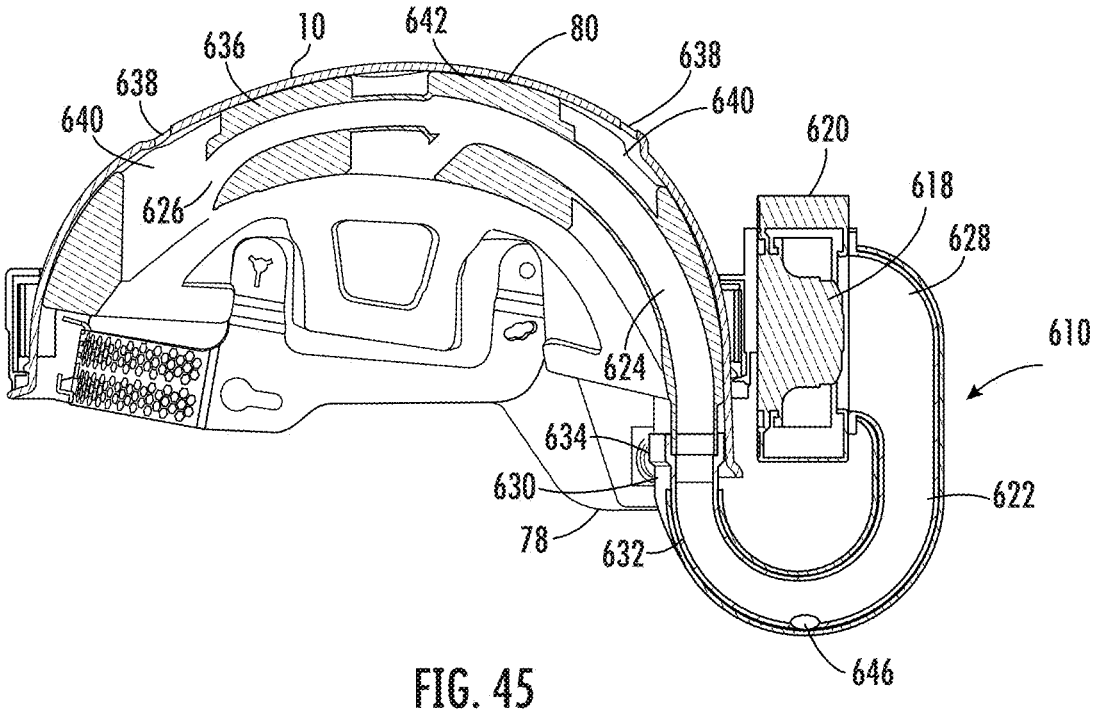
FIG. 45 side cross sectional view of the hard hat with fan and manifold system of FIG. 44 taken along line C-C, according to an exemplary embodiment.
Figure 46:
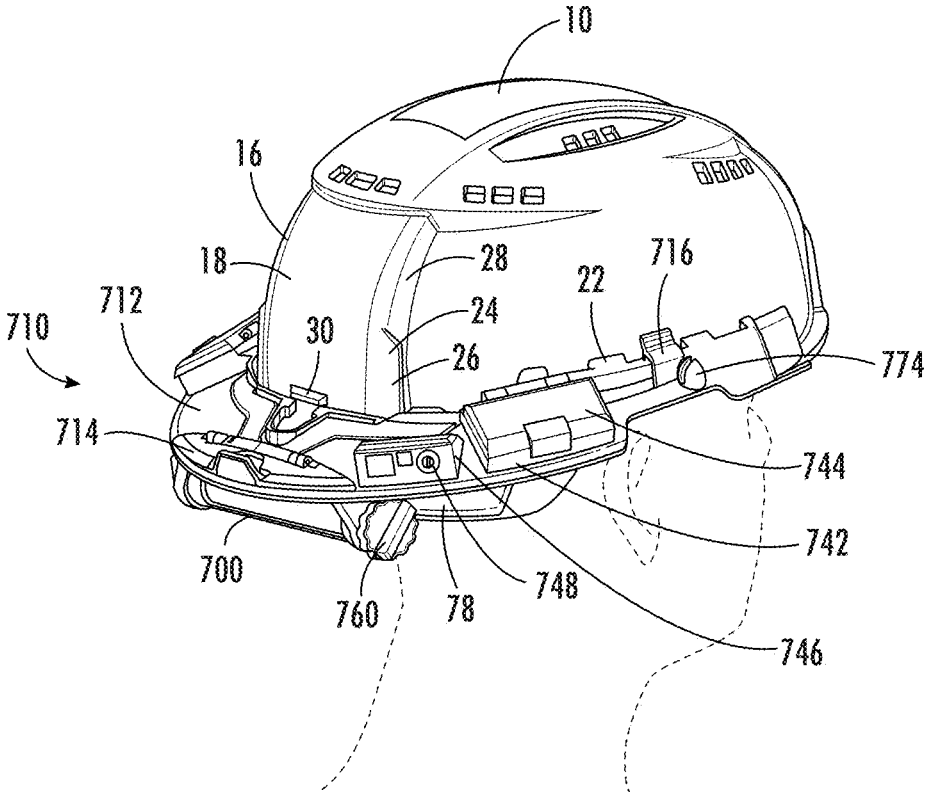
FIG. 46 is a rear perspective view of a fan system connected to a hard hat, according to an exemplary embodiment.
Figure 47:
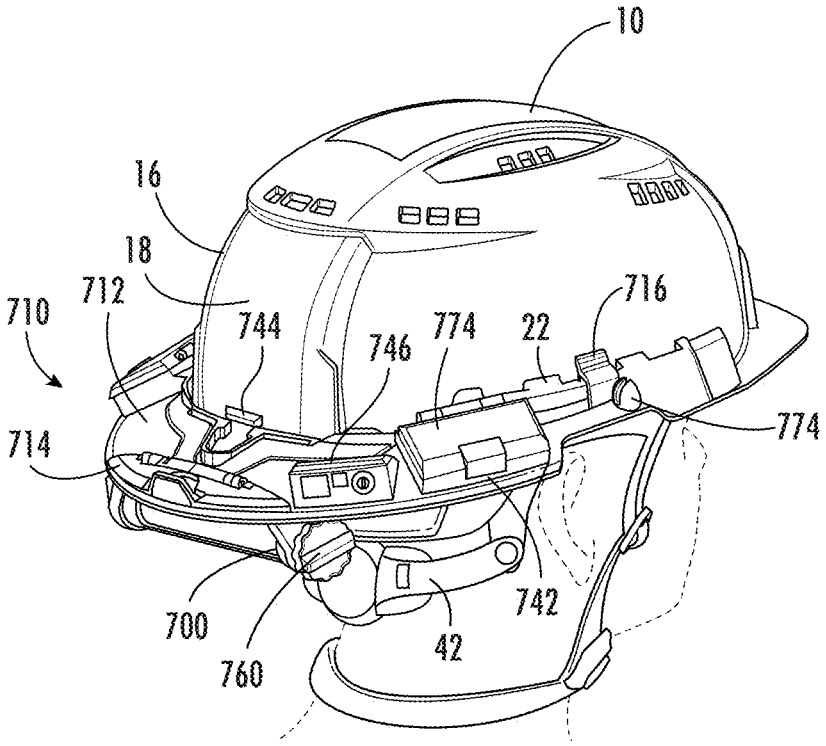
FIG. 47 is a rear perspective view of the fan system and hard hat of FIG. 46, according to an exemplary embodiment.

Referring to FIG. 40, fan 600 is coupled to hard hat 10 at rear mounting feature 18 above the lower edge 78 of hard hat 10. Specifically, fan 600 is coupled to a fan mounting bracket 612, and fan mounting bracket 612 is mounted at mounting ridge 24 of hard hat 10. Fan 600 is coupled fan mounting bracket 612 through a mounting plate 614. Mounting plate 614 includes holes 615 configured to receive a fastener. Fan 600 includes a plurality of projections 616 that are configured to receive a fastener. Mounting plate 614 can be coupled to fan 600 by aligning at least one hole 615 with at least one projection 616 and securing them together with a fastener. Projections 616 may have varied depth to allow different types and lengths of fasteners.

Referring to FIGS. 41-45, fan 600 includes an air intake 618 and an exhaust or air outlet 620. Ambient air enters fan 600 through intake 618 and exits through outlet 620. Intake 618 is located on the front of fan 600. Different from outlet 520 of fan 500, outlet 620 is located along one side of fan 600 and angled to direct air up from the top of fan 600. Different from manifold system 510, manifold system 610 is attached to air intake 618 such that fan 600 removes hot/humid air from between the head of a user and hard hat 10.

Manifold system 610 includes a primary duct 622, a plurality of secondary ducts 624, and a plurality of air vents 626. Primary duct 622 is coupled to intake 618 of fan 600 at a first end 628 of primary duct 622. Primary duct 622 may be coupled to intake 618 through a friction fit arrangement, such as through an interference fit, snap fit, press-fit arrangement, etc., or through the use of adhesives or fasteners. As shown, primary duct 622 extends below the lower edge 78 of hard hat 10 and curves upwards towards inner surface 80 of hard hat 10. Primary duct 622 includes a plurality of projections 630 at a second end 632 of primary duct 622. Projections 630 are elongate tubes coupled to primary duct 622 and configured to receive secondary ducts 624. Secondary ducts 624 may be coupled to projections 630 through a friction fit arrangement, such as through an interference fit, snap fit, press-fit arrangement, etc.

As shown, primary duct 622 includes three projection 630. Projections 630 include outer rims 634. Projections 630 extend towards inner surface 80 of hard hat 10 and rest against the lower edge 78.

As shown in FIG. 41-45, hard hat 10 includes a foam or impact absorbing layer 636 and open ports 638. Impact absorbing layer 636 is helmet shaped and securely fits within hard hat 10. A top surface 642 of impact absorbing layer 636 lies adjacent to inner surface 80 of hard hat 10. Impact absorbing layer 636 may be coupled to hard hat 10 through any suitable attachment mechanism, such as adhesives, fasteners, or friction fit arrangements. Impact absorbing layer 636 includes cavities 640. Cavities 640 extend through impact absorbing layer 636. Cavities 640 may align with open ports 638 to allow ambient air to enter hard hat 10. As shown, cavities 640 are polygonal shapes and evenly spaced around impact absorbing layer 636.

Secondary ducts 624 are embedded in impact absorbing layer 636. Secondary ducts 624 extend through impact absorbing layer 636 and terminate at air vents 626. Air vents 526 are apertures that open into cavities 640 to move hot/humid air out of cavities 640 through manifold system 610 and out air outlet 620. Ambient air may be drawn into cavities 640 through ports 638 by a vacuum created. Secondary ducts 624 includes branching arms 644. Branching arms 644 allow secondary ducts 624 to deliver air to multiple air vents 626.

As shown, manifold system 610 includes three secondary ducts 624 which includes six branching arms 644. Each secondary duct 624 has two branching arms 644 which extend into two cavities 640.

In various embodiments, manifold system 610 includes a water drain 646. Water drain 646 is an opening or aperture located in primary duct 622. Specifically, water drain 646 is located at the lowest point between first end 628 and second end 632. Water drain allows for moisture that enters manifold system 610 to exit.

Referring generally to FIGS. 46-62, hard hat 10 with a fan 700 and fan system 710 is shown according to an exemplary embodiment. Referring to FIGS. 46-49, fan system 710 includes a brim mounting bracket 712 attached to hard hat 10, a support mount 714 removably coupled to brim mounting bracket 712, and fan 700 removably coupled to the support mount 714.

Brim mounting bracket 712 is attached to hard hat 10 at rear mounting feature 18. Specifically, brim mounting bracket 712 is coupled to mounting ridge 24 and side accessory mounts 22. Brim mounting bracket 712 includes side attachment brackets or clips 716 which are removably coupled to side accessory ridges 22. Brim mounting bracket 712 extends outwards from rear 16 of hard hat 10 and partially around the sides of hard hat 10. Specifically, brim mounting bracket 712 is generally flat and extends half-way around hard hat 10. Brim mounting bracket 712 has a similar shape and size to brim or bill 20. Brim mounting bracket 712 is located above lower edge 78 of hard hat 10.

Figure 51:
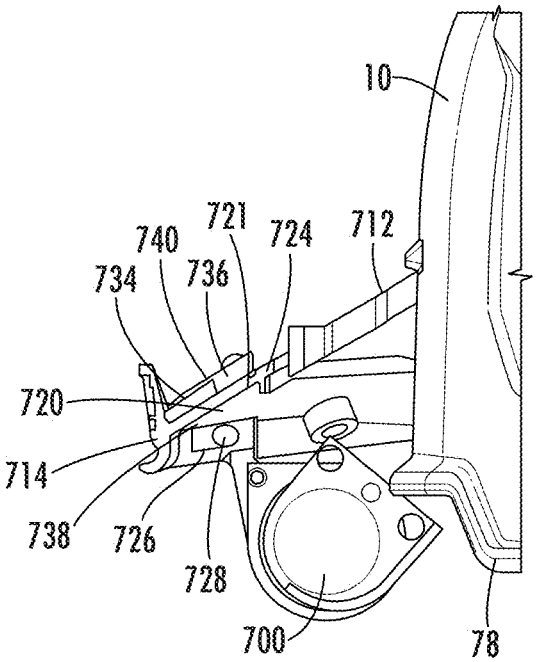
FIG. 51 is a cross-sectional detailed view of the fan system and fan of FIG. 51 with the fan in the down position, according to an exemplary embodiment.
Figure 53:
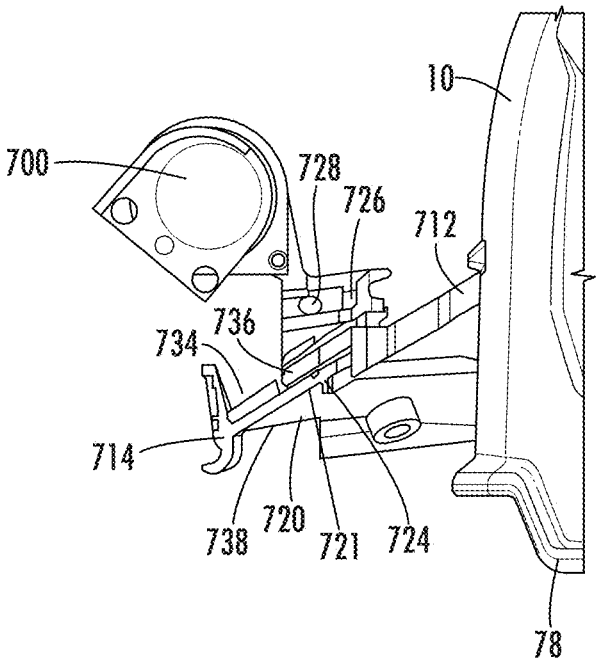
FIG. 53 is a cross-sectional detailed view of the fan system and hard hat of FIG. 53 with the fan in the up position, according to an exemplary embodiment.

Support mount 714 is coupled to brim mounting bracket 712. Specifically, support mount 714 is centered on brim mounting bracket 714 and aligned with retention cleat 30. Support mount 714 is coupled to the outer edge 718 of brim mounting bracket 714. Support mount 714 may be coupled to brim mounting bracket 712 through a friction fit arrangement, such as through an interference fit, snap fit, press-fit arrangement, etc. As best shown in FIGS. 51 and 53, support mount 714 is coupled to brim mounting bracket 712 through a snap fit. Brim mounting bracket 712 includes a projection 720. Projection 720 has an upper ridge 721. Support mount 714 has a connection 722. Connection 722 is configured to receive projection 720 and is sized substantially the same as projection 720. Connection 722 includes a lip 724 at an open end. Lip 724 makes the open end narrower than the thickest section of projection 720. When support mount 714 is coupled to brim mounting bracket 712, connection 722 receives projection 720 and lip 724 is secured against upper ridge 721 to prevent translational movement. In this way, the support mount 714 cannot disconnect from brim mounting bracket 712 during normal operation of the fan system 710.

Fan 700 is removably coupled to support mount 714. In the specific embodiment shown, fan 700 is a cross flow fan and is attached horizontally with respect to the hard hat to support mount 714. Brim mounting bracket 712 and support mount 714 are sized and structured such that fan 700 is spaced from the back of a user's head and substantially above lower edge 78. This spacing provide a gap large enough to allow a user access to the ratcheting system 44 when fan 700 is coupled to support mount 714.

Referring to FIGS. 50-53, fan 700 is attached to support mount 714 by hinge 726. Hinge 726 has a rotational axis 728, a first end 730, and a second end 732. The first end 730 is coupled to support mount 714 and the second end is coupled to fan 700. This allows for a user to move fan 700 around rotational axis 728 into an upwards position and a downwards position.

Figure 50:
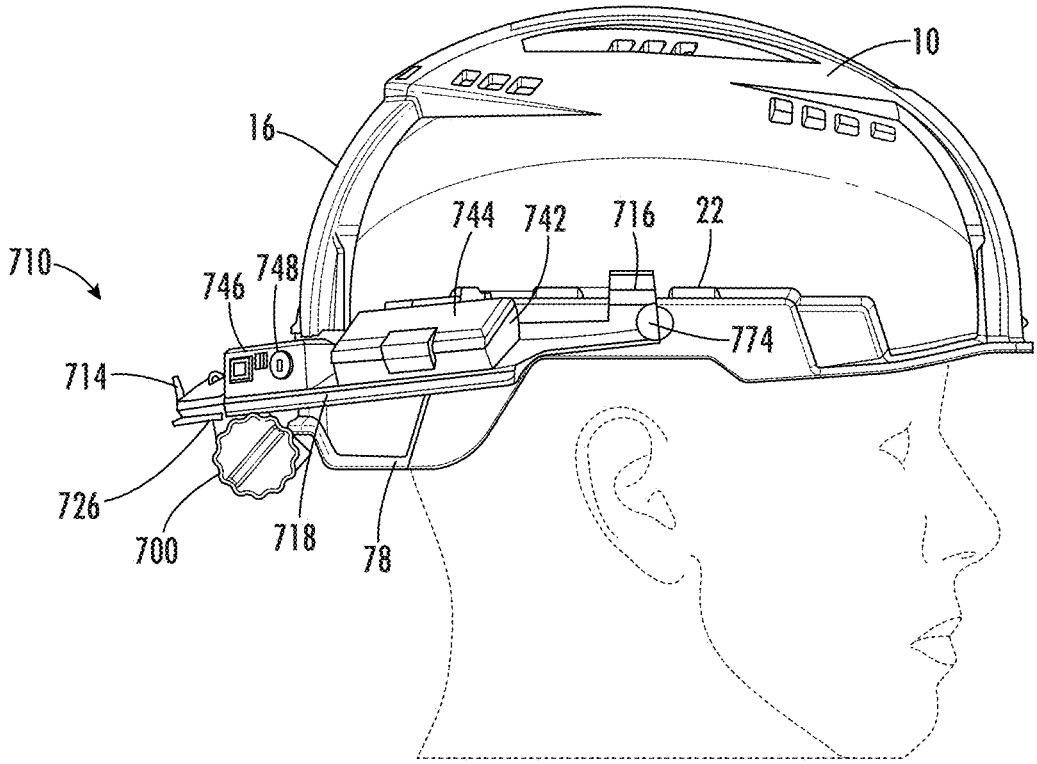
FIG. 50 is side plan view of the fan system and hard hat of FIG. 46 with the fan in the down position, according to an exemplary embodiment.

Referring to FIGS. 50 and 51, support mount 714 with fan 700 in the down position is shown. Support mount 714 includes locking structure 734. When fan 700 is in the down position, the hinge 726 and fan 700 are locked in place by locking structure 734. The first end 730 of hinge 726 is secured against the bottom side of support mount 714, and fan 700 is located below brim mounting bracket 712. When in the down position, fan 700 is locked in place and can be used to provide cooling to the back of a user's neck. As shown, locking structure 734 includes a slidable clip 736 which receives a portion of the first end 730 of hinge 726 when fan 700 is moved into the down position.

Figure 52:
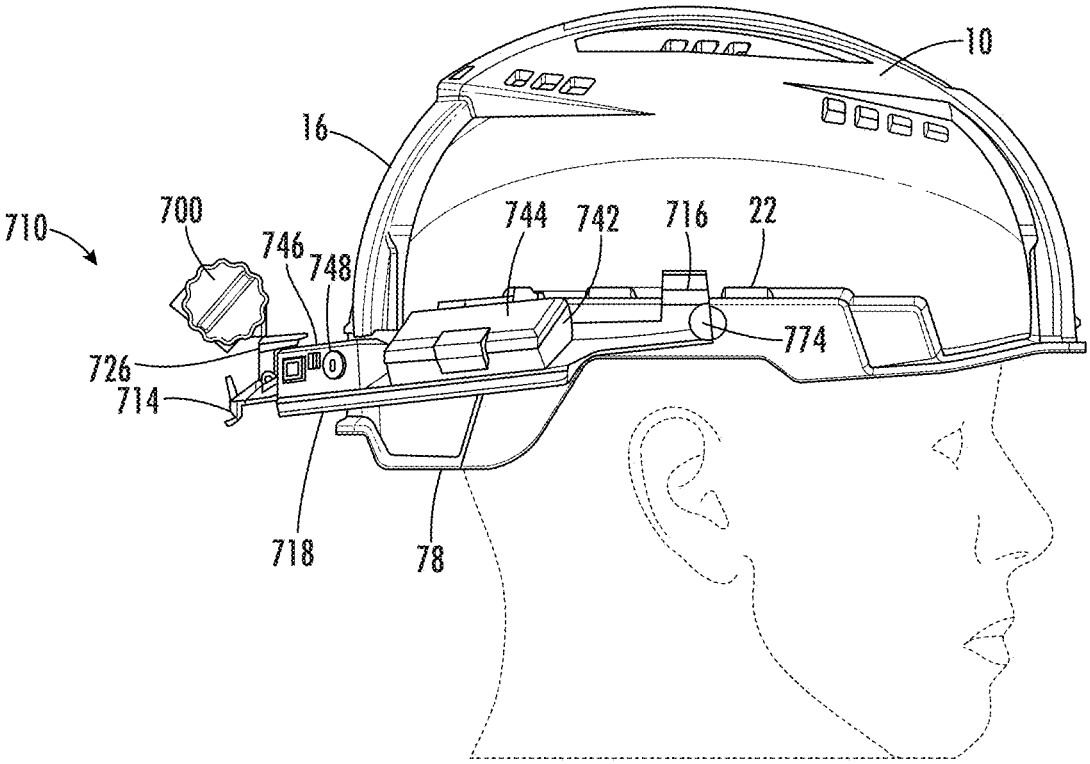
FIG. 52 is a side plan view of the fan system and hard hat of FIG. 46 with the fan in the up position, according to an exemplary embodiment.

Referring to FIGS. 52 and 53, support mount 714 with fan 700 in the up position is shown. When in the up position, the first end 730 of hinge 726 rests against the top side 740 of support mount 714, and fan 700 is located above support mount 714. When fan 700 is in the up position, the locking structure 734 is in the unlocked position and fan 700 and the hinge 726 may be uncoupled from support mount 714. In the same way, when in the unlocked position, fan 700 can be installed on support mount 714.

Figure 56:
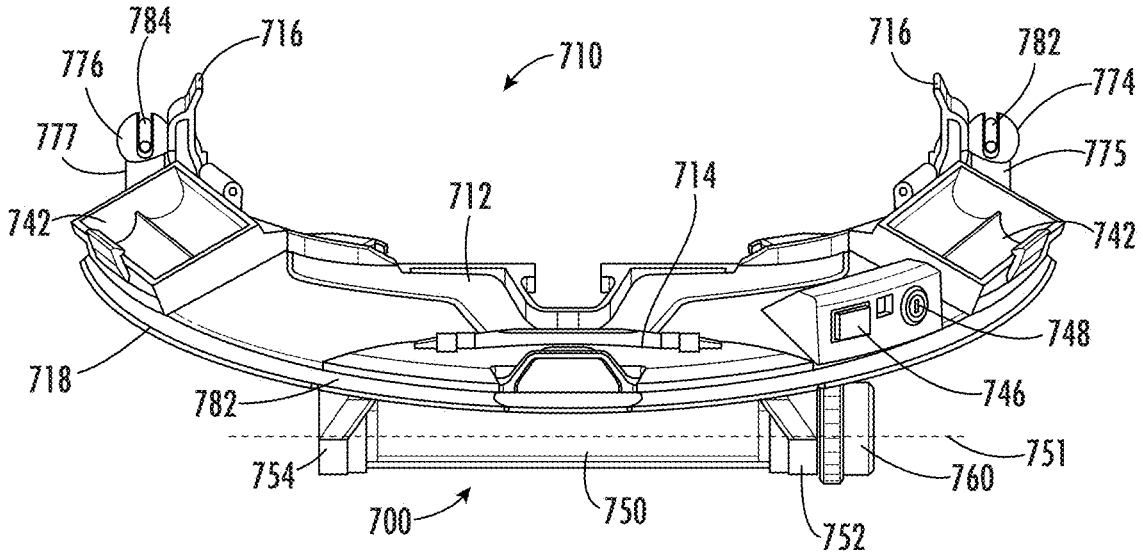
FIG. 56 is a rear plan view of the fan system of FIG. 46, according to an exemplary embodiment.

In various embodiments, brim mounting bracket 712 includes a power source mount 742. As best shown in FIG. 56, two power source mounts 742 are coupled to brim mounting bracket 712. Each power source mount 742 is configured to receive a power source, for example battery cells. Power source mount 742 may have a lid 744 to cover and secure a power source in power source mount 742. In other embodiments, brim mounting bracket 712 includes a power control device 746. As shown, power control device 746 includes an actuator or button 748, which allows a user to selectively power fan 700 by pressing the button 748 in a designated direction.

Figure 48:
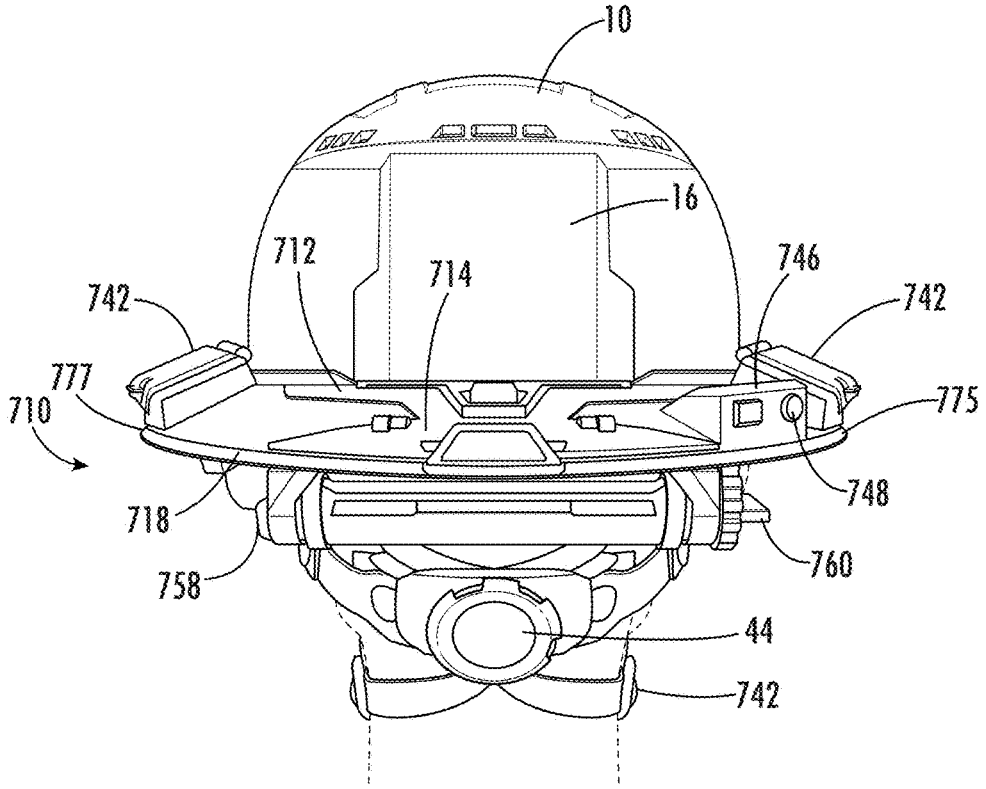
FIG. 48 is a rear plan view of the fan system and hard hat of FIG. 46, according to an exemplary embodiment.
Figure 49:
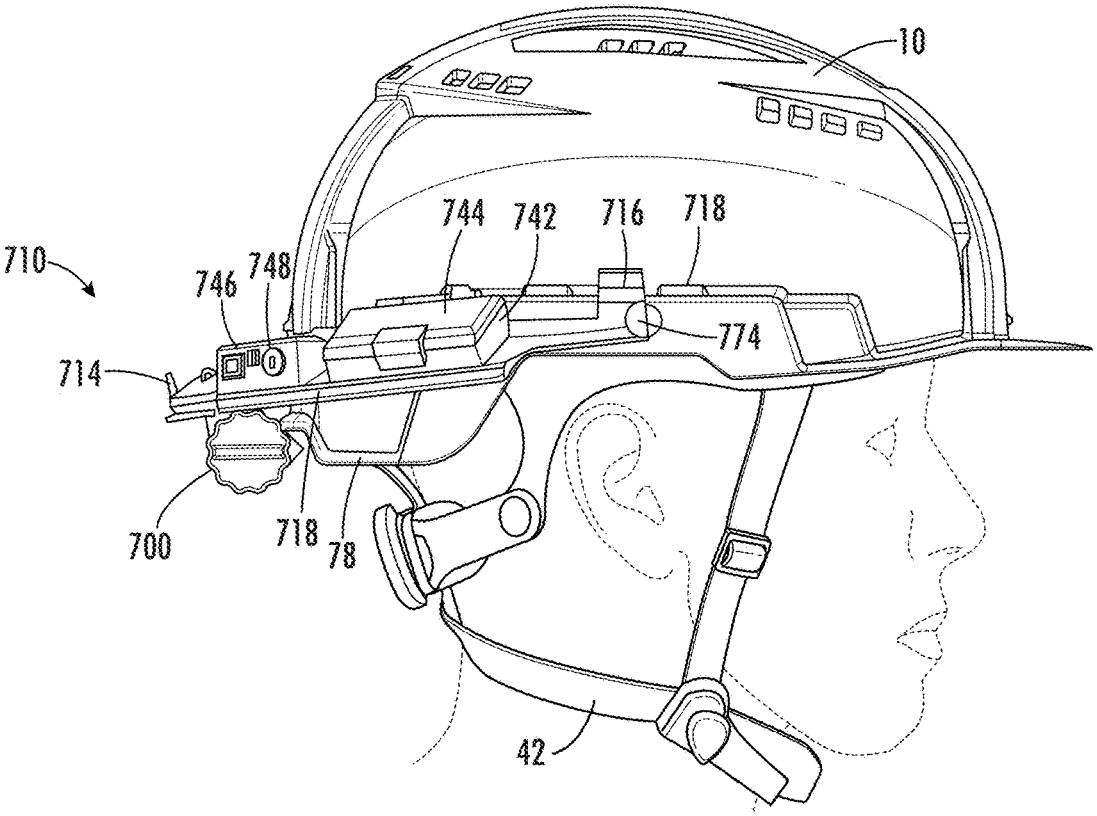
FIG. 49 is a side perspective view of the fan system and hard hat of FIG. 46, according to an exemplary embodiment.
Figure 54:
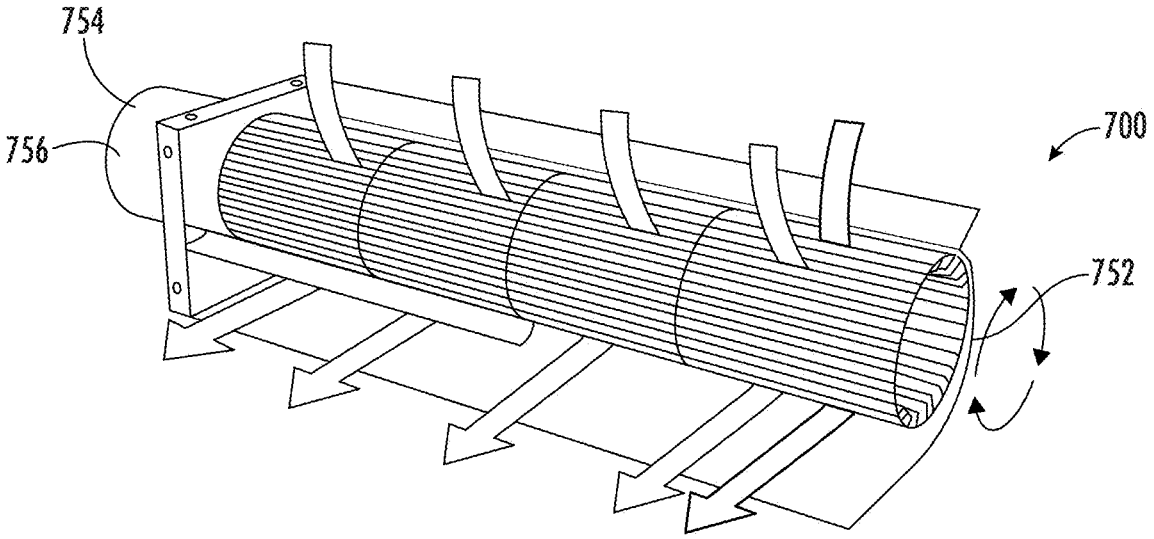
FIG. 54 is a perspective schematic view of the fan of FIG. 46, according to an exemplary embodiment.
Figure 55:
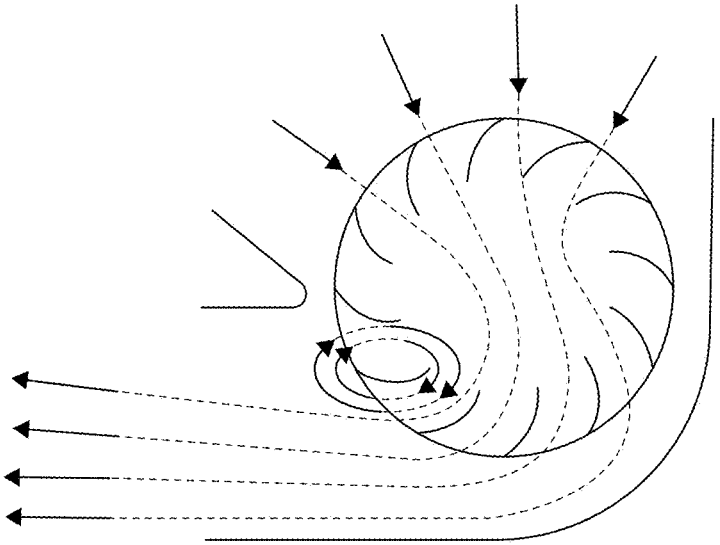
FIG. 55 is a cross-sectional schematic view of the fan of FIG. 55 with directional arrows diagraming air flow through the fan, according to an exemplary embodiment.

In other various embodiments, fan 700 has an elongate body 750 extending along a longitudinal axis 751 with a first end 752 and a second end 754 opposite the first end 752 along the longitudinal axis 751. A motor 756 (as shown in FIG. 54) is located at the first end 752 and is connected to power source mount 742. As best shown in FIG. 48, first end 752 and power source mount 742 are connected by wires 758. A directional control 760 is located at the second end 754 of fan 700. Directional control 760 is a dial or knob. When directional control 760 is rotated in a direction around longitudinal axis 751, the direction that fan 700 will change. Thus, a user can select the direction of air flow from fan 700 by moving directional control 760.

Figure 57:
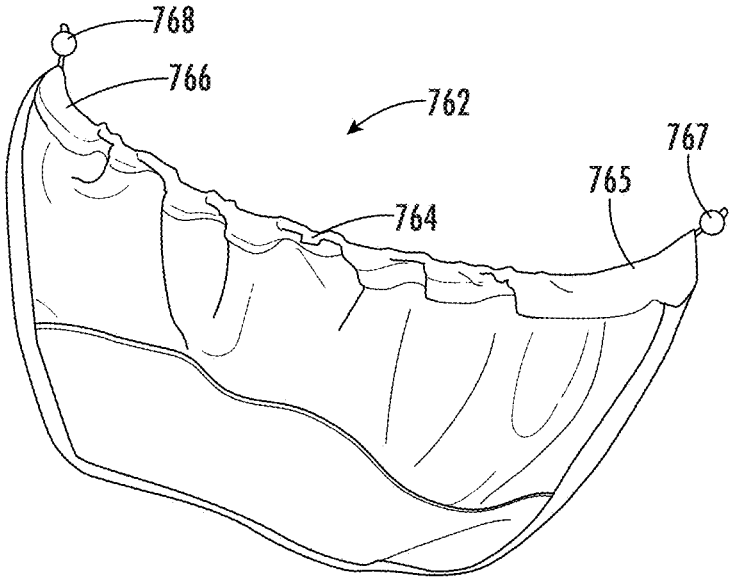
FIG. 57 is a perspective view of a sunshade, according to an exemplary embodiment.

Referring to FIGS. 57-62, fan system 710 is shown with a sunshade 762 attached. Sunshade 762 provides added cooling to a user by blocking ultraviolet radiation from reaching the back of a user's neck. Referring to FIG. 57, sunshade 762 is shown according to an exemplary embodiment. Sunshade 762 includes a cord 764 with a first end 765 and a second end 766, a first retention anchor 767 coupled to the first end 765, and a second retention anchor 768 coupled to second end 766. As shown, retention anchors 767, 768 are spherical or ball shaped with a central tunnel 770 that receives cord 764 to attach retention anchors 767, 768 to cord 764.

Figure 58:
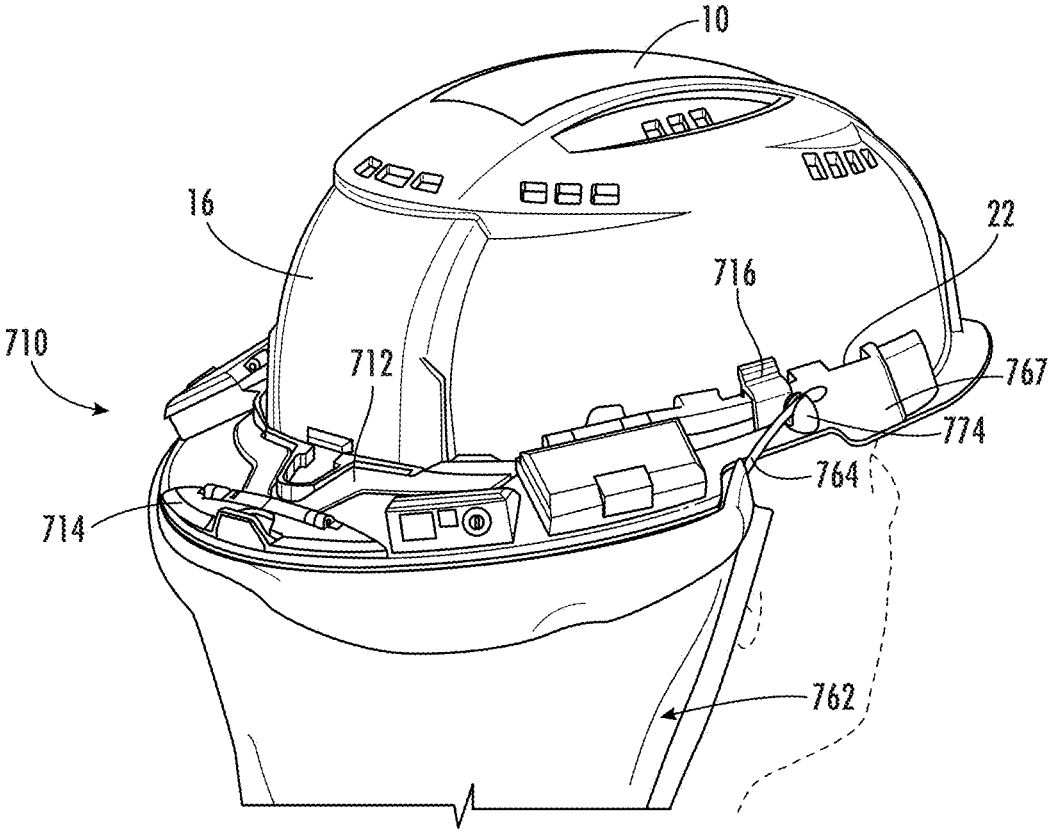
FIG. 58 is a rear perspective view of the fan system and hard hat with the sunshade of FIG. 57 attached, according to an exemplary embodiment.
Figure 59:
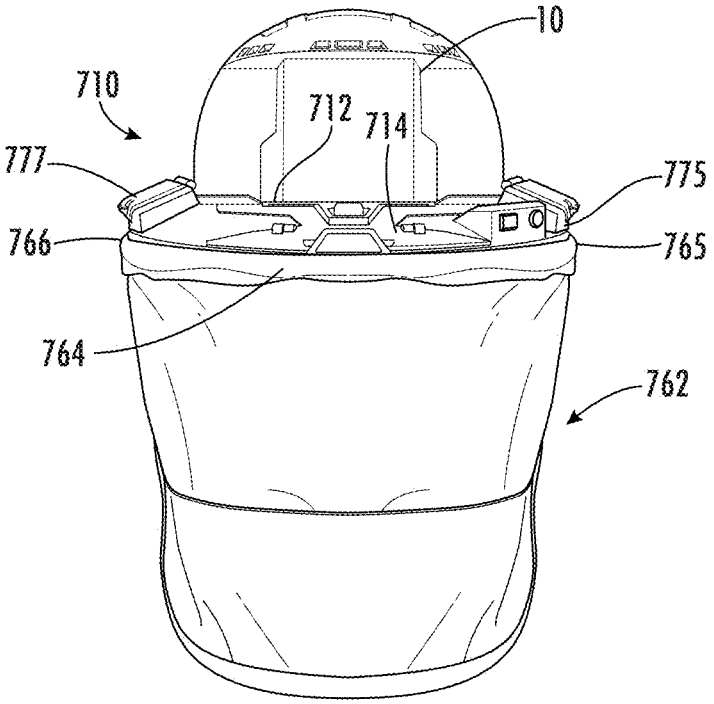
FIG. 59 is a rear plan view of the fan system with the sunshade attached of FIG. 58, according to an exemplary embodiment.
Figure 60:
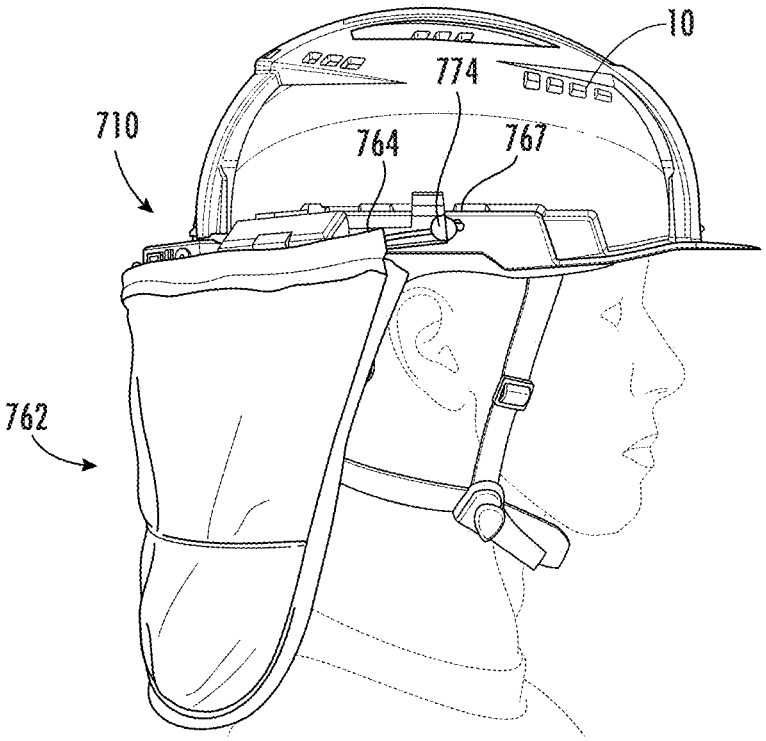
FIG. 60 is a side perspective view of the fan system with the sunshade attached of FIG. 58, according to an exemplary embodiment.

Referring to FIGS. 58-60, sunshade 762 is removably attached to fan system 710 through sunshade attachment system 772. Sunshade attachment system 772 includes first receiver 774 coupled to the brim mounting bracket 712 at a first end 775, a second receiver 776 coupled to brim mounting bracket at a second end 777, and a retention groove 778.

Referring to FIG. 56, retention groove extends along outer edge 718 between the first end 775 and second end 777 of brim mounting bracket 712. Retention groove 778 also extends along a front edge 782 of support mount 714. In this way, retention groove 778 is a continuous channel that receives cord 764 between the first end 775 and second end 777 of brim mounting bracket 712. When the sunshade 762 is coupled to the sunshade attachment system 772, the cord 764 is received in the retention groove 778, the first retention anchor 767 is received in the first receiver 774, and the second retention anchor 768 is received in the second receiver 776.

Figure 61:
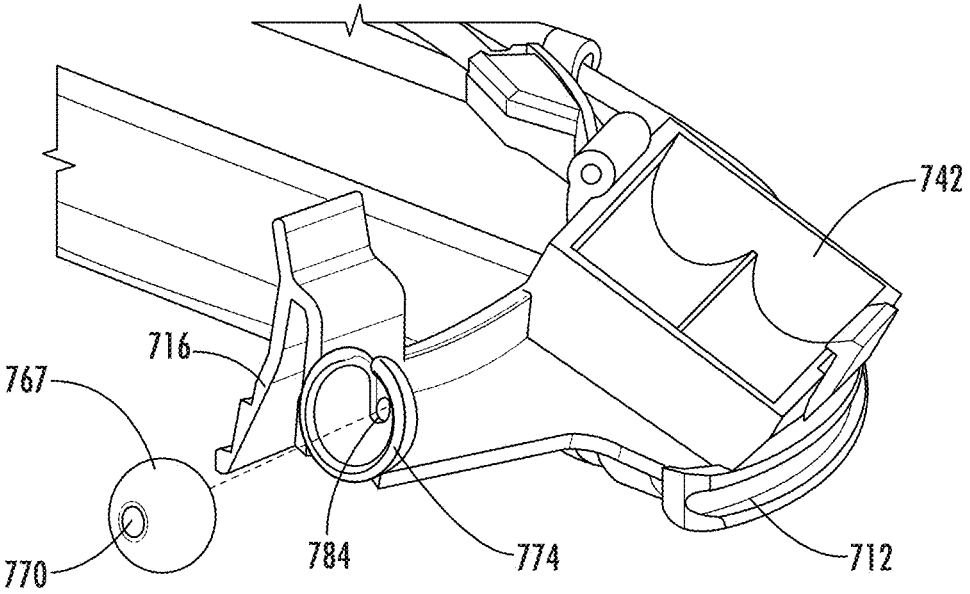
FIG. 61 is a detailed view of a receiver and retention anchor, according to an exemplary embodiment.
Figure 62:
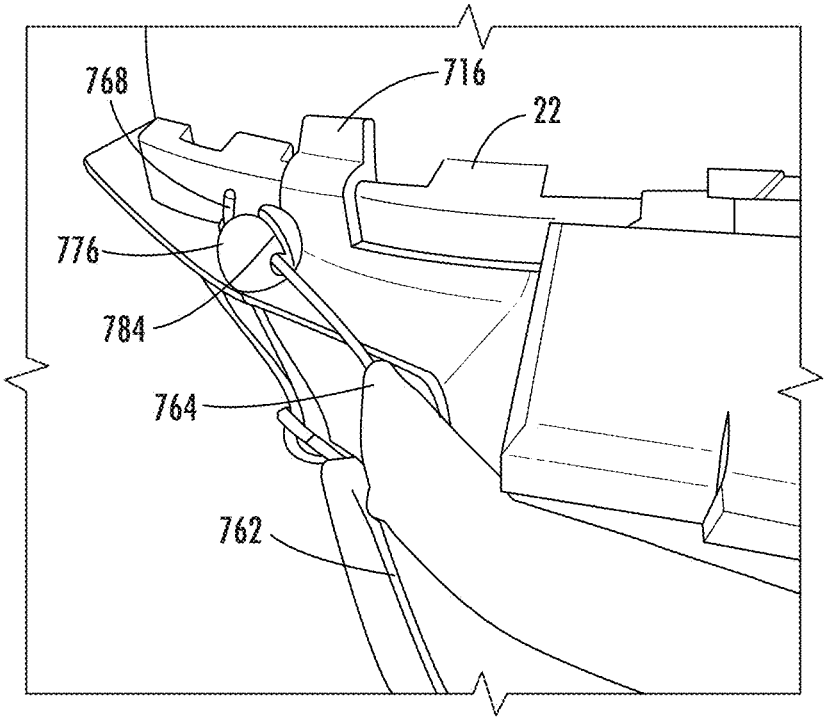
FIG. 62 is a detailed view of the fan system with the sunshade attached of FIG. 58, according to an exemplary embodiment.
Figure 63:
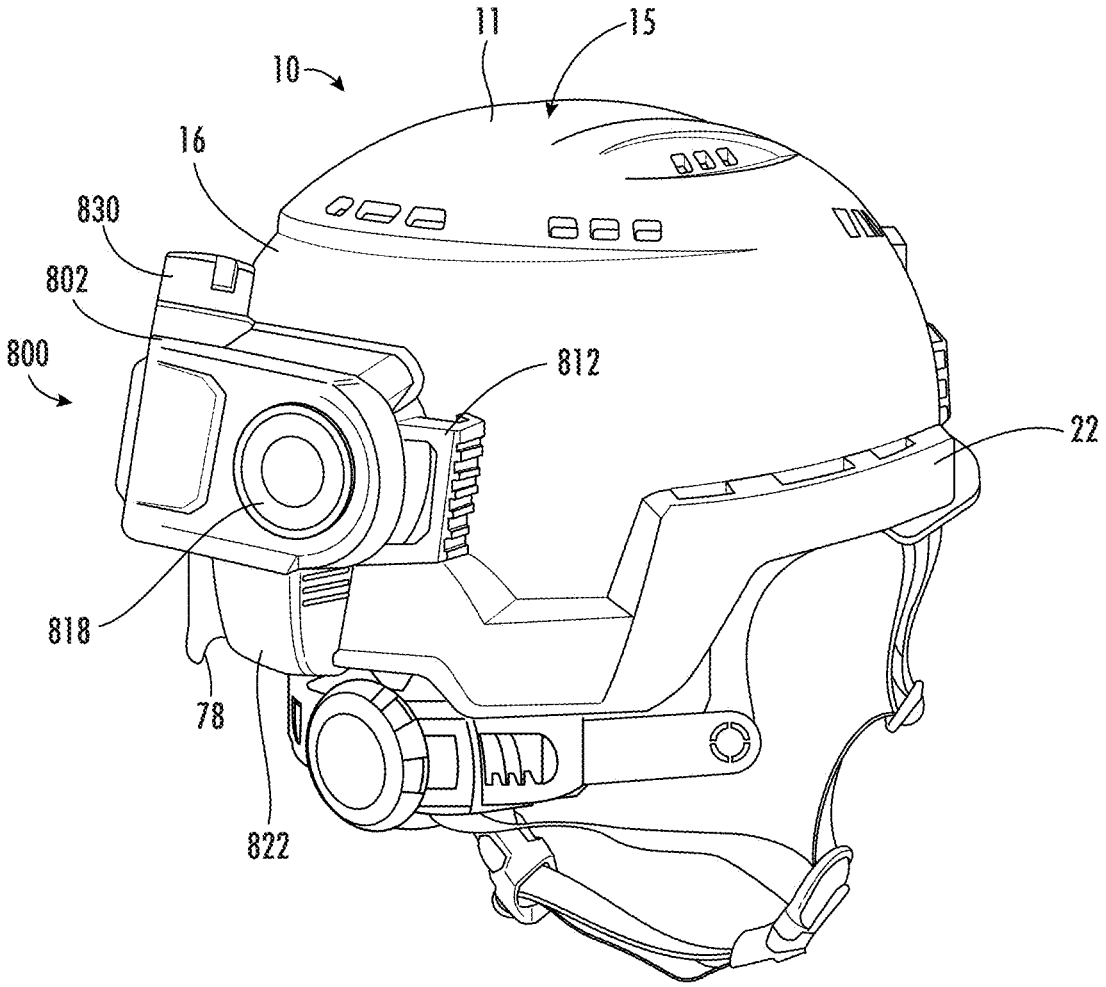
FIG. 63 is a rear perspective view of a fan system connected to a hard hat, according to an exemplary embodiment.
Figure 64:
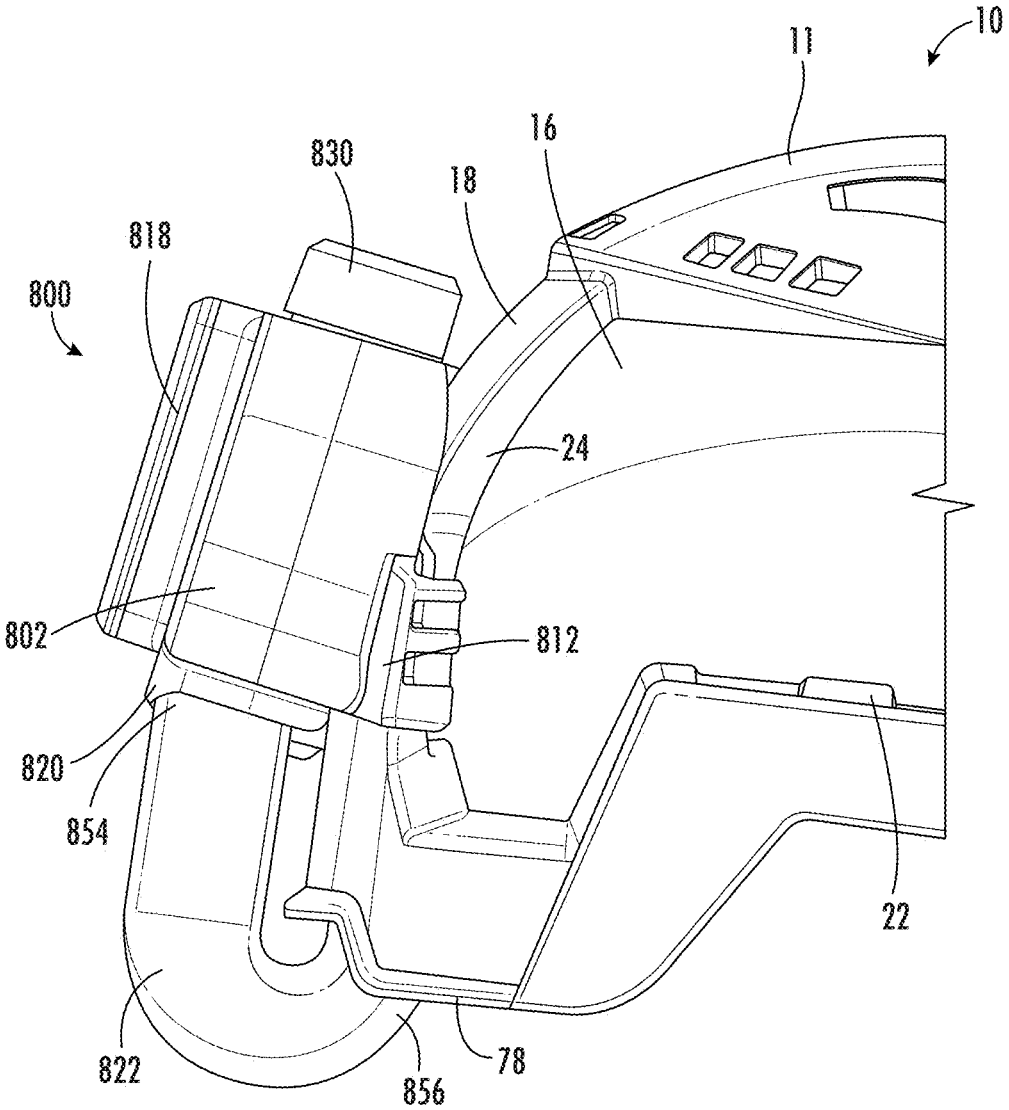
FIG. 64 is a detailed side view of the fan system and hard hat of FIG. 63, according to an exemplary embodiment.
Figure 65:
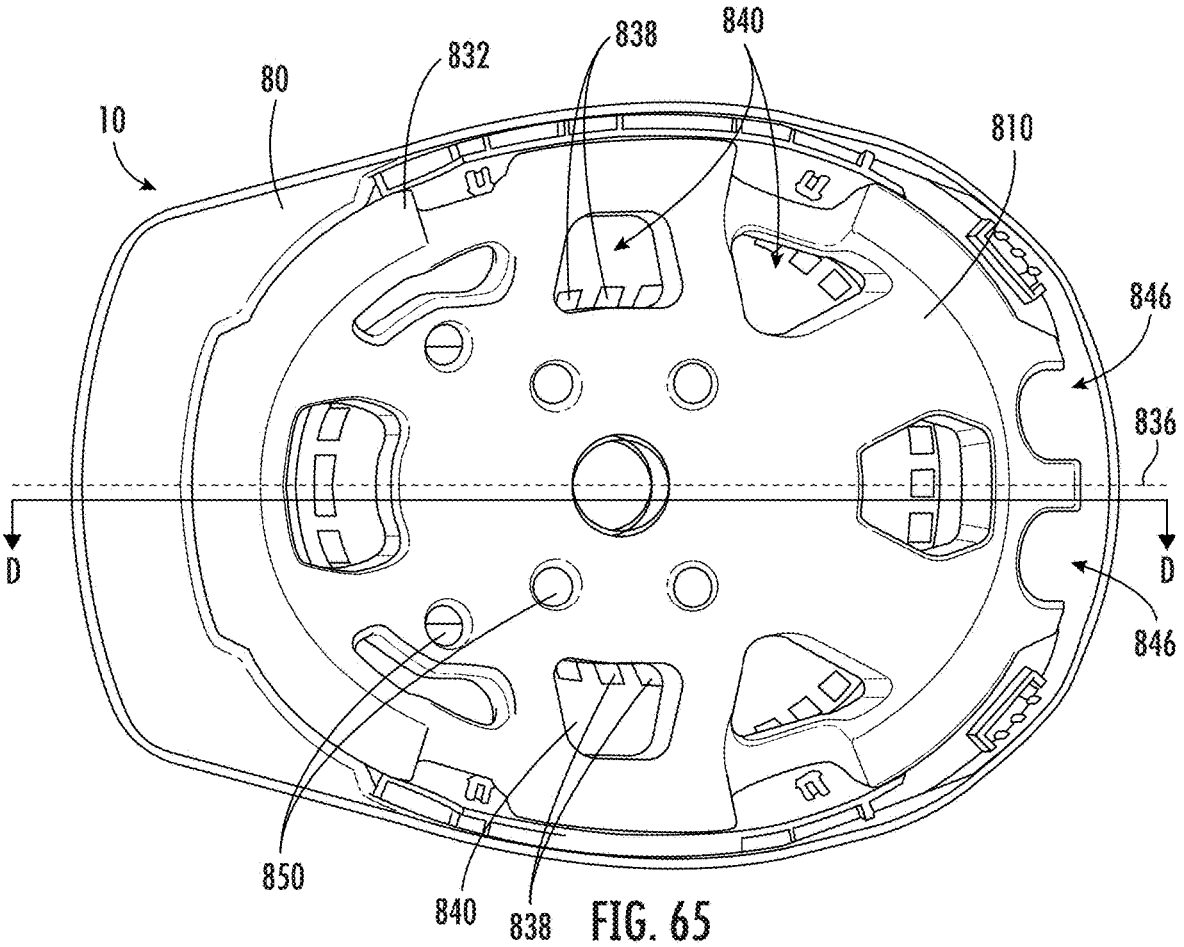
FIG. 65 is a bottom plan view of the fan system and hard hat of FIG. 63, according to an exemplary embodiment.
Figure 66:
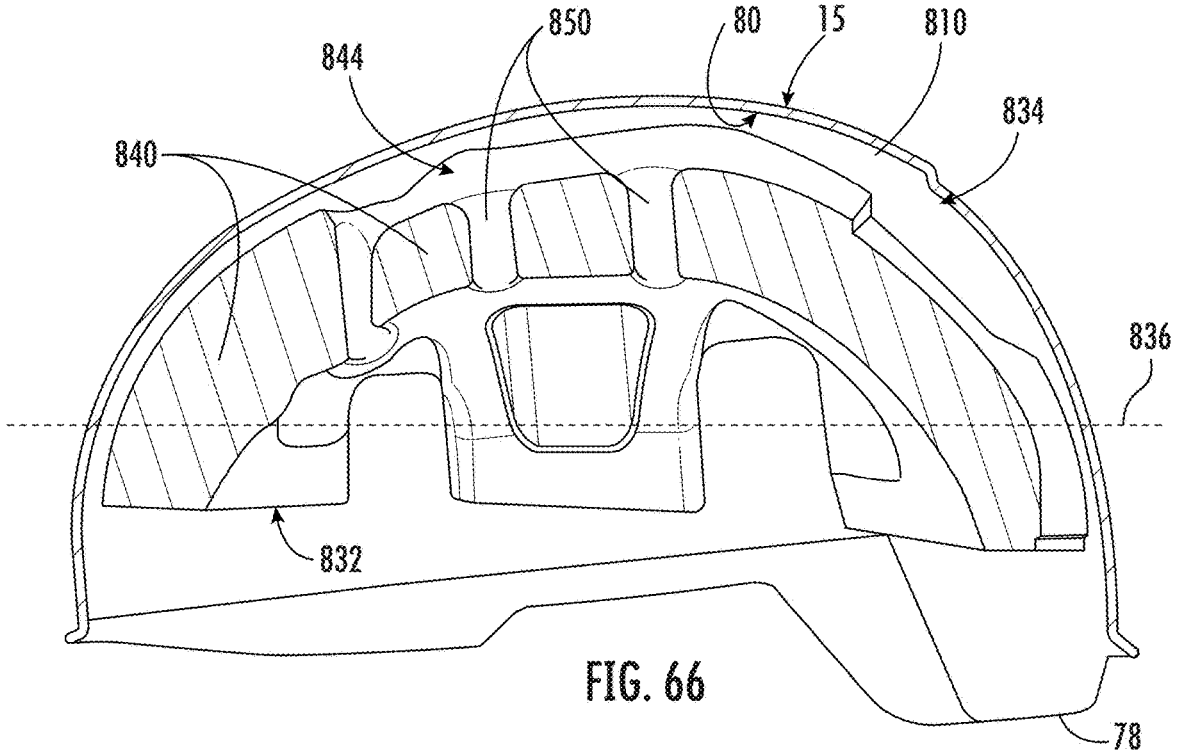
FIG. 66 is a cross-sectional view of the fan system and hard hat of FIG. 65 taken along line D-D, according to an exemplary embodiment.
Figure 67:
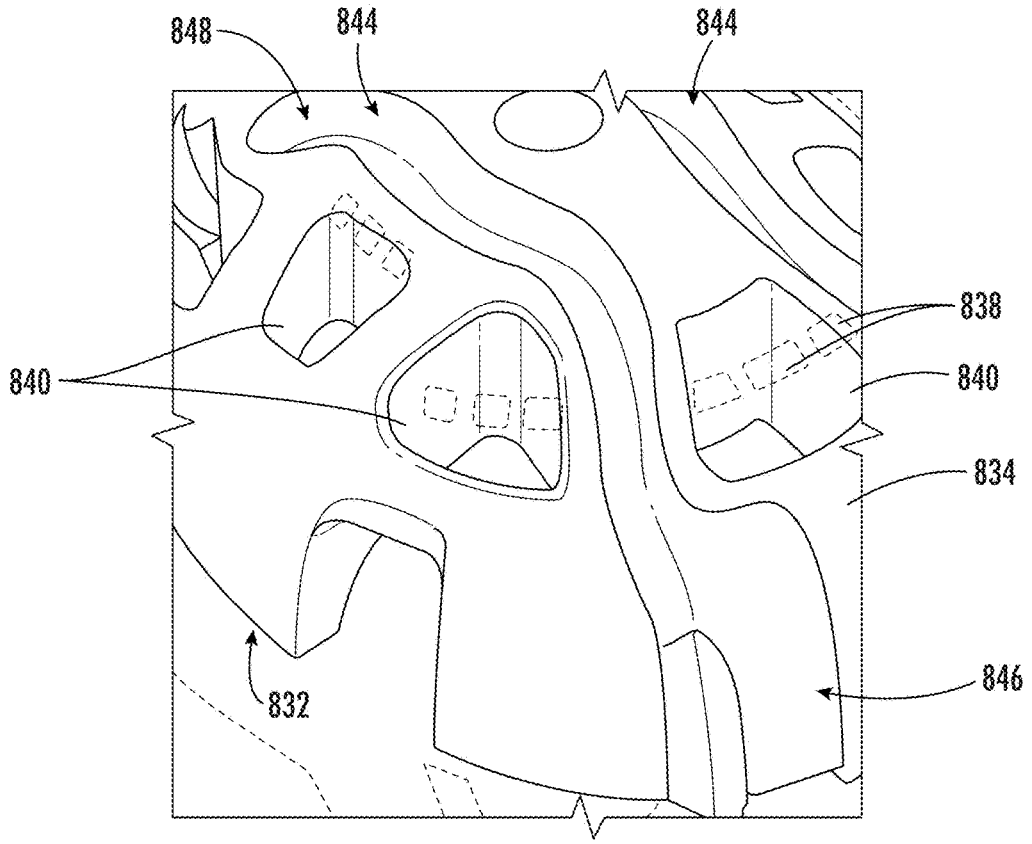
FIG. 67 is a detailed view of a channel in the impact absorbing layer of the fan system and hard hat of FIG. 63, according to an exemplary embodiment.

As best shown in FIGS. 56 and 61, first and second receivers 774, 776 are concave projections or cups with a slot 784 in the center. Slots 784 are configured to allow for cord 764 to pass through receivers 774, 776 when the anchors 767, 768 are attached. In this way, sunshade 762 is secured to sunshade attachment system 772.

When attached to the fan system 710, sunshade 762 hangs down from brim mounting bracket 712 and past lower edge 78 of hard hat 10 to protect the neck of a user. Sunshade 762 is spaced away from fan 700 to not interfere with the operation of fan 700.

Referring generally to FIGS. 63-71, a hard hat fan system including protective helmet or hard hat 10, a fan 800, and a foam or impact absorbing layer 810 is shown according to an exemplary embodiment. Fan 800 is substantially the same as fans 100, 200, 300, 400, 500, and 600 except for the differences discussed herein. Impact absorbing layer 810 is substantially the same as impact absorbing layers 434, 536, and 636 except for the differences discussed herein. Specifically, impact absorbing layer 810 includes at least one channel that defines a duct between an outer surface of impact absorbing layer 810 and inner surface 80 of shell 11 of hard hat 10.

As shown, fan 800 is coupled to outer surface 15 of shell 11. Specifically, fan 800 is coupled to rear mounting feature 18 located on rear side surface 16 of shell 11. As shown, fan 800 is coupled to mounting bracket 812, and mounting bracket 812 is coupled to mount ridge 24 which extends from rear side surface 16.

Fan 800 includes an air intake 818 and an exhaust or air outlet 820. Ambient air enters fan 800 through intake 818 and exits through outlet 820. So, fan 800 is configured to provide fluid communication for air between intake 818 and outlet 820. Intake 818 is positioned on a front surface of a body 802 of fan 800 and faces away from outer surface 15 of shell 11. Outlet 820 is positioned at a bottom of fan 800 below intake 818. Fan 800 is mounted above lower edge 78 of hard hat 10 such that outlet 820 does not extend below lower edge 78.

Fan 800 further includes a power source, shown as battery cell 830. Battery cell 830 is configured to slidably engage with fan 800 to power fan 800. Specifically, battery cell 830 is received within body 802 of fan 800.

As shown, foam or impact absorbing layer 810 is coupled to hard hat 10. Impact absorbing layer is centered on a central axis 836. Impact absorbing layer 810 includes an inner surface 832 and an outer surface 834 opposite inner surface 832. Outer surface 834 is coupled to inner surface 80 of shell 11 of hard hat 10. Inner surface 832 is helmet shaped and defines an interior region configured to receive a head of a user. Impact absorbing layer 810 may be coupled to hard hat 10 through any suitable attachment mechanism, such as adhesives, fasteners, or friction fit arrangements. Shell 11 is formed from a first material and impact absorbing layer 810 is formed from a second material that is different from the first material. Impact absorbing layer 810 is formed from a material selected based on regional impact performance requirements for hard hats or protective helmets. Specifically, impact absorbing layer 810 is made of expanded polystyrene. More specifically, impact absorbing layer 810 is made of expanded polystyrene with a density of 1.6 pounds per cubic foot.

Impact absorbing layer 810 includes a plurality of cavities 840 that extend through impact absorbing layer 810 from inner surface 832 to outer surface 834. Cavities 840 may align with a plurality of ports 838 located along shell 11 to allow ambient air to enter hard hat 10. As shown, cavities 840 are polygonal shapes and evenly spaced around impact absorbing layer 810.

At least one recessed surface 842 is formed in outer surface 834 of impact absorbing layer 810. Each recessed surface 842 extends into impact absorbing layer 810 away from inner surface 80 of shell 11. Each recessed surface 842 defines at least one channel 844. Each channel 844 extends along outer surface 834 and includes an inlet 846 and an end 848. Applicant believes that defining channels by forming recessed surfaces 842 in outer surface 834 of impact absorbing layer 810 (rather than ducts that are embedded within impact absorbing layer 810) may provide manufacturing advantages by allowing easy molding of recessed surfaces 842 on outer surface 834.

A primary duct 822 extends between fan 800 and impact absorbing layer 810. Primary duct 822 is configured to provide fluid communication for air between fan 800 and each channel 844. Specifically, primary duct 822 is coupled to outlet 820 of fan 800. Primary duct 822 may be coupled to outlet 820 through a friction fit arrangement, such as through an interference fit, snap fit, or press-fit arrangement.

Primary duct 822 directs air from outlet 820 of fan 800 into inlet 846 of each channel 844. A first end 854 of primary duct 822 is coupled to fan 800, while a second end 856 abuts inner surface 832 of impact absorbing layer 810 around inlet 846. In a certain embodiment, impact absorbing layer 810 and primary duct 822 have a small overlap used to reduce leakage of air between impact absorbing layer 810 and primary duct 822. Primary duct 822 extends below and around lower edge 78 of hard hat 10 such that primary duct 822 does not contact lower edge 78. As such, fan 800, mounting bracket 812, and primary duct 822 may be removably coupled to hard hat 10.

Each channel 844 defines a secondary duct between outer surface 834 of impact absorbing layer 810 and inner surface 80 of shell 11. At least one air vent 850 is located along each channel 844. Air vents 850 extend through each recessed surface 842. Air vents 850 are openings configured to provide air to the head of a user. Air vents 850 extend from recessed surface 842 through impact absorbing layer 810 to inner surface 832.

The secondary ducts defined between outer surface 834 of impact absorbing layer 810 and inner surface 80 of hard hat 10 provide fluid communication between inlets 846 and air vents 850. So, air flows from inlet 846 along each channel 844 to air vents 850 and into the interior region defined by impact absorbing layer 810.

As such, hard hat fan system is configured to provide fluid communication for air between an exterior of shell 11 and the interior region in order to provide a cooling sensation to a user when the user's head is positioned within the interior region. Specifically, air flows from intake 818 of fan 800 through outlet 820 of fan into primary duct 822 through secondary ducts defined by channels 844 and out air vents 850. Applicant believes that by providing a duct defined between outer surface 834 of impact absorbing layer 810 and inner surface 80 of shell 15, rather than a duct embedded within impact absorbing layer 810, that air movement and heat/moisture transfer away from a user's head may be improved.

In a certain embodiment, shell 11 includes an uninterrupted surface along each channel 844 such that there are no openings extending between recessed surface 842 and outer surface 15 of the shell 11. Specifically, there are no ports 838 located along shell 11 above channels 844. Additionally, cavities 840 do not intersect with channels 844. So, each channel 844 is separate and distinct from each other and from cavities 840.

Figure 68:
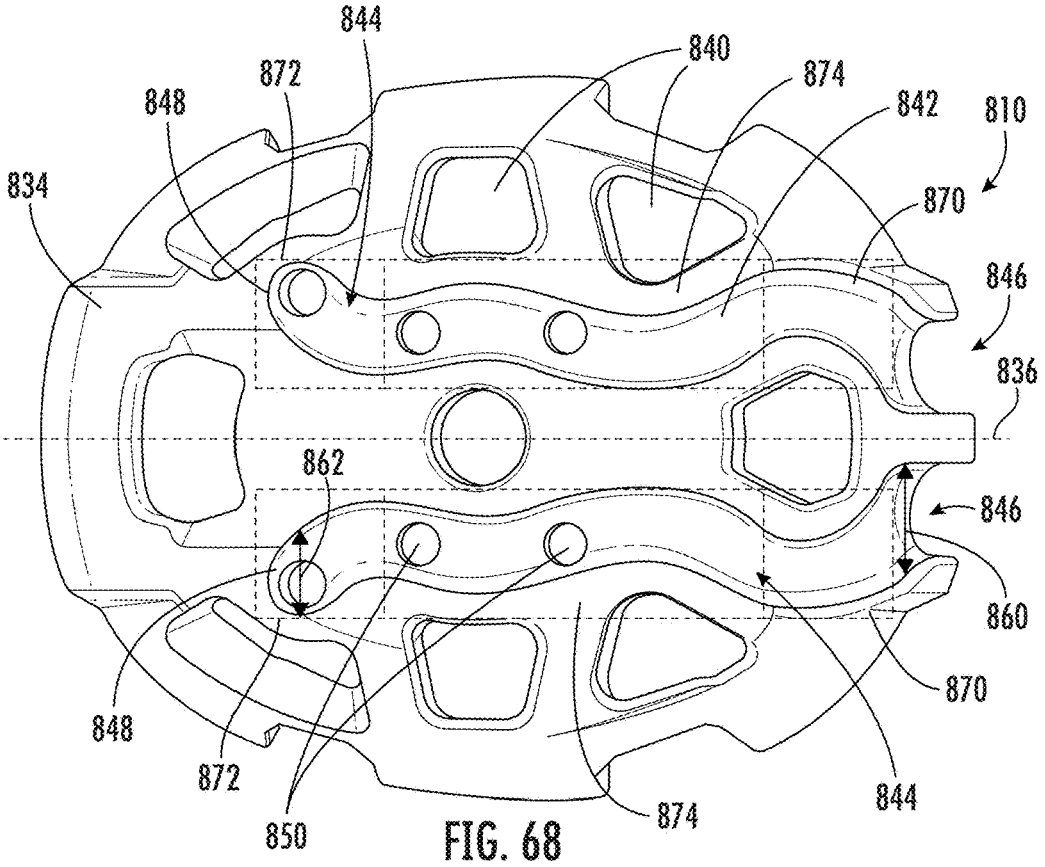
FIG. 68 is a top plan view of the impact absorbing layer of the fan system of FIG. 63, according to an exemplary embodiment.
Figure 69:
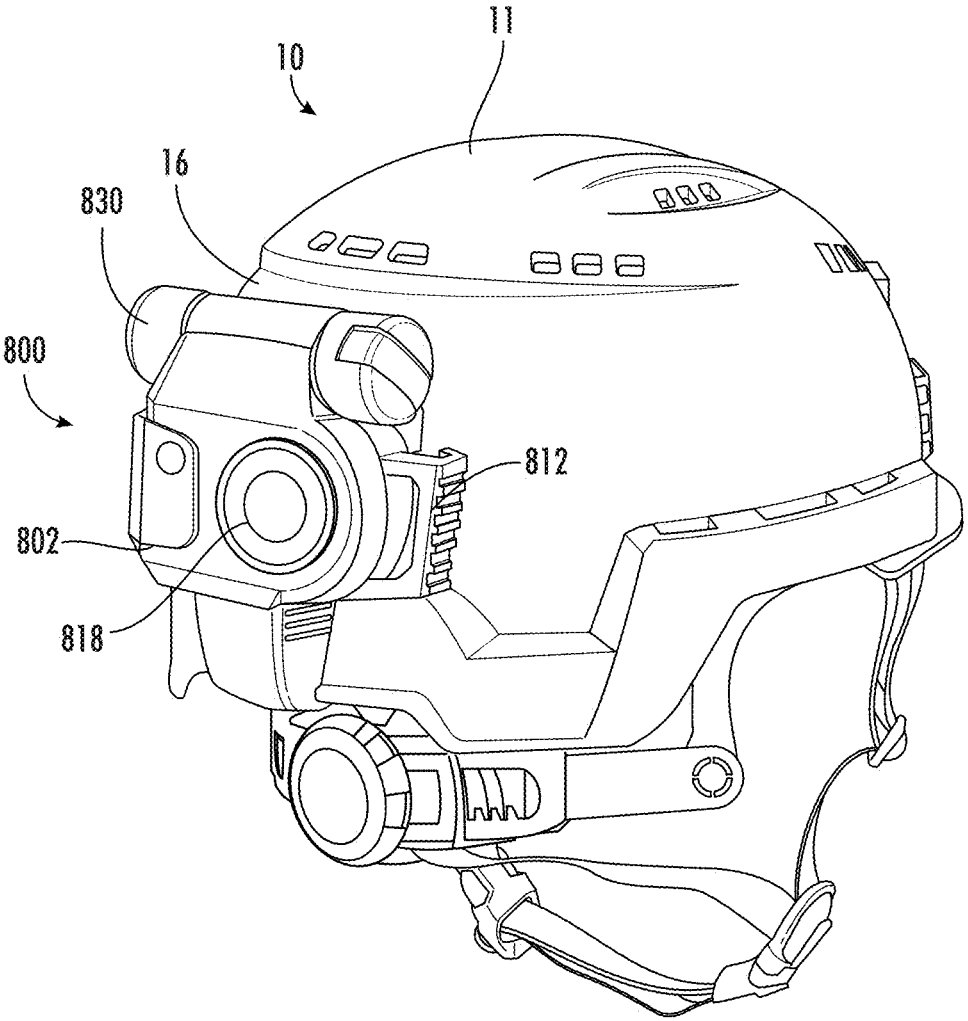
FIG. 69 is a rear perspective view the fan system and hard hat of FIG. 63 with a horizontally mounted battery, according to an exemplary embodiment.

Referring to FIG. 68, impact absorbing layer 810 includes two channels 844, one located on each side of central axis 836. Each channel 844 extends along the length of impact absorbing layer 810 from inlet 846 to end 848. Channels 844 terminates within impact absorbing layer 810 such that end 848 of each channel 844 is spaced from an outer perimeter of impact absorbing layer 810.

Channels 844 have a length defined between inlet 846 and an end 848 that is less than the length of the impact absorbing layer 810 defined along central axis 836. In a certain embodiment, channels 844 have a length at least 50% of the length of impact absorbing layer 810. More specifically, the channel length is at most 90% of the length of impact absorbing layer 810. In another embodiment, the channel length is between 60% and 70% of the length of impact absorbing layer 810. In a specific embodiment, the length of impact absorbing layer 810 is at least 9 inches and at most 10 inches, and the length of channel 844 is at least 6 inches and at most 7 inches.

Each inlet 846 defines a first channel width 860 and each end 848 defines a second channel width 862. In a certain embodiment, first channel width 860 is greater than second channel width 862. As such, inlet 846 has a greater width than end 848.

As shown, each channel 844 includes a plurality of bending sections between inlet 846 and end 848. Specifically, inlet 846 of each channel 844 is located closer to central axis 836 than end 848 of each channel 844. Each channel 844 includes a first or inlet section 870 that extends from inlet 846 and a second or end section 872 extending from end 848. A middle section 874 extends between inlet section 870 and end section 872.

In a specific embodiment, inlet sections 870 of channels 844 bend towards central axis 836. So, the two inlet sections 870 are concave with respect to each other. In another specific embodiment, end section 872 bend away from central axis 836. So, the two end sections 872 are convex with respect to each other. In another specific embodiment, middle section 874 of each channel 844 includes two bends. So, at least a portion of middle sections 874 are concave with respect to each other, and at least a portion of middle sections 874 are convex with respect to each other.

As shown, each channel 844 includes three air vents 850 spaced along channel 844. One air vent 850 on each channel 844 is located within end section 872 and is adjacent to end 848. The other air vents 850 are located within middle section 874.

Figure 70:
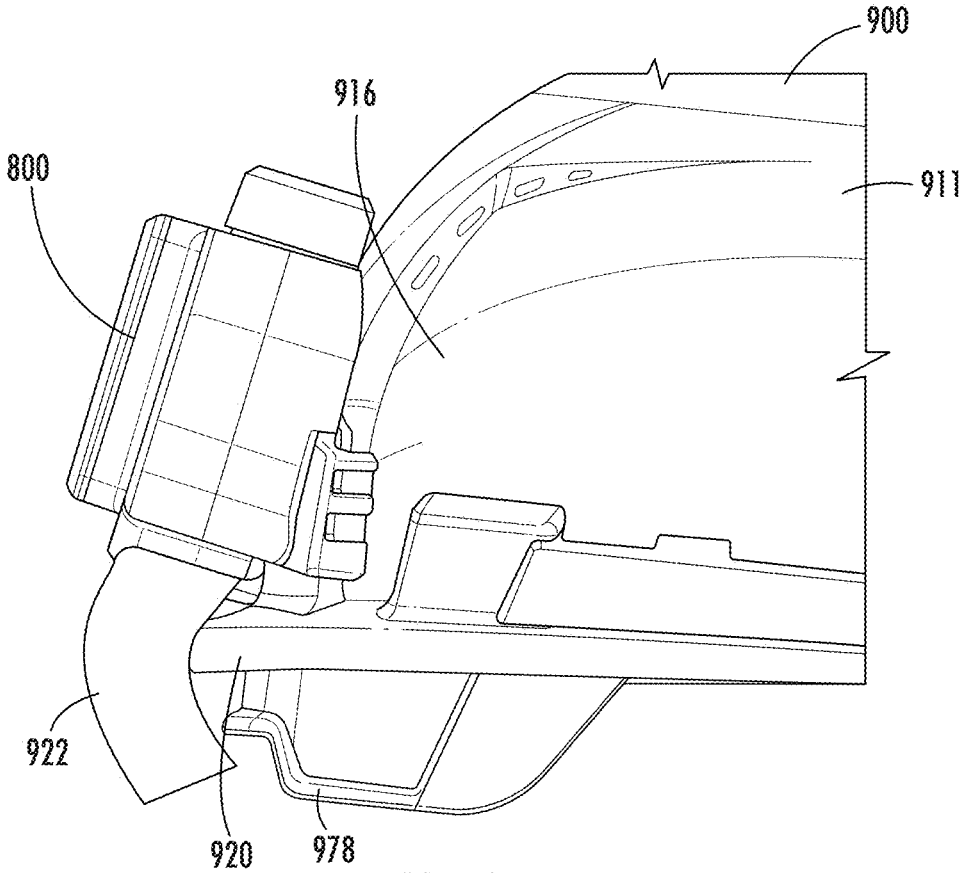
FIG. 70 is a detailed side view of a hard hat and primary duct, according to an exemplary embodiment.
Figure 71:
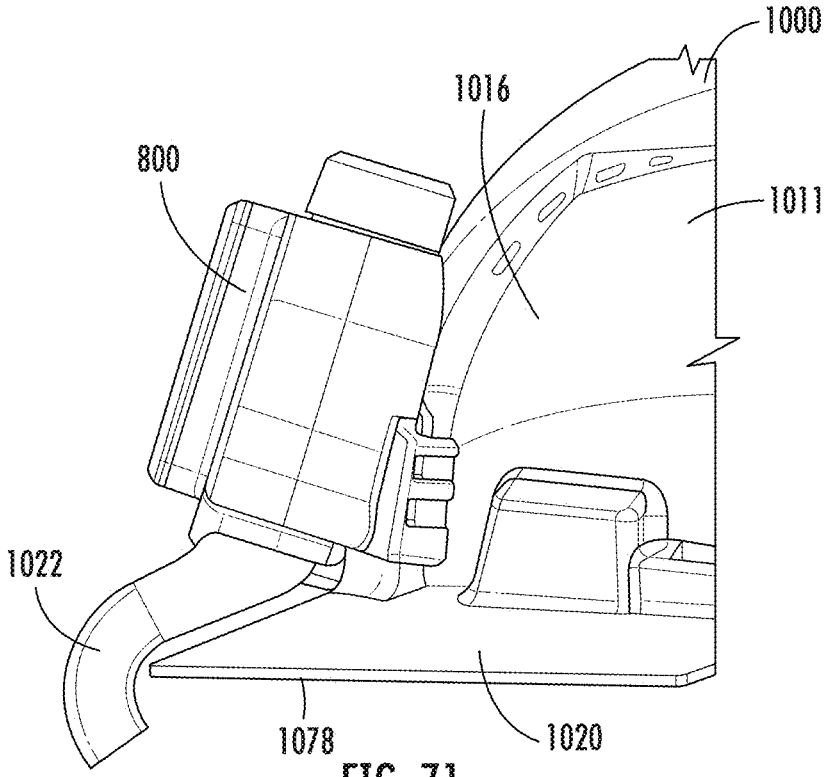
FIG. 71 is a detailed side view of a hard hat and primary duct, according to an exemplary embodiment.
Figure 72:
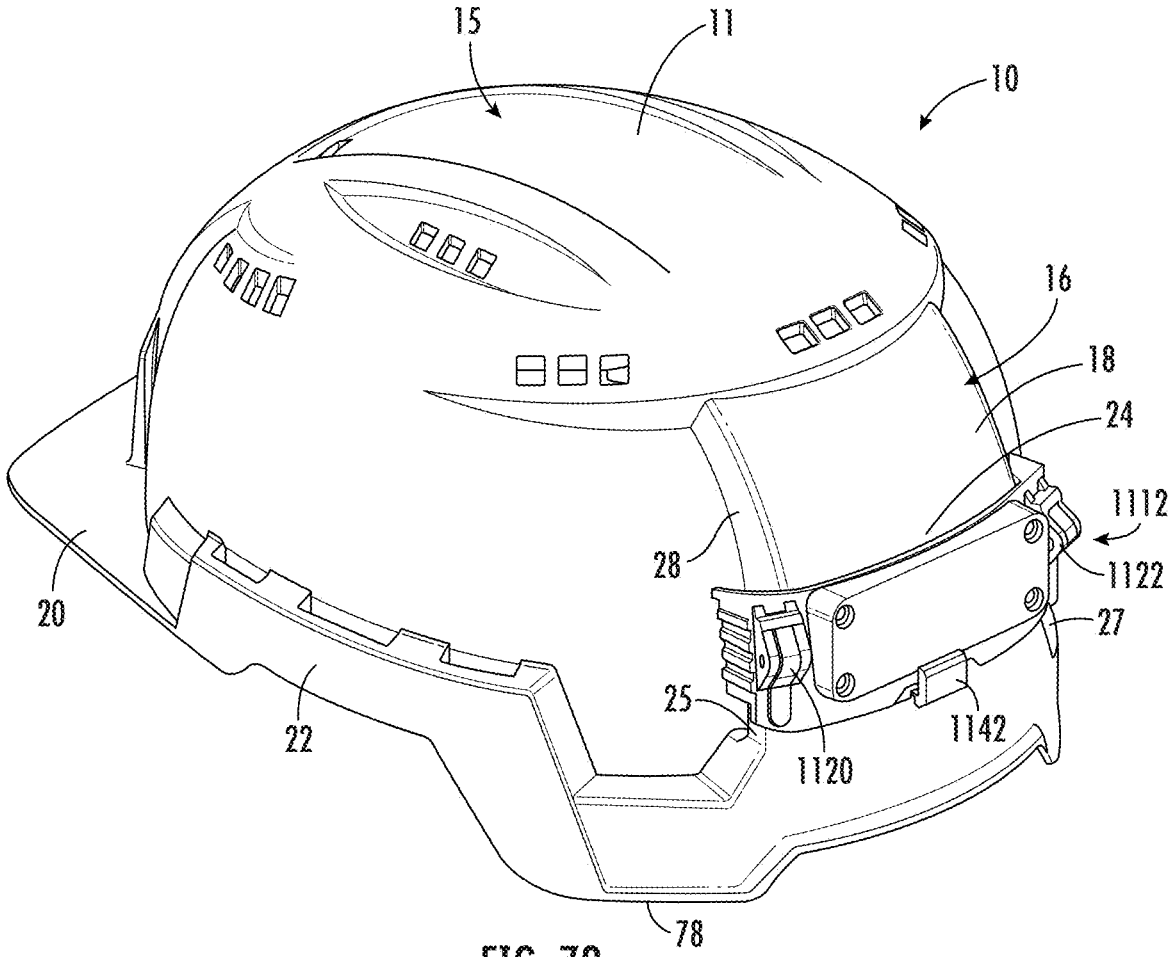
FIG. 72 is a rear perspective view of a hard hat with a mounting bracket, according to an exemplary embodiment.
Figure 73:
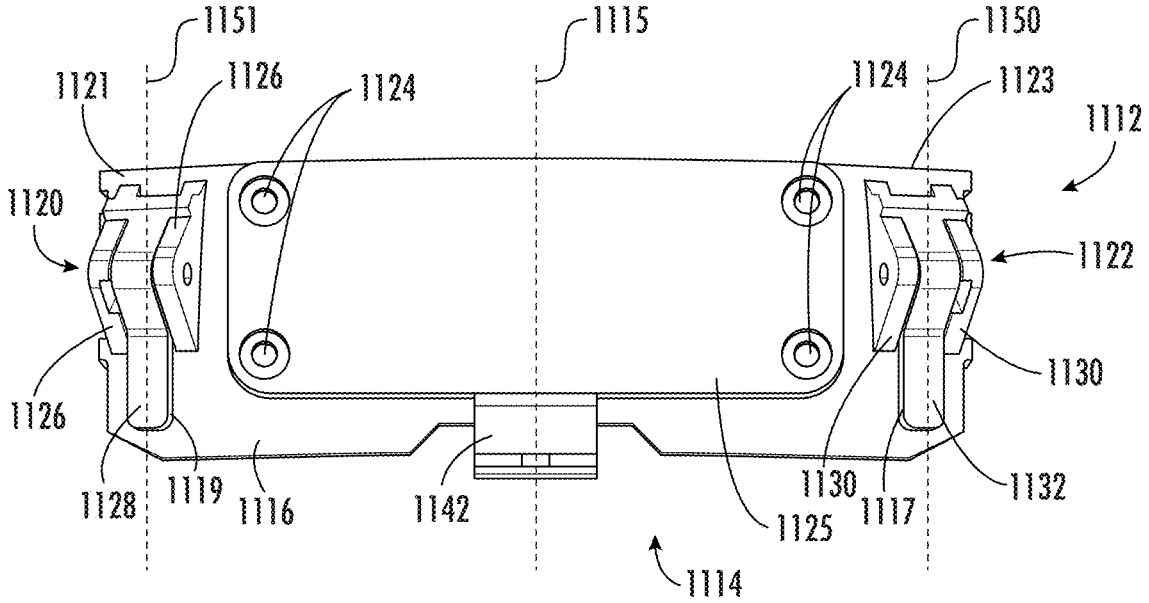
FIG. 73 is a front plan view of the mounting bracket of FIG. 70, according to an exemplary embodiment.
Figure 74:
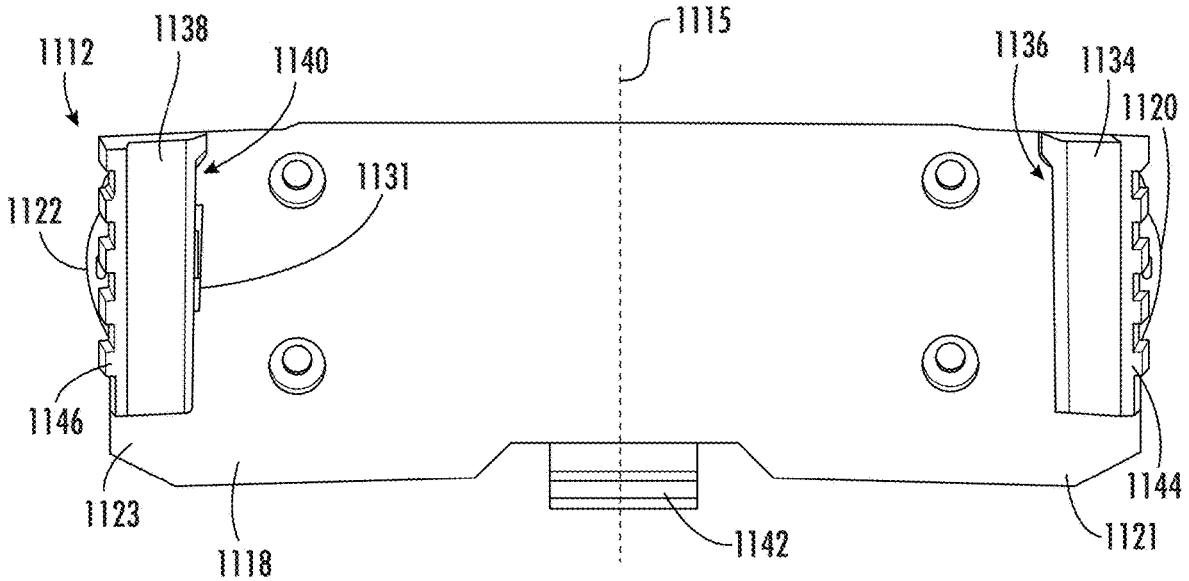
FIG. 74 is a rear plan view of the mounting bracket of FIG. 70, according to an exemplary embodiment.
Figure 75:
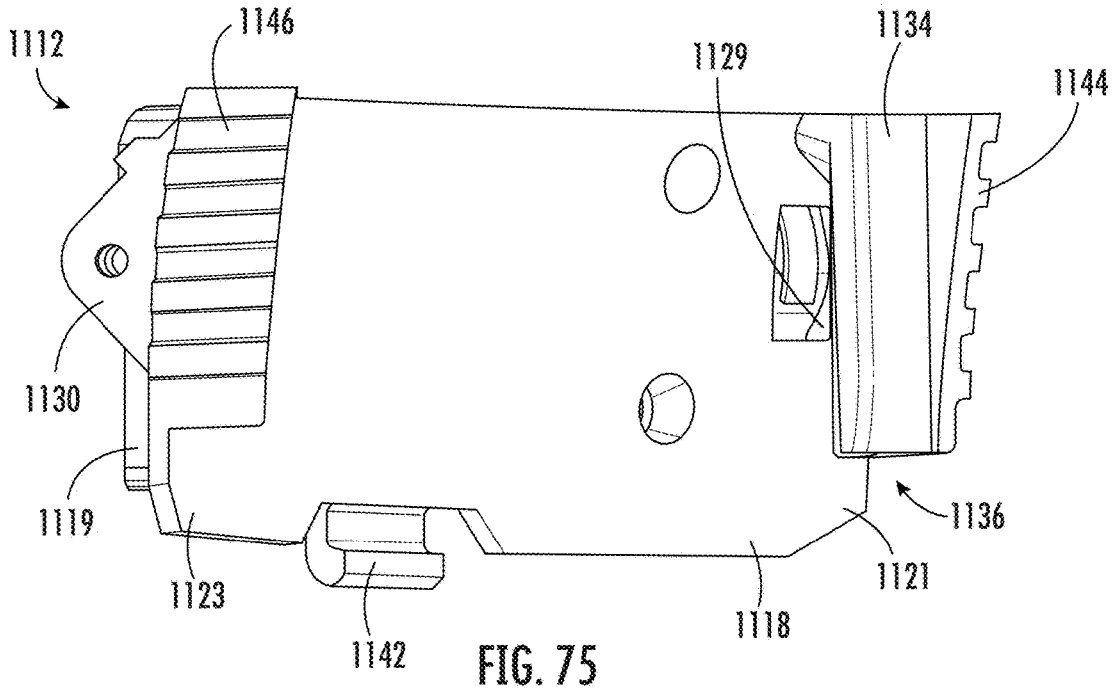
FIG. 75 is a perspective view of the mounting bracket of FIG. 70, according to an exemplary embodiment.
Figure 76:
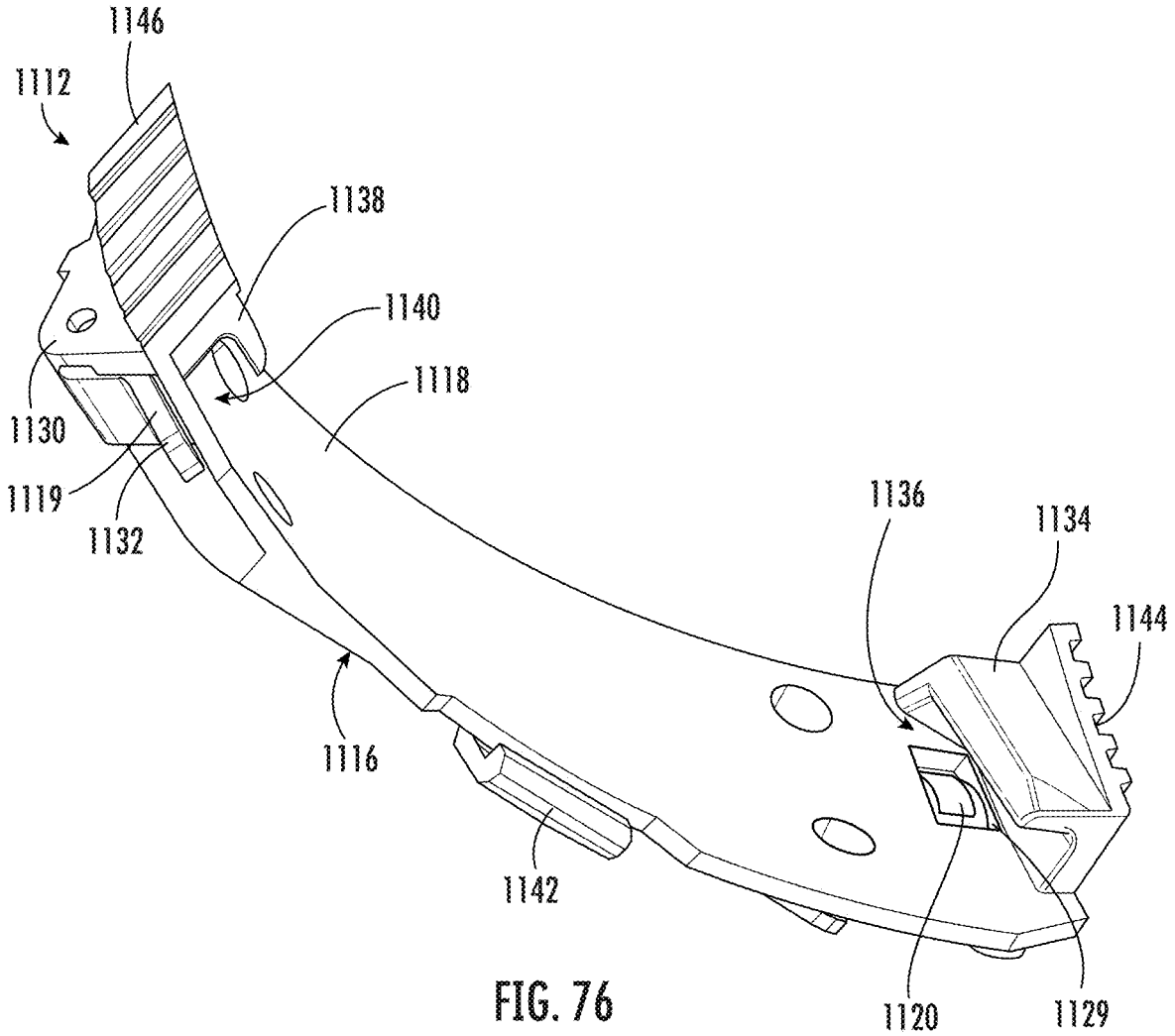
FIG. 76 is a perspective view of the mounting bracket of FIG. 70, according to an exemplary embodiment.

Referring to FIGS. 70-71, fan 800 is configured to be retrofittable with different primary ducts in order to accommodate different hard hats. As shown in FIGS. 71-72, alternative embodiments of the primary duct may be attached to outlet 820 of fan 800.

Referring to FIG. 71, hard hat 900 is shown with primary duct 922 coupled to fan 800. Hard hat 900 is substantially the same as hard hat 10 except that it includes a partial brim 920 around rear surface 916. Primary duct 922 is substantially the same as primary duct 822 except that primary duct 922 abuts partial brim before bending towards lower edge 978. In certain embodiments, primary duct may extend under lower edge 978 and abut an impact absorption layer.

Referring to FIG. 71, hard hat 10 is shown with primary duct 1022 coupled to fan 800. Hard hat 1000 is substantially the same as hard hats 10 and 900 except that it includes a full brim 1020 around rear surface 1016. Primary duct 1022 is substantially the same as primary ducts 822 and 922 except that primary duct 1022 extends along full brim 1020 before bending towards and around lower edge 1078. As shown, primary duct 1022 is spaced from full brim 1020. In certain embodiments, primary duct 1022 may extend under lower edge 1078 and abuts an impact absorption layer.

Referring generally to FIGS. 72-76, hard hat 10 with a mounting bracket 1112 is shown according to an exemplary embodiment. Mounting bracket 1112 is substantially similar to mounting brackets 112, 212, 312, 412, 512, 612, and 812 except for the differences discussed herein. Mounting bracket 1112 may be used to couple a fan, such as fans 100, 200, 300, 400, 500, 600, and 800, or another hard hat accessory to a hard hat or a protective helmet.

Mounting bracket 1112 is securely and removably coupled to mounting ridge 24 and, more specifically, to first edge 25 and second edge 27. Mounting bracket 1112 includes a mounting plate 1114. Mounting plate 1114 includes a front surface 1116 and a back surface 1118 opposite front surface 1116. Mounting plate 1114 extends along a longitudinal axis 1115.

A first cam lock 1120 and a second cam lock 1122 are coupled front surface 1116 of mounting plate 1114. First cam lock 1120 is located on a first end 1121 of mounting plate 1114, and second cam lock 1122 is located on a second end 1123 of mounting plate 1114.

A center portion 1125 is located on front surface 1116 between first cam lock 1120 and second cam lock 1122. Center portion 1125 extends in a direction away from front surface 1116 and away from back surface 1118. Center portion 1125 includes openings 1124. Openings 1124 extend through front surface 1116 to back surface 1118 and are configured to receive a fastener to couple a fan or other accessory to mounting bracket 1112.

First cam lock 1120 includes retainers 1126 and a first cam lever 1128. First cam lever 1128 is pivotably coupled to front surface 1116. First cam lever 1128 is configured to actuate between a locked and unlocked position. First cam lever 1128 actuates along a pivot axis 1150 that is parallel to longitudinal axis 1115.

Specifically, first cam lever 1128 is rotatably coupled to retainers 1126. Retainers 1126 are coupled to front surface 1116 and are substantially parallel with each other. Each retainer 1126 extends in a direction away from front surface 1116. First cam lever 1128 is at least partially retained in a first slot 1129 such that first cam lever 1128 extends at least part way through mounting plate 1114. First slot 1129 extends through mounting plate 1114 from front surface 1116 to back surface 1118.

Specifically, a portion of first cam lever 1128 extends from front surface 1116 and through back surface 1118 when first cam lever 1128 is moved into the locked position. In this way, when in the locked position, a portion of first cam lever 1128 extends through first slot 1129 and is fully surrounded by mounting plate 1114. That is, a portion of first cam lever 1128 is surrounded by mounting plate 1114 on at least three sides. As shown, when in the locked position, a first tab 1117 of first cam lever 1128 abuts front surface 1116 and lies flat against front surface 1116.

Similar to first cam lock 1120, second cam lock 1122 includes retainers 1130 and second cam lever 1132. Second cam lever 1132 is pivotably coupled to front surface 1116. Second cam lever 1132 is configured to actuate between a locked and unlocked position. Second cam lever 1132 actuates along a pivot axis 1151 that is parallel to longitudinal axis 1115.

Specifically, second cam lever 1132 is rotatably coupled to retainers 1130. Retainers 1130 are coupled to front surface 1116 and are substantially parallel with each other. Each retainer 1130 extends in a direction away from front surface 1116. Second cam lever 1132 is at least partially retained in second slot 1131 such that second cam lever 1132 extends at least part way through mounting plate 1114. Second slot 1131 extends through mounting plate 1114 from front surface 1116 to back surface 1118.

Specifically, a portion of second cam lever 1132 extends from front surface 1116 and through back surface 1118 when cam lever is moved into the locked position. In this way, when in the locked position, a portion of second cam lever 1132 extends through second slot 1131 and is fully surrounded by mounting plate 1114. This is, a portion of second cam lever 1132 is surrounded by mounting plate 1114 on at least three sides. When in the locked position, a second tab 1119 of second cam lever 1132 abuts front surface 1116 and lies flat against front surface 1116.

Back surface 1118 includes a first projection 1134 that defines a first channel 1136 and a second projection 1138 that defines a second channel 1140. First projection 1134 and second projection 1138 are coupled to and extend away from back surface 1118. First projection 1134 and second projection 1138 extend in a direction away from back surface 1118 and away from front surface 1116.

First projection 1134 and first channel 1136 are located on first end 1121 along back surface 1118 opposite first cam lock 1120. First channel 1136 is configured to couple to first edge 25 of mounting ridge 24. Second projection 1138 and second channel 1140 are located on second end 1123 opposite second cam lock 1122. Second channel 1140 is configures to couple to second edge 27 of mounting ridge 24.

When mounting bracket 1112 is mounted on mounting ridge 24, first cam lever 1128 and second cam lever 1132 are actuated into the locked position. When actuated into the locked position, first cam lever 1128 biases first edge 25 of mounting ridge 24 against first channel 1136, and second cam lever 1132 biases second edge 27 of mounting ridge 24 against second channel 1140 such that mounting bracket 1112 is retained on shell 11 of hard hat 10.

First cam lever 1128 and second cam lever 1132 may be user actuated or spring loaded. When user actuated, a user moves the first cam lever 1128 and second cam lever 1132 into the locked position when mounting bracket 1112 is mounted on mounting ridge 24. To remove mounting bracket 1112, the user would actuate first cam lever 1128 and second cam lever 1132 into the unlocked position in order to disengage mounting bracket 1112 from mounting ridge 24.

When spring loaded such that first cam lever 1128 and second cam lever 1132 are actuated by a spring. In such embodiment, first cam lock 1120 includes a first spring (not shown) and second cam lock 1122 include a second spring (not shown). The first spring and second spring are configured to bias first cam lever 1128 and second cam lever 1132 into the locked position. As such, when first cam lock 1120 and second cam lock 1122 are pressed against mounting ridge 24 the springs actuate first cam lever 1128 and second cam lever 1132 into the locked position to retain mounting bracket 1112 on mounting ridge 24. To remove mounting bracket 1112, the user would actuate first cam lever 1128 and second cam lever 1132 into the unlocked position, compressing the first spring and the second spring, and allow mounting bracket 1112 to disengage from mounting ridge 24.

Mounting bracket 1112 further includes a clip 1142. Clip 1142 is configured to engage retention cleat 30 to assist in retaining mounting bracket 1112 on mounting ridge 24. Clip 1142 is located between first channel 1136 and second channel 1140. Specifically, clip 1142 is centered on mounting plate 1114 between first end 1121 and second end 1123. Clip 1142 is coupled to front surface 1116 and extends below mounting plate 1114.

As shown, mounting bracket 1112 includes a first side ridge 1144 and a second side ridge 1146. First side ridge 1144 and second side ridge 1146 are configured to engage with outer surface 15 of shell 11 when mounting bracket 1112 is coupled to mounting ridge 24.

First side ridge 1144 is located on first end 1121 of mounting plate 1114. First side ridge 1144 is adjacent to first projection 1134 and first channel 1136. First side ridge 1144 extends in a direction away from back surface 1118 of mounting plate 1114. As shown, first side ridge 1144 includes a ribbed surface with a plurality of ribs. The ribbed surface provides a grip surface to assist a user in mounting and removing mounting bracket 1112 from shell 11.

Second side ridge 1146 is located on second end 1123 of mounting plate 1114. Second side ridge 1146 is adjacent to second projection 1138 and second channel 1140. Second side ridge 1146 extends in a direction away from back surface 1118 of mounting plate 1114. As shown, second side ridge 1146 includes a ribbed surface with a plurality of ribs. The ribbed surface provides a grip surface to assist a user in mounting and removing mounting bracket 1112 from shell 11.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes, and omissions may also be made in the design, operating conditions, and arrangement of the various exemplary embodiments without departing from the scope of the present invention.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

In various exemplary embodiments, the relative dimensions, including angles, lengths, and radii, as shown in the Figures are to scale. Actual measurements of the Figures will disclose relative dimensions, angles, and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

What is claimed is:

1. A hard hat fan system, comprising:

a shell comprising an outer surface and an inner surface opposite the outer surface;

a fan coupled to the outer surface of the shell, the fan comprising:

an intake; and an outlet positioned on a bottom surface of the fan;

a primary duct coupled to the outlet of the fan, the primary duct extending below a lower edge of the shell;

an impact absorbing layer defining an interior region configured to receive a head of a user, the impact absorbing layer comprising:

an outer surface facing the inner surface of the shell;

an inner surface opposite the outer surface of the impact absorbing layer;

a channel defining a recessed surface along the outer surface of the impact absorbing layer; and an air vent positioned along the channel and extending through the recessed surface to the inner surface of the impact absorbing layer;

wherein the channel defines a secondary duct between the outer surface of the impact absorbing layer and the inner surface of the shell; and wherein the hard hat fan system is configured to provide fluid communication for air between an exterior of the shell and the interior region.

2. The hard hat fan system of claim 1, wherein a first end of the primary duct is coupled to the outlet of the fan and a second end of the primary duct, opposite the first end, directs air around the lower edge of the shell and towards an inlet side of the secondary duct.

3. The hard hat fan system of claim 2, wherein the second end of primary duct abuts the inner surface of the impact absorbing layer.

4. The hard hat fan system of claim 2, wherein, when coupled to the outlet of the fan, the second end of the primary duct is stationary with respect to the lower edge of the shell.

5. The hard hat fan system of claim 1, wherein the fan is positioned along the outer surface of the shell such that the outlet does not extend below the lower edge of the shell.

6. The hard hat fan system of claim 1, wherein the primary duct is removably coupled to the outlet of the fan.

7. The hard hat fan system of claim 1, wherein the channel terminates within the impact absorbing layer such that an end portion of the channel is spaced from an outer perimeter of the impact absorbing layer.

8. The hard hat fan system of claim 7, wherein the air vent is located in the end portion of the channel.

9. The hard hat fan system of claim 1, wherein the channel has an inlet side and an end portion, wherein the channel has a length defined between the inlet side and the end portion that is less than a length of the impact absorbing layer defined along a central axis of the impact absorbing layer.

10. The hard hat fan system of claim 1, wherein the shell includes an uninterrupted surface along the channel such that there are no openings extending between the recessed surface and the outer surface of the shell.

11. A hard hat fan system, comprising:

a shell comprising an inner surface and an outer surface opposite the inner surface;

a fan coupled to the outer surface of the shell; and an impact absorbing layer, comprising:

an outer surface facing the inner surface of the shell;

an inner surface opposite the outer surface of the impact absorbing layer;

a channel defining a recessed surface along the outer surface of the impact absorbing layer, the recessed surface extending away from the inner surface of the shell; and an air vent extending through recessed surface to the inner surface of the impact absorbing layer; and wherein the inner surface of the shell and the recessed surface of the impact absorbing layer define a duct configured to provide fluid communication between an inlet of the channel and the air vent.

12. The hard hat fan system of claim 11, wherein the channel terminates within the impact absorbing layer such that an end of the channel is spaced from an outer perimeter of the impact absorbing layer.

13. The hard hat fan system of claim 11, wherein the shell is formed from a first material and the impact absorbing layer is formed from a second material that is different from the first material.

14. The hard hat fan system of claim 11, wherein the shell includes an uninterrupted surface along the channel such that there are no openings extending between the recessed surface and the outer surface of the shell.

15. The hard hat fan system of claim 11, further comprising a mounting bracket coupled to the outer surface of the shell, wherein the fan is removably coupled to the mounting bracket.

16. The hard hat fan system of claim 15, wherein the fan is positioned along the mounting bracket such that it is spaced from a first side of the mounting bracket and spaced from a second side of the mounting bracket opposite the first side.

17. A hard hat fan system, comprising:

a shell comprising an outer surface and an inner surface opposite the outer surface;

a fan coupled to the outer surface of the shell, the fan comprising:

an intake positioned on a front surface of the fan facing away from the outer surface of the shell; and an outlet positioned on a bottom surface of the fan below the intake, wherein the fan is positioned along the outer surface of the shell such that the outlet does not extend below a lower edge of the shell;

a primary duct comprising a first end coupled to the outlet of the fan and a second end opposite the first end, the second end extending below the lower edge of the shell; and an impact absorbing layer coupled to the inner surface of the shell and defining an interior region configured to receive a head of a user, the impact absorbing layer comprising at least one channel extending a distance along a length of the impact absorbing layer; and wherein the hard hat fan system is configured to provide fluid communication for air between an exterior of the shell and the interior region through the at least one channel.

18. The hard hat fan system of claim 17, wherein the second end of the primary duct abuts an inner surface of the impact absorbing layer.

19. The hard hat fan system of claim 17, wherein a portion of the primary duct bends in a direction towards the lower edge of the shell.

20. The hard hat fan system of claim 17, wherein the at least one channel defines a recessed surface along an outer surface of the impact absorbing layer, and wherein the inner surface of the shell and the recessed surface of the impact absorbing layer define at least one secondary duct.

* * * * *